US005989789A

United States Patent [19]

Nakagawa et al.

[11] Patent Number: 5,989,789

[45] **Date of Patent: *Nov. 23, 1999**

[54] SILVER HALIDE COLOR PHOTOGRAPHIC MATERIAL AND METHOD FOR FORMING IMAGE

[75] Inventors: Hajime Nakagawa; Akimitsu Haijima, both of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/673,212

[22] Filed: Jun. 27, 1996

[30] Foreign Application Priority Data

Jun. 27, 1995 [JP] Japan ..... 7-182294
Jul. 24, 1995 [JP] Japan ..... 7-207325

[51] Int. Cl.[6] ..... G03C 7/407

[52] U.S. Cl. ..... 430/382; 430/445; 430/446; 430/486; 430/963

[58] Field of Search ..... 430/505, 544, 430/957, 382, 445, 446, 486, 963

[56] References Cited

U.S. PATENT DOCUMENTS

| | | | |
|---|---|---|---|
| 4,500,634 | 2/1985 | Sakanoue et al. | 430/544 |
| 4,947,196 | 8/1990 | Wash et al. | 354/76 |
| 5,344,750 | 9/1994 | Fujimoto et al. | 430/487 |
| 5,376,484 | 12/1994 | Iwagaki | 430/533 |
| 5,455,146 | 10/1995 | Nishikawa et al. | 430/391 |
| 5,498,513 | 3/1996 | Mikayashi et al. | 430/505 |
| 5,506,094 | 4/1996 | Merkel et al. | 430/957 |
| 5,529,894 | 6/1996 | Mihayashi et al. | 430/957 |
| 5,545,513 | 8/1996 | Edwards | 430/505 |
| 5,571,661 | 11/1996 | Isbige et al. | 430/957 |
| 5,576,158 | 11/1996 | Ford et al. | 430/544 |
| 5,618,656 | 4/1997 | Szajewski et al. | 430/957 |
| 5,630,927 | 5/1997 | Kawagishi et al. | 430/544 |

FOREIGN PATENT DOCUMENTS

| | | |
|---|---|---|
| 0 329 016 | 8/1989 | European Pat. Off. . |
| 0 458 315 A1 | 11/1991 | European Pat. Off. . |
| 0 467 300 A1 | 1/1992 | European Pat. Off. . |
| 0 569 975 A1 | 11/1993 | European Pat. Off. . |
| 59-129849 | 7/1984 | Japan . |
| WO 90/04254 | 4/1990 | WIPO . |

*Primary Examiner*—Hoa Van Le
*Attorney, Agent, or Firm*—Birch, Stewart, Kolasch & Birch, LLP

[57] ABSTRACT

A silver halide color photographic material comprising a transparent support having thereon at least one blue-sensitive silver halide emulsion layer, at least one green-sensitive silver halide emulsion layer, at least one red-sensitive silver halide emulsion layer and at least one light-insensitive layer, wherein said red-sensitive silver halide emulsion layer contains at least one compound which releases a development inhibitor having a diffusion parameter of 0.3 or more upon reaction with the oxidation product of a color developing agent, and when development processing I and development processing II each defined in the specification are carried out, the gradients of yellow, magenta and cyan obtained by said two kinds of development processing satisfy the following conditions:

$0.8 \leqq \gamma_{II}(Y)/\gamma_{I}(Y) \leqq 1.2$ $0.8 \leqq \gamma_{II}(M)/\gamma_{I}(M) \leqq 1.2$ $0.8 \leqq \gamma_{II}(C)/\gamma_{I}(C) \leqq 1.2$ wherein $\gamma_I$ (Y), $\gamma_I$ (M), $\gamma_I$ (C), $\gamma_{II}$ (Y), $\gamma_{II}$(M) and $\gamma_{II}$ (C) each is defined in the specification.

14 Claims, No Drawings

SILVER HALIDE COLOR PHOTOGRAPHIC MATERIAL AND METHOD FOR FORMING IMAGE

FIELD OF THE INVENTION

The present invention relates to a silver halide color photographic material which is free from the degradation of the balance of gradation, the deteriorations of color reproducibility and sharpness, and the lowering of the capability of magnetic recording, which become problems at rapid processing, and relates to a method for forming an image.

BACKGROUND OF THE INVENTION

Every endeavor has been made to shorten the development processing time of a color photographic material. The development processing time of a color negative light-sensitive material has been extremely reduced by the introduction of C-41 processing by Eastman Kodak in 1972. The wet processing time exclusive of drying process has been shortened to 17 minutes and 20 seconds, and in recent years, the processing time has been speeded up to 8 minutes and 15 seconds by the introduction of rapid processing CN-16FA of Fuji Photo Film Co., Ltd. for a minilab market.

On the other hand, in the processing method of a light-sensitive material, in general, color development, desilvering, washing and stabilization steps are carried out. Taking development processing of a color negative film as an example, the reduction of the time of these development processing steps has been conducted mainly by the shortening of desilvering step, therefore, the speedup of the color development processing time is desired.

The shortening of the color developing time is feasible by raising the processing temperature of a color development processing solution and the concentration of a developing agent. However, it has been found that raising only the activity of the color development by these methods causes various problems. For example, the development of a red-sensitive layer of a color negative film, which is generally the lowermost light-sensitive emulsion layer, is relatively delayed, as a result, the balance of gradation is lost, and the deteriorations of color reproducibility and sharpness due to the lowering of an interlayer effect occur.

The present inventors further investigated and have found that a DIR compound having a high diffusibility is very effective for solving the above problems concerning the rapid processing. With respect to the technique of using a high diffusible DIR compound, various techniques have been disclosed in the past, for example, in JP-A-59-129849 (the term "JP-A" as used herein means an "unexamined published Japanese patent application") and JP-B-5-49090 (the term "JP-B" as used herein means an "examined Japanese patent publication"). However, there is no suggestion of the deteriorations of color reproducibility and sharpness at the time of rapid processing in these specifications, and the effect of the present invention cannot be foreseen from these patents. Further, there are disclosed in JP-B-5-84891 and JP-A-62-170955 the methods of improving graininess by processing a photographic material containing a DIR compound at 120 seconds or less color developing time. Although graininess is certainly improved according to these methods, the above problems, that is, the degradation of the balance of gradation, the deterioration of color reproducibility and the deterioration of sharpness are not improved.

In the meanwhile, a roll film having a magnetic layer containing grains of a magnetic substance on the back side of the film which is capable of magnetic recording and a camera for photographing having a magnetic head are disclosed in U.S. Pat. No. 4,947,196 and WO 90/04254. According to these improved techniques, printing quality can be improved and printing works and office works of labs can be expedited by magnetically inputting/outputting various informations to and from magnetic layers of films, such as identification information of the kind and manufacturer of a photographic material, information concerning the conditions at the time of photographing, information about customers, and information about the printing conditions and the number of sheets of reprinting. However, it has been found that when such a photographic material having a magnetic recording layer is processed with a processing solution of a developing agent of high concentration as described above, the capability of a magnetic recording layer is extremely deteriorated and satisfactory information cannot be offered.

SUMMARY OF THE INVENTION

Accordingly, an object of the present invention is to provide a silver halide color photographic material which is free from the degradation of the balance of gradation, the deteriorations of color reproducibility and sharpness, and the lowering of the capability of magnetic recording when rapid development processing is carried out, and a further object is to provide a combination of a photographic material which is suitable for rapid processing with a development processing method.

The above objects of the present invention can be achieved by the following photographic material and method for forming an image.

(1) A silver halide color photographic material comprising a transparent support having thereon at least one blue-sensitive silver halide emulsion layer, at least one green-sensitive silver halide emulsion layer, at least one red-sensitive silver halide emulsion layer and at least one light-insensitive layer, wherein said red-sensitive silver halide emulsion layer contains at least one compound which releases a development inhibitor having a diffusion parameter of 0.3 or more upon reaction with the oxidation product of a color developing agent, and when development processing I and development processing II each having different color developing times are carried out, the gradients of yellow, magenta and cyan obtained by said two kinds of development processing satisfy the following conditions:

$0.8 \leqq \gamma_{II}(Y)/\gamma_{I}(Y) \leqq 1.2$ $0.8 \leqq \gamma_{II}(M)/\gamma_{I}(M) \leqq 1.2$ $0.8 \leqq \gamma_{II}(C)/\gamma_{I}(C) \leqq 1.2$ wherein $\gamma_{I}(Y)$, $\gamma_{I}(M)$ and $\gamma_{I}(C)$ each represents the gradient of yellow, magenta and cyan when development processing I is carried out and $\gamma_{II}(Y)$, $\gamma_{II}(M)$ and $\gamma_{II}(C)$ each represents the gradient of yellow, magenta and cyan when development processing II is carried out, Development Processing I:

development processing is characterized in that color development processing is carried out (i) for from 3 minutes to 3 minutes and 15 seconds of the color developing time, (ii) at the temperature of a color developing solution of from 37 to 39° C., and (iii) using a color developing solution containing from 15 to 20 mmol/liter of 2-methyl-4-[N-ethyl-N-(β-hydroxyethyl)amino]aniline as a color developing agent;

Development Processing II:

development processing is characterized in that color development processing is carried out (i) for from 50 seconds to 70 seconds of the color developing time, (ii) at the temperature of a color developing solution of from 43 to 47° C., and (iii) using a color developing solution containing from 35 to 40 mmol/liter of 2-methyl-4-[N-ethyl-N-(β-hydroxy-ethyl) amino]aniline as a color developing agent, and containing at least one silver halide solvent selected from the group consisting of thiosulfate, methanesulfonate, thiocyanate, the compounds represented by the following formulae (A), (B), (C), (D) and (E):

(A)

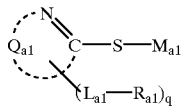

wherein $Q_{a1}$ represents a nonmetal atomic group necessary for forming a 5- or 6-membered heterocyclic ring, and this heterocyclic ring may be condensed with a carbocyclic aromatic ring or a heterocyclic aromatic ring; $L_{a1}$ represents a single bond, a divalent aliphatic group, a divalent aromatic hydrocarbon group, a divalent heterocyclic group, or a linking group of a combination of these groups; $R_{a1}$ represents a carboxylic acid or a salt thereof, a sulfonic acid or a salt thereof, a phosphonic acid or a salt thereof, or an amino group or an ammonium salt; q represents an integer of 1, 2 or 3; and $M_{a1}$ represents a hydrogen atom or a cation;

(B)

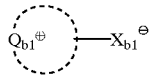

wherein $Q_{b1}$ represents a 5- or 6-membered mesoionic ring constituted with a carbon atom, a nitrogen atom, an oxygen atom, a sulfur atom or a selenium atom; $X_{b1}^-$ represents —$O^-$, —$S^-$, or —$N^-R_{b1}$; and $R_{b1}$ represents an aliphatic group, an aromatic hydrocarbon group or a heterocyclic group;

$$L_{c1}—(A_{c1}—L_{c2})_r—A_{c2}—L_{c3} \quad (C)$$

wherein $L_{c1}$ and $L_{c3}$, which may be the same or different, each represents an aliphatic group, an aromatic hydrocarbon group or a heterocyclic group; $L_{c2}$ represents a divalent aliphatic group, a divalent aromatic hydrocarbon group, a divalent heterocyclic linking group or a linking group of a combination of these groups; $A_{c1}$ and $A_{c2}$ each represents —S—, —O—, —$NR_{c20}$—, —CO—, —$SO_2$—, or a group of a combination of these groups; r represents an integer of from 1 to 10; provided that at least one of $L_{c1}$ and $L_{c3}$ is substituted with —$SO_3M_{c1}$, —$PO_3M_{c2}M_{c3}$, —$NR_{c1}(R_{c2})$, —$N^+R_{c3}(R_{c4})(R_{c5}).X_{c1}^-$, —$SO_2NR_{c6}(R_{c7})$, —$NR_{c8}SO_2R_{c9}$, —$CONR_{c10}(R_{c11})$, —$NR_{c12}COR_{c13}$, —$SO_2R_{c14}$, —$PO[—NR_{c15}(R_{c16})]_2$, —$NR_{c17}CONR_{c18}(RC_{19})$, —$COOM_{c4}$ or a heterocyclic group; $M_{c1}$, $M_{c2}$, $M_{c3}$ and $M_{c4}$, which may be the same or different, each represents a hydrogen atom or a counter cation; $R_{c1}$ to $R_{c20}$, which may be the same or different, each represents a hydrogen atom, an aliphatic group or an aromatic hydrocarbon group; and $X_{c1}^-$ represents a counter anion; provided that at least one of $A_{c1}$ and $A_{c2}$ represents —S—;

(D)

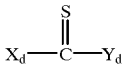

wherein $X_d$ and $Y_d$ each represents an aliphatic group, an aromatic hydrocarbon group, a heterocyclic group, —$N(R_{d1})R_{d2}$, —$N(R_{d3})N(R_{d4})R_{d5}$, —$OR_{d6}$, or —$SR_{d7}$, further, $X_d$ and $Y_d$ may form a ring but do not enolize, provided that at least one of $X_d$ and $Y_d$ is substituted with at least one of a carboxylic acid or a salt thereof, a sulfonic acid or a salt thereof, a phosphonic acid or a salt thereof, an amino group or an ammonium group, and a hydroxyl group; $R_{d1}$, $R_{d2}$, $R_{d3}$, $R_{d4}$ and $R_{d5}$ each represents a hydrogen atom, an aliphatic group, an aromatic hydrocarbon group or a heterocyclic group: and $R_{d6}$ and $R_{d7}$ each represents a hydrogen atom, a cation, an aliphatic group, an aromatic hydrocarbon group or a heterocyclic group;

(E)

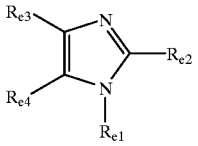

wherein $R_{e1}$, $R_{e2}$, $R_{e3}$ and $R_{e4}$ each represents a hydrogen atom, an alkyl group or an alkenyl group.

(2) The silver halide color photographic material as described in (1), wherein said development inhibitor has a benzotriazolyl group, a triazolyl group, or a benzimidazolyl group.

(3) A method for forming a color image using the silver halide color photographic material as described in (1) or (2), wherein a color image is formed by carrying out the following development processing A, development processing A:

development processing is characterized in that color development processing is carried out (i) for from 150 seconds to 200 seconds of the color developing time, (ii) at the temperature of a color developing solution of from 37 to 40° C., and (iii) using a color developing solution containing from 15 to 20 mmol/liter of a color developing agent.

(4) A method for forming a color image using the silver halide color photographic material as described in (1) or (2), wherein a color image is formed by carrying out the following development processing B, development processing B:

development processing is characterized in that color development processing is carried out (i) for from 25 seconds to 90 seconds of the color developing time, (ii) at the temperature of a color developing solution of from 40 to 60° C., and (iii) using a color developing solution containing from 25 to 80 mmol/liter of a color developing agent, and containing at least one silver halide solvent selected from the group consisting of thiosulfate, methanesulfonate, thiocyanate, the compounds represented by formulae (A), (B), (C), (D) and (E) described in (1).

(5) The method for forming an image as described in (4), wherein said photographic material has a magnetic recording layer on the side of the support opposite to the side on which the silver halide emulsion layer is provided.

DETAILED DESCRIPTION OF THE INVENTION

The present invention will be described in detail below.

The photographic material of the present invention can exhibit excellent capabilities in the interlayer effect and sharpness even in rapid processing by containing a DIR compound which releases a diffusible development inhibitor. This is because the interlayer effect, which is extremely reduced in rapid color development processing, can be improved by further increasing the diffusibility of a development inhibitor.

The development inhibitor having 0.3 or more of a diffusion parameter for use in the present invention is described in detail below.

The evaluation of the diffusion parameter of the development inhibitor for use in the present invention is conducted according to the method disclosed in JP-A-59-129849. Representative development inhibitors and the values of the diffusion parameter measured using this method are shown in the following Tables 1 and 2.

TABLE 1

| Development Inhibitor | Diffusion Parameter |
|---|---|
| 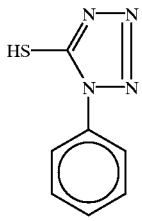 | 0.20 |
| 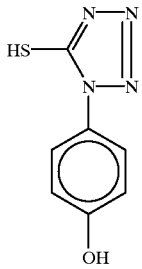 | 0.60 |
| 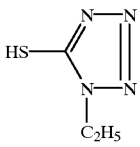 | 0.48 |
| 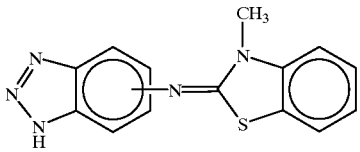 | 0.31 |
| 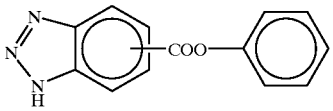 | 0.72 |

TABLE 1-continued

| Development Inhibitor | Diffusion Parameter |
|---|---|
| 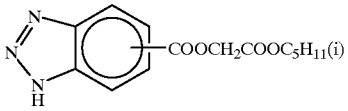 | 0.58 |

TABLE 2

| Development Inhibitor | Diffusion Parameter |
|---|---|
| 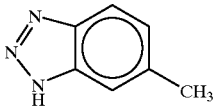 | 0.79 |
| 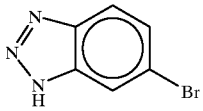 | 0.90 |
| 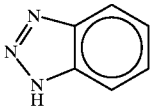 | 0.97 |
| 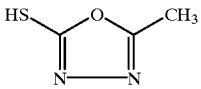 | 0.45 |
| 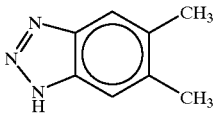 | 0.70 |

The development inhibitors for use in the present invention include those disclosed, for example, in *Research Disclosure*, Vol. 176, No. 17643 (December, 1978), U.S. Pat. Nos. 4,477,563, 5,021,332, 5,026,628, 3,227,554, 3,384,657, 3,615,506, 3,617,291, 3,733,201, 3,933,500, 3,958,993, 3,961,959, 4,149,886, 4,259,437, 4,095,984, 4,782,012, British Patents 1,450,479 and 5,034,311. Preferred examples include a heterocyclic thio group, a heterocyclic seleno group, and a triazolyl group (e.g., monocyclic or condensed ring 1,2,3-triazolyl or 1,2,4-triazolyl), and particularly preferred examples include tetrazolylthio, tetrazolylseleno, 1,3,4-oxadiazolylthio, 1,3,4-thiadiazolylthio, 1-(or 2-)benzotriazolyl, 1,2,4-triazol-1-(or -4-)yl, 1,2,3-triazol-1-yl, 2-benzothiazolylthio, 2-benzoxazolylthio, 2-benzimidazolylthio, and the derivatives of these compounds. Preferred development inhibitors are represented by the following formula (DI-1), (DI-2), (DI-3), (DI-4), (DI-5) or (DI-6):

(DI-1)

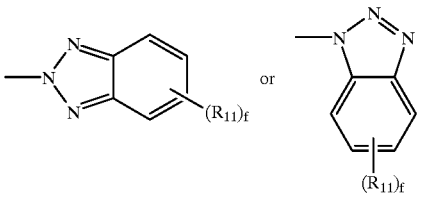

(DI-2)

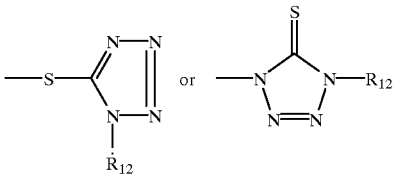

(DI-3)

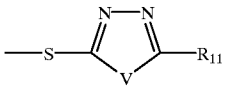

(DI-4)

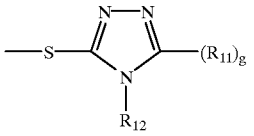

(DI-5)

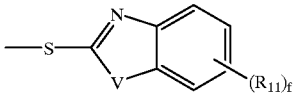

(DI-6)

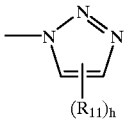

wherein $R_{11}$, represents a halogen atom (e.g., bromine, chlorine), an alkoxycarbonyl group (having from 2 to 20, preferably from 2 to 10, carbon atoms, e.g., methoxycarbonyl, isoamyloxycarbonylmethoxy), an acylamino group (having from 2 to 20, preferably from 2 to 10, carbon atoms, e.g., hexanamido, benzamido), a carbamoyl group (having from 1 to 20, preferably from 1 to 10, carbon atoms, e.g., N-butylcarbamoyl, N,N-diethylcarbamoyl, N-mesylcarbamoyl), a sulfamoyl group (having from 1 to 20, preferably from 1 to 10, carbon atoms, e.g., N-butylsulfamnoyl), an alkoxyl group (having from 1 to 20, preferably from 1 to 10, carbon atoms, e.g., methoxy, benzyloxy), an aryloxy group (having from 6 to 20, preferably from 6 to 10, carbon atoms, e.g., phenoxy, 4-methoxyphenoxy, naphthoxy), an aryloxycarbonyl group (having from 7 to 21, preferably from 7 to 11, carbon atoms, e.g., phenoxycarbonyl), an alkoxycarbonylamino group (having from 1 to 20, preferably from 1 to 10, carbon atoms, e.g., ethoxycarbonylamino), a cyano group, a nitro group, an alkylthio group (having from 1 to 20, preferably from 1 to 10, carbon atoms, e.g., methylthio, hexylthio), a ureido group (having from 1 to 20, preferably from 1 to 10, carbon atoms, e.g., N-phenylureido), an aryl group (having from 6 to 10 carbon atoms, e.g., phenyl, naphthyl, 4-methoxyphenyl), a heterocyclic group (having from 1 to 10 carbon atoms, a 3- to 12-membered, preferably a 5- or 6-membered, monocyclic or condensed ring containing at least 1 or more of a nitrogen atom, an oxygen atom and a sulfur atom as a hetero atom, e.g., 2-pyridyl, 1-pyrrolyl, morpholino, indolyl), an alkyl group (a straight chain, branched, cyclic, saturated or unsaturated group having from 1 to 20, preferably from 1 to 10, carbon atoms, e.g., methyl, ethyl, butoxycarbonylmethyl, 4-methoxybenzyl, benzyl), an acyl group (having from 1 to 20, preferably from 2 to 10, carbon atoms, e.g., acetyl, benzoyl), an arylthio group (having from 6 to 20, preferably from 6 to 10, carbon atoms, e.g., phenylthio, naphthylthio), or an aryloxycarbonylamino group (having from 7 to 11 carbon atoms, e.g., phenoxycarbonylamino). The above described substituents may further have substituents and the above described substituents can be cited as examples of these substituents.

In the above formulae, $R_{12}$ represents an aryl group (having from 6 to 10 carbon atoms, e.g., phenyl, naphthyl, 4-methoxyphenyl, 3-methoxycarbonylphenyl), a heterocyclic group (having from 1 to 10 carbon atoms, a 3- to 12-membered, preferably a 5- or 6-membered, monocyclic or condensed ring containing at least 1 or more of a nitrogen atom, an oxygen atom and a sulfur atom as a hetero atom, e.g., 2-pyridyl, 1-pyrrolyl, morpholino, indolyl), an alkyl group (a straight chain, branched, cyclic, saturated or unsaturated group having from 1 to 20, preferably from 1 to 10, carbon atoms, e.g., methyl, ethyl, butoxycarbonylmethyl, 4-methoxybenzyl, benzyl); V represents an oxygen atom or a sulfur atom; f represents 1, 2, 3 or 4; g represents 0 or 1; and h represents 1 or 2.

The diffusion parameter of a development inhibitor even having a diffusion parameter of 0.3 or less evaluated by the above-described method can be set at 0.3 or more by providing a timing group. The following structure can be cited as a specific example of such a case.

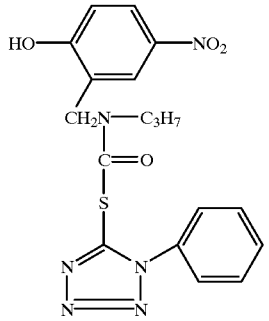

diffusion parameter: 0.48

The coupler having such a splittable group is called a so-called timing type DIR coupler. This timing type coupler certainly has a sufficient diffusibility in ordinary processing of a color negative film, but as the inhibitor is too strong in rapid processing, it strongly inhibits development of the layer in which it is contained and, in particular, when used in a red-sensitive layer, it causes the development delay of the red-sensitive layer. Therefore, in the present invention the diffusion parameter of the development inhibitor per se is necessary to be 0.3 or more.

The preferred structure of the development inhibitor for use in the present invention is not limited to the above structure. Further, if a sulfur atom which is strongly adsorbed onto silver or silver halide is contained in the inhibiting part of an inhibitor, the diffusibility is sometimes extremely inhibited, in particular, in rapid processing. Accordingly, those having the structure which does not contain a sulfur atom in the molecule are particularly preferred. That is, the structure represented by the above formula (DI-1), (DI-2), (DI-3), (DI-4), (DI-5) or (DI-6) is particularly preferred.

The diffusion parameter of the development inhibitor of the present invention is necessary to be 0.3 or more and the diffusion parameter of 0.4 or more is further preferred. Too large a diffusibility also deteriorates the function as an inhibitor, accordingly, diffusion parameter of 0.95 or less is preferred.

A DIR compound according to the present invention is explained below.

A DIR compound according to the present invention is represented by the following formula (I), (II) or (III):

A-DI (I)

A-$(TIME)_a$-DI (II)

A-$(TIME)_i$-RED-DI (III)

wherein A represents a coupler residue releasing DI, $(TIME)_a$-DI, or RED-DI upon coupling reaction with the oxidation product of an aromatic primary amine developing agent; TIME represents a timing group cleaving DI after splitting up from A by coupling reaction; RED represents a group cleaving DI upon reaction with the oxidation product of a developing agent after splitting up from A; DI represents the above-described development inhibitor; a represents 1 or 2; and i represents 0 or 1; and when a represents 2, two TIME's may be the same or different.

A coupler residue represented by A is described below.

When A represents a yellow color image-forming coupler residue, examples of the coupler residues include, for example, pivaloylacetanilide type, benzoylacetanilide type, malondiester type, malondiamide type, dibenzoylmethane type, benzothiazolylacetamide type, malonestermonoamide type, benzoxazolylacetamide type, benzimidazolylacetamide type and cycloalkanoylacetamide type coupler residues. Further, the coupler residues may be the coupler residues disclosed in U.S. Pat. Nos. 5,021,332, 5,021,330 and EP-A-421221.

When A represents a magenta color image-forming coupler residue, examples of the coupler residues include, for example, 5-pyrazolone type, pyrazolobenzimidazole type, pyrazolotriazole type, pyrazoloimidazole type and cyanoacetophenone type coupler residues.

When A represents a cyan color image-forming coupler residue, examples of the coupler residues include, for example, phenol type and naphthol type coupler residues. Further, the coupler residues may be the coupler residues disclosed in U.S. Pat. No. 4,746,602 and EP-A-249453.

Moreover, A may be a coupler residue which substantially does not form a color image. As such type coupler residues, for example, indanone type and acetophenone type coupler residues and the dissolution type coupler residues disclosed in EP-A-443530 and EP-A-444501 can be cited.

When A represents a coupler residue in formula (I), preferred examples of A are coupler residues represented by the following formula (Cp-1), (Cp-2), (Cp-3), (Cp-4), (Cp-5), (Cp-6), (Cp-7), (Cp-8), (Cp-9) or (Cp-10). These coupler residues have high coupling speed and preferred.

(Cp-1)

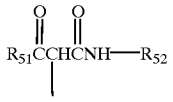

(Cp-2)

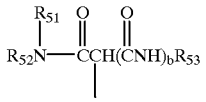

(Cp-3)

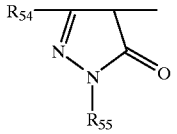

(Cp-4)

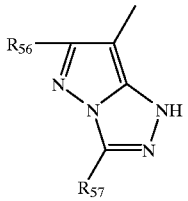

(Cp-5)

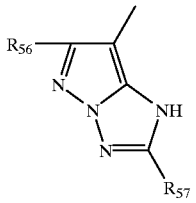

(Cp-6)

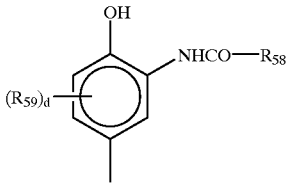

(Cp-7)

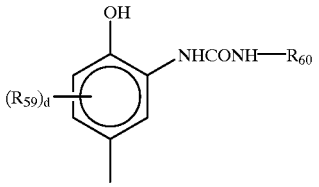

(Cp-8)

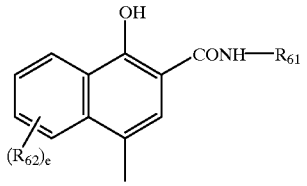

-continued (Cp-9)

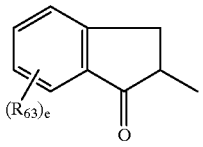

(Cp-10)

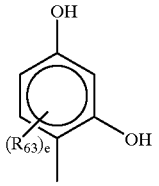

In the above formulae, a free bond derived from the coupling position represents the bonding position of a coupling-splittable group.

In the above formulae, when $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ contains a diffusion resistive group, the diffusion resistive group is selected so that the total carbon atom number is from 8 to 40 and preferably from 10 to 30, and in other cases the total carbon atom number is preferably 15 or less. When the coupler is bis type, telomer type or polymer type, either of the above substituents represents a divalent group and links a repeating unit and the like. In such a case, the range of the carbon atom number may be out of the above regulation.

$R_{51}$ to $R_{63}$, b, d and e are explained in detail below. In the following, $R_{41}$ represents an alkyl group, an aryl group or a heterocylcic group; $R_{42}$ represents an aryl group or a heterocyclic group; $R_{43}$, $R_{44}$ and $R_{45}$ each represents a hydrogen atom, an alkyl group, an aryl group or a heterocyclic group; $R_{51}$ represents the same meaning as represented by $R_{41}$; $R_{52}$ and $R_{53}$ each represents the same meaning as represented by $R_{43}$; b represents 0 or 1; $R_{54}$ represents the same group as represented by $R_{41}$, an $R_{41}CO(R_{43})N$— group, an $R_{41}SO_2(R_{43})N$— group, an $R_{41}(R_{43})N$— group, an $R_{41}S$— group, an $R_{43}O$— group, or an $R_{45}(R_{43})NCON(R_{44})$— group.

$R_{55}$ represents the same group as represented by $R_{41}$; $R_{56}$ and $R_{57}$ each represents the same group as represented by $R_{43}$, an $R_{41}S$— group, an $R_{43}O$— group, an $R_{41}CO(R_{43})N$— group, or an $R_{41}SO_2(R_{43})N$— group; $R_{58}$ represents the same group as represented by $R_{41}$; $R_{59}$ represents the same group as represented by $R_{41}$, an $R_{41}CO(R_{43})N$— group, an $R_{41}OCO(R_{43})N$— group, an $R_{41}SO_2(R_{43})N$— group, an $R_{43}(R_{44})NCO(R_{45})N$— group, an $R_{41}O$— group, an $R_{41}S$— group, a halogen atom, or an $R_{41}(R_{43})N$— group; d represents 0, 1, 2 or 3; when d represents a plurality, a plurality of $R_{59}$'s represent the same or different substituents; $R_{60}$ represents the same group as represented by $R_{41}$; $R_{61}$ represents the same group as represented by $R_{41}$; $R_{62}$ represents the same group as represented by $R_{41}$, an $R_{41}CONH$— group, an $R_{41}OCONH$— group, an $R_{41}SO_2NH$— group, an $R_{43}(R_{44})NCONH$— group, an $R_{43}(R_{44})NSO_2NH$— group, an $R_{43}O$— group, an $R_{41}S$— group, a halogen atom, or an $R_{41}NH$— group; $R_{63}$ represents the same group as represented by $R_{41}$, an $R_{43}CO(R_{44})N$— group, an $R_{43}(R_{44})NCO$— group, an $R_{41}SO_2(R_{43})N$— group, an $R_{41}(R_{43})NSO_2$— group, an $R_{41}SO_2$— group, an $R_{43}OCO$— group, an $R_{43}O$—$SO_2$— group, a halogen atom, a nitro group, a cyano group or an $R_{43}CO$— group; e represents 0, or an integer of 1, 2, 3 or 4; when there are a plurality of $R_{62}$ or $R_{63}$, each represents the same or different groups.

In the above, an alkyl group is a saturated or unsaturated, acyclic or cyclic, straight chain or branched, substituted or unsubstituted alkyl group having from 1 to 32, preferably from 1 to 22, carbon atoms, and representative examples include methyl, cyclopropyl, isopropyl, n-butyl, t-butyl, i-butyl, t-amyl, n-hexyl, cyclohexyl, 2-ethylhexyl, n-octyl, 1,1,3,3-tetramethylbutyl, n-decyl, n-dodecyl, n-hexadecyl, and n-octadecyl.

An aryl group is preferably substituted or unsubstituted phenyl or substituted or unsubstituted naphthyl having from 6 to 20 carbon atoms.

A heterocyclic group is preferably a 3- to 8-membered substituted or unsubstituted heterocyclic group having from 1 to 20, preferably from 1 to 7, carbon atoms, and having a hetero atom selected from a nitrogen atom, an oxygen atom and a sulfur atom, and there can be cited 2-pyridyl, 2-benzoxazolyl, 2-imidazolyl, 2-benzimidazolyl, 1-indolyl, 1,3,4-thiadiazol-2-yl, 1,2,4-triazol-2-yl and 1-indolinyl as representative examples of heterocyclic groups.

When the above-described alkyl group, aryl group and heterocyclic group have substituents, representative examples thereof include a halogen atom, an $R_{47}O$— group, an $R_{46}S$— group, an $R_{47}CO(R_{48})N$— group, an $R_{47}(R_{48})NCO$— group, an $R_{46}OCO(R_{47})N$— group, an $R_{46}SO_2(R_{47})N$— group, an $R_{47}(R_{48})NSO_2$— group, an $R_{46}SO_2$— group, an $R_{47}OCO$— group, an $R_{47}NCO(R_{48})N$— group, an $R_{47}CONHSO_2$— group, an $R_{47}NHCONHSO_2$— group, the same group as represented by $R_{46}$, an $R_{47}(R_{48})N$— group, an $R_{46}COO$— group, an $R_{47}OSO_2$— group, a cyano group and a nitro group; where $R_{46}$ represents an alkyl group, an aryl group or a heterocyclic group, $R_{47}$, $R_{48}$ and $R_{49}$ each represents an alkyl group, an aryl group, a heterocyclic group or a hydrogen atom; and the alkyl group, aryl group and heterocyclic group each has the same meaning as defined above.

Preferred ranges of $R_{51}$, to $R_{63}$, b, d and e are explained below.

$R_{51}$ preferably represents an alkyl group, an aryl group or a heterocyclic group; $R_{52}$ and $R_{55}$ each preferably represents an aryl group; $R_{53}$ represents an aryl group when b is 1, and a heterocyclic group when b is 0; $R_{54}$ preferably represents an $R_{41}CONH$— group or an $R_{41}(R_{43})N$— group; $R_{56}$ and $R_{57}$ each preferably represents an alkyl group, an $R_{41}O$— group or an $R_{41}S$— group.

$R_{58}$ preferably represents an alkyl group or an aryl group; in formula (Cp-6) $R_{59}$ preferably represents a chlorine atom, an alkyl group or an $R_{41}CONH$— group; d preferably represents 1 or 2; $R_{60}$ preferably represents an aryl group; in formula (Cp-7) $R_{59}$ preferably represents an $R_{41}CONH$— group; in formula (Cp-7) d preferably represents 1; $R_{61}$ preferably represents an alkyl group or an aryl group; in formula (Cp-8) e preferably represents 0 or 1; $R_{62}$ preferably represents an $R_{41}OCONH$— group, an $R_{41}CONH$— group or an $R_{41}SO_2NH$— group, and the position of substitution of these groups is preferably the 5-position of a naphthol ring; in formula (Cp-9) $R_{63}$ preferably represents an $R_{41}CONH$— group, an $R_{41}SO_2NH$— group, an $R_{41}(R_{43})NSO_2$— group, an $R_{41}SO_2$— group, an $R_{41}(R_{43})NCO$— group, a nitro group or a cyano group; in formula (Cp-10) $R_{63}$ preferably represents an $R_{43}NCO$— group, an $R_{43}OCO$— group or an $R_{43}CO$— group.

The group represented by TIME is described below.

The group represented by TIME may be any group so far as it is a linking group capable of cleaving DI after splitting up from A during development processing. The following can be cited as such examples, for example, the groups making use of a cleavage reaction of hemiacetal as disclosed in U.S. Pat. Nos. 4,146,396, 4,652,516 and 4,698,297; the timing groups causing a cleavage reaction utilizing an intramolecular nucleophilic substitution reaction as disclosed in U.S. Pat. Nos. 4,248,962, 4,847,185 and 4,857,440; the timing groups causing a cleavage reaction utilizing an electron transfer reaction as disclosed in U.S. Pat. Nos. 4,409,323 and 4,421,845; the groups causing a cleavage reaction utilizing a hydrolysis reaction of iminoketal as disclosed in U.S. Pat. No. 4,546,073; and the groups causing a cleavage reaction utilizing a hydrolysis reaction of ester as disclosed in West German Patent 2,626,317. TIME is bonded to A through a hetero atom contained in TIME, preferably an oxygen atom, a sulfur atom or a nitrogen atom. TIME is preferably represented by the following formula (T-1), (T-2) or (T-3).

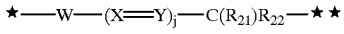

(T-1)

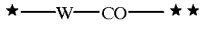

(T-2)

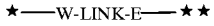

(T-3)

In formula (II), * indicates the position to be bonded to A, ** indicates the position to be bonded to DI or TIME (when a represents a plurality), W represents an oxygen atom, a sulfur atom or

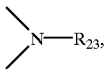

X and Y each represents methine or a nitrogen atom, j represents 0, 1 or 2, $R_{21}$, $R_{22}$ and $R_{23}$ each represents a hydrogen atom or a substituent, wherein when X and Y each represents substituted methine, arbitrary two of the substituents thereof, $R_{21}$, $R_{22}$ and $R_{23}$ may be linked to form a cyclic structure (e.g., a benzene ring, a pyrazole ring), or may not form a ring. In formula (T-3) E represents an electrophilic group, and LINK is a linking group for spatially relating W and E to undergo an intra-molecular nucleophilic substitution reaction.

Specific examples of TIME represented by formula (T-1) are shown below.

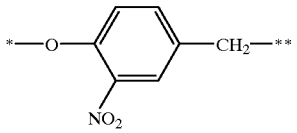

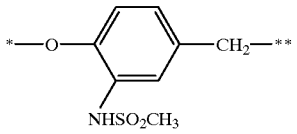

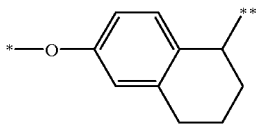

-continued

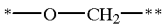

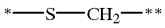

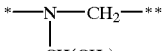

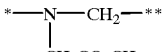

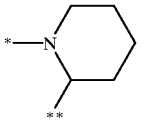

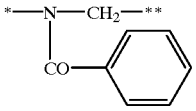

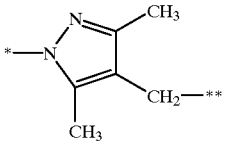

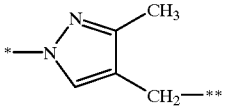

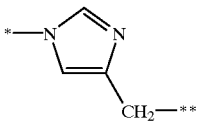

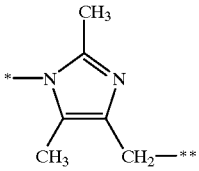

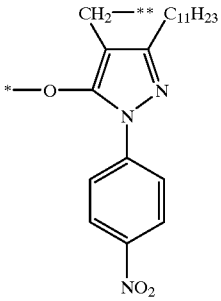

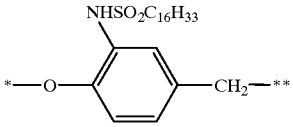

Specific examples of TIME represented by formula (T-2) are shown below.

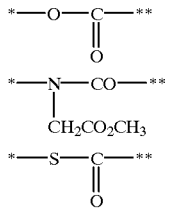

Specific examples of TIME represented by formula (T-3) are shown below.

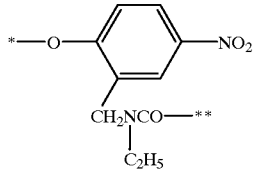

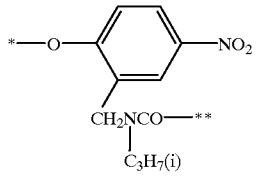

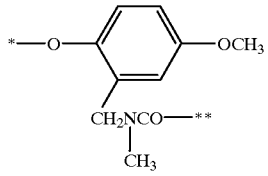

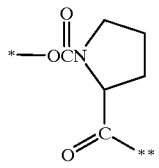

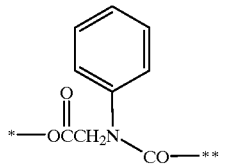

In formula (II), when a is 2 or more, specific examples of (TIME),a are shown below.

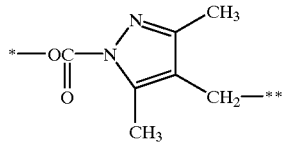

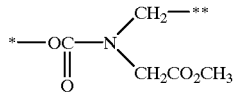

-continued

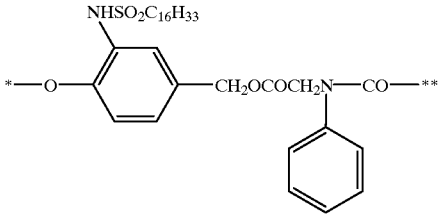

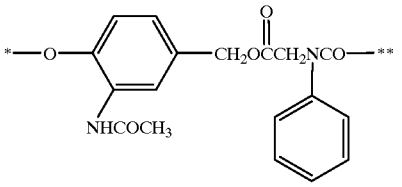

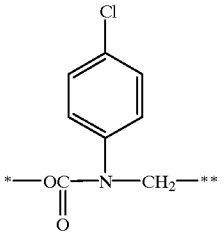

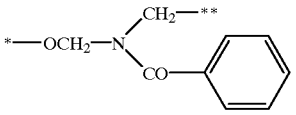

The group represented by RED in formula (III) is described below.

RED-DI is cleaved from A and can be cross-oxidized by the oxidizer present during development processing, e.g., the oxidation product of a developing agent. RED-DI may be any compound so far as DI is cleaved by oxidation. Examples of RED include, for example, hydroquinones, catechols, pyrogallols, 1,4-naphthohydroquinones, 1,2-naphthohydroquinones, sulfonamidophenols, hydrazides and sulfonamidonaphthols. Specific examples thereof are disclosed, for example, in JP-A-61-230135, JP-A-62-251746, JP-A-61-278852, U.S. Pat. Nos. 3,364,022, 3,379,529, 4,618,571, 3,639,417, 4,684,604 and *J. Org. Chem.*, Vol. 29, p. 588 (1964).

Preferred of the above as RED is hydroquinones, 1,4-naphthohydroquinones, 2(or 4)-sulfonamidophenols, pyrogallols or hydrazides. Of these, an oxidation reduction group having a phenolic hydroxyl group is bonded with A in the oxygen atom of the phenol group thereof.

Specific examples of the DIR couplers for use in the present invention are shown below but the present invention is not limited thereto.

(1)
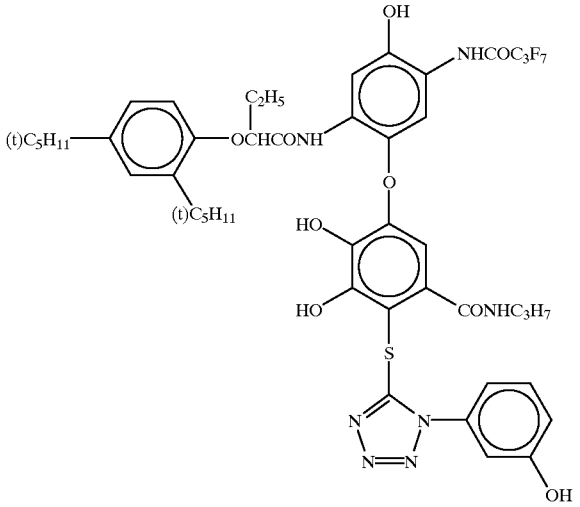
(2)
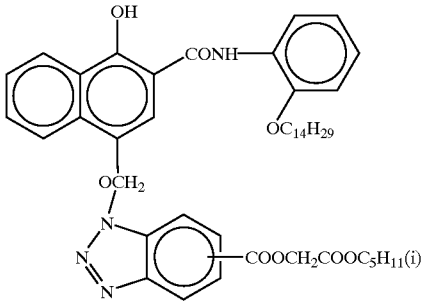
(3)
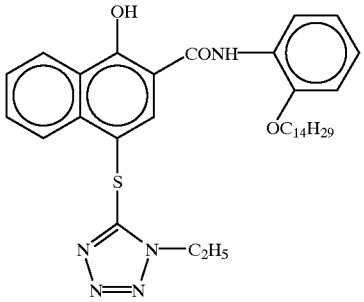
(4)
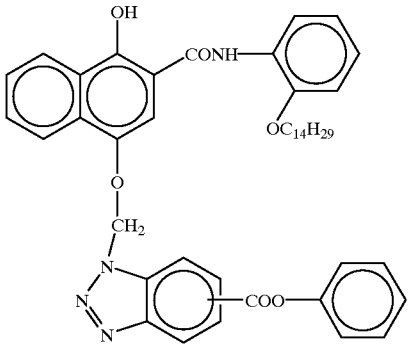

-continued
(5)
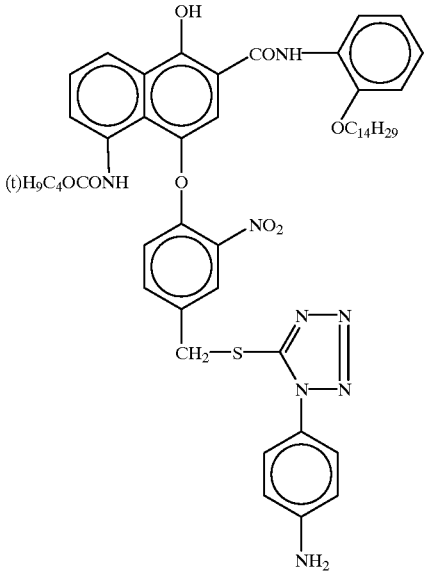
(6)
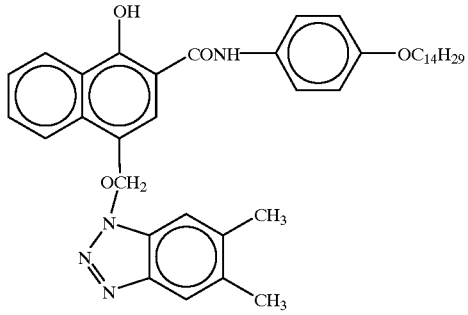
(7)
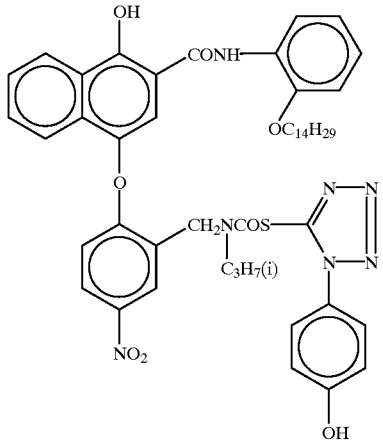

-continued
(8)
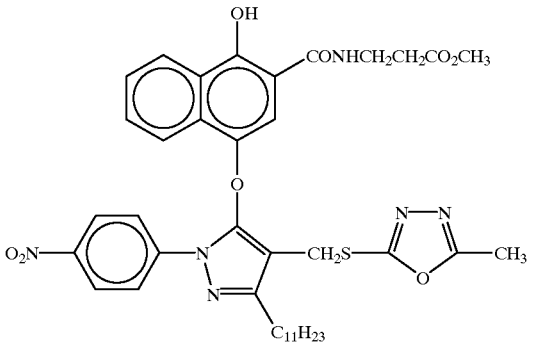
(9)
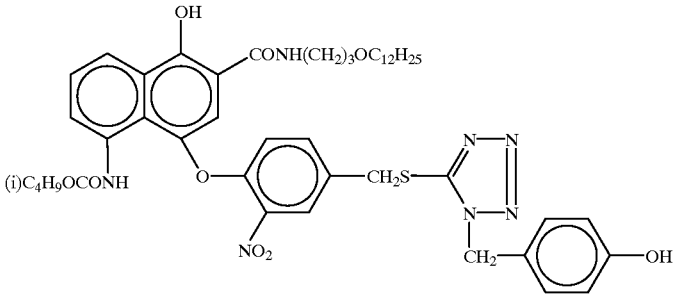
(10)
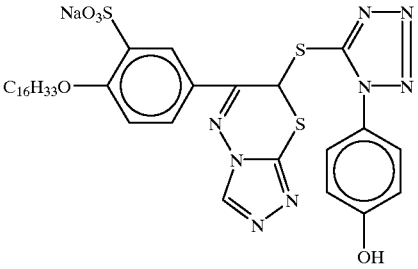
(11)
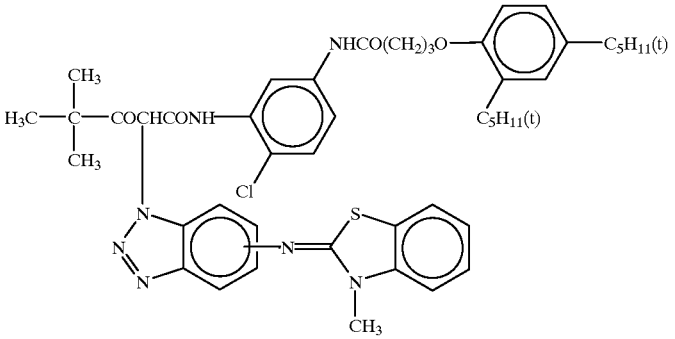
(12)
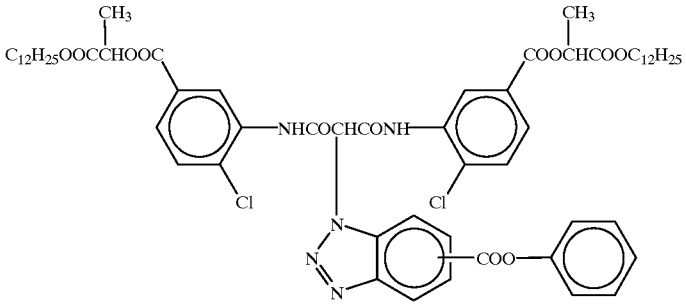

-continued
(13)
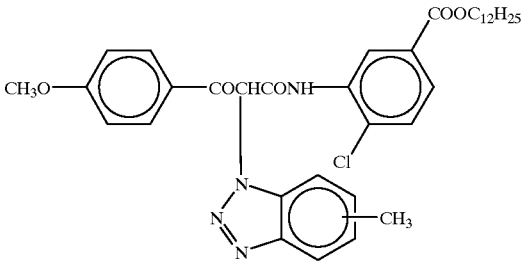
(14)
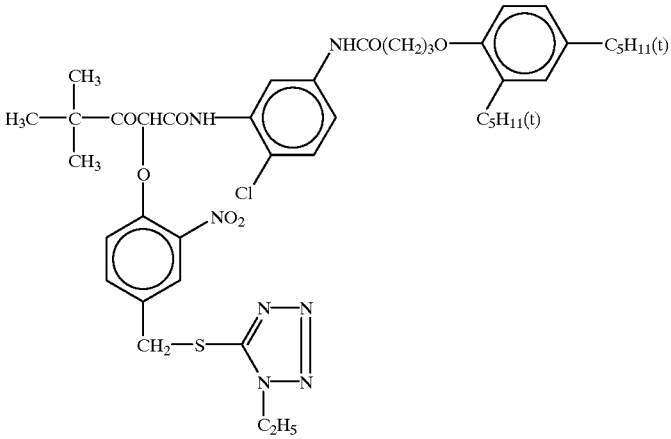
(15)
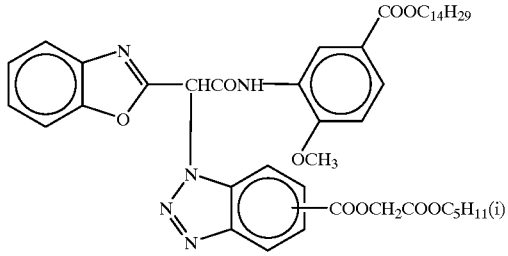
(16)
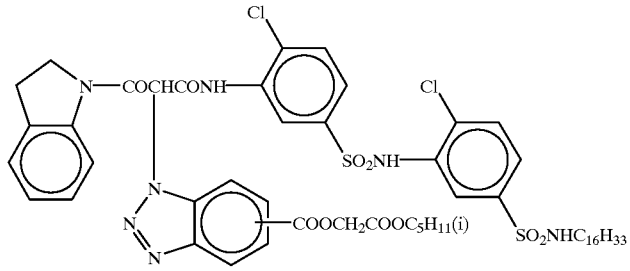

-continued
(17)
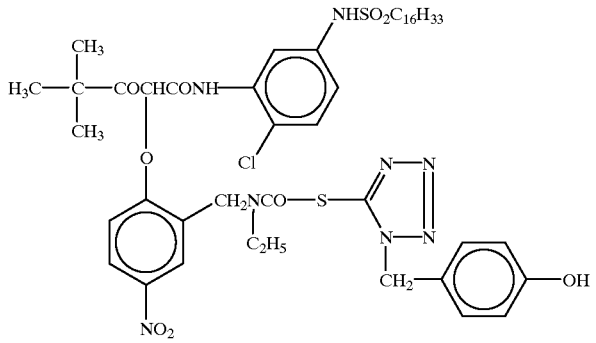
(18)
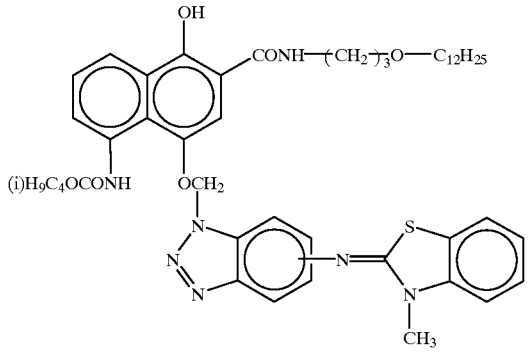
(19)
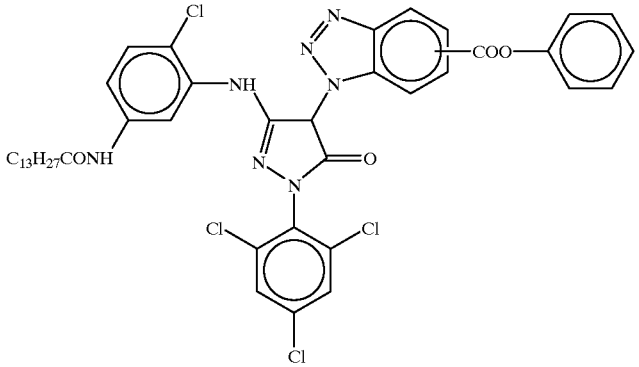
(20)
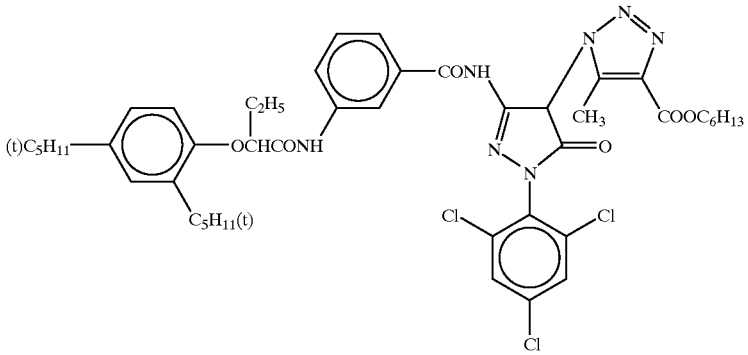

-continued
(21)
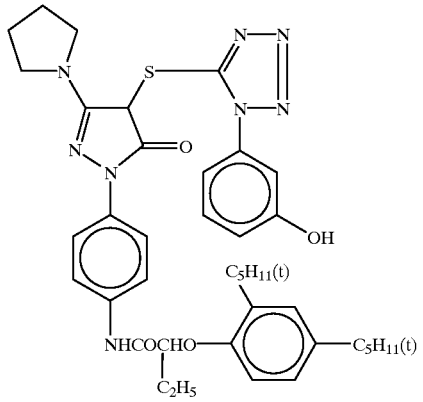
(22)
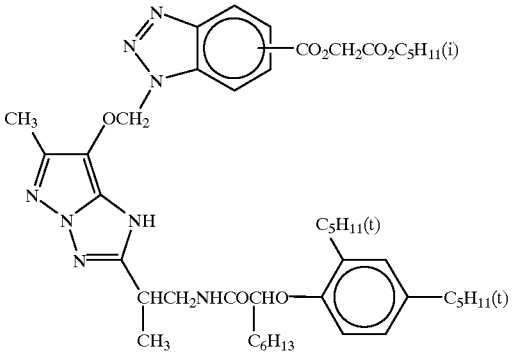
(23)
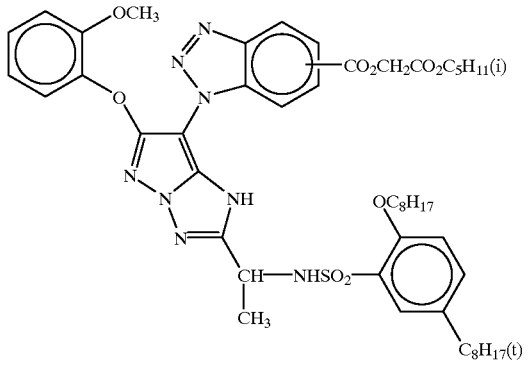
(24)
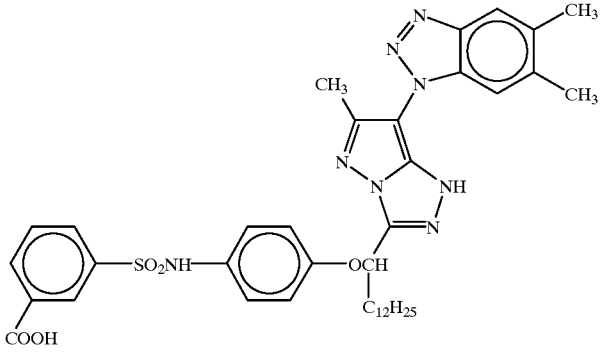

-continued
(25)
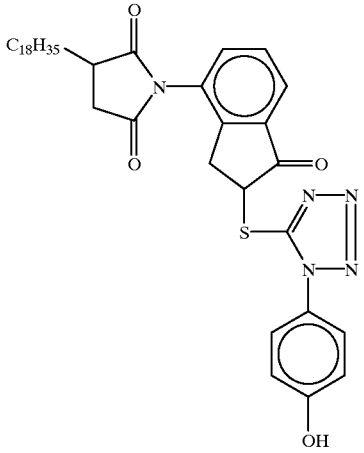
(26)
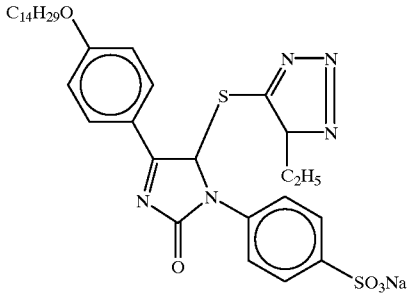
(27)
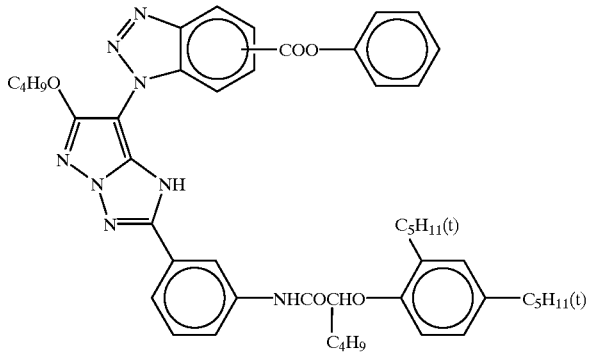
(28)
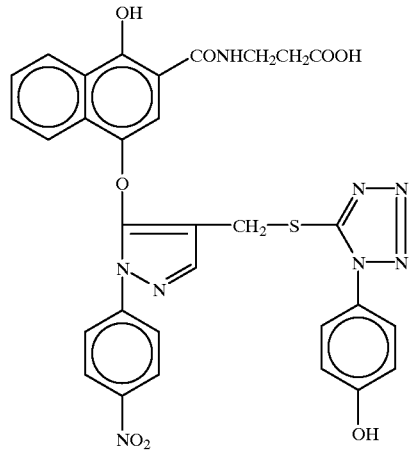

-continued
(29)
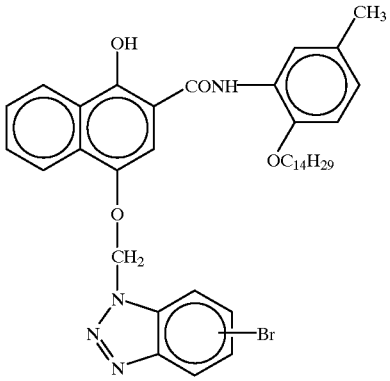
(30)
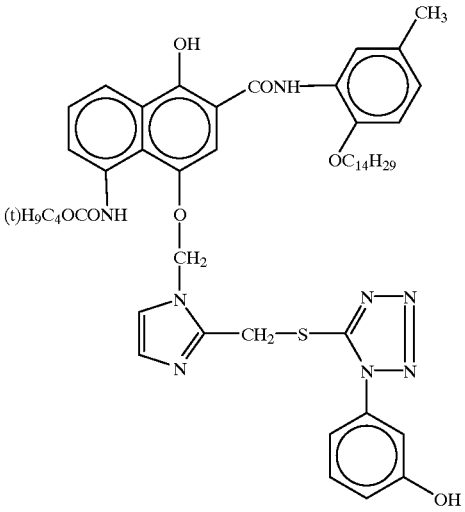
(31)
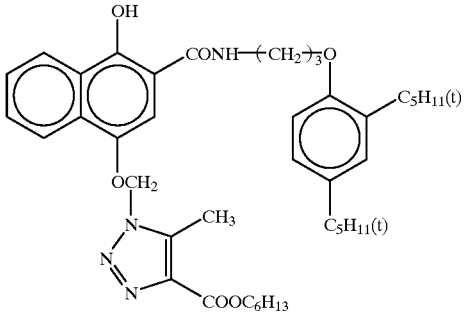
(32)
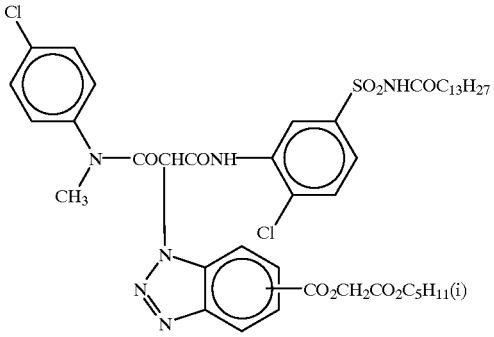

-continued (33)

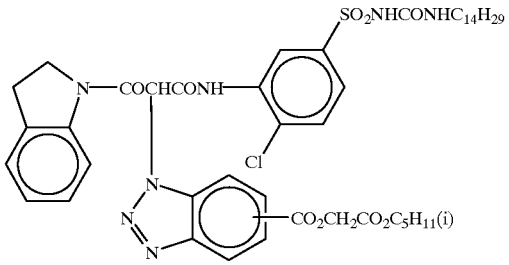

(34)

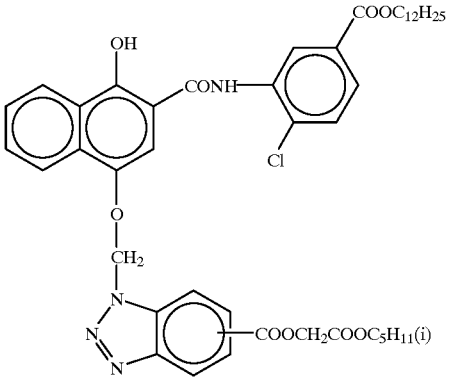

These DIR couplers for use in the present invention can be synthesized according to the methods disclosed in JP-A-54-145135, JP-A-63-37346, JP-A-56-114946, JP-A-57-154234, JP-A-58-162949, JP-A-63-37350, JP-A-57-151944, JP-A-58-205150, JP-A-60-218645, U.S. Pat. Nos. 4,618,571, 4,770,982, JP-A-63-284159, JP-A-60-203943 and JP-A-63-23152, etc.

These DIR couplers for use in the present invention are used in an amount of 30 mol % or more, preferably from 50 mol % to 100 mol %, of the entire DIR couplers contained in the interlayer effect-providing layer in a photographic material for giving a sufficient interlayer effect. The addition amount of these DIR couplers is from $1\times10^{-6}$ to $1\times10^{-2}$ mol/m$^2$, preferably from $5\times10^{-5}$ to $1\times10^{-3}$ mol/m$^2$.

The development inhibitor-releasing coupler for use in the present invention is contained in a red-sensitive emulsion layer in the present invention but it can be added to other light-sensitive layers, that is, a blue-sensitive emulsion layer and a green-sensitive emulsion layer, or it can be added to a light-insensitive layer.

Silver halide solvents for use in development processing (II) or development processing (B) in the present invention are described in detail below.

Silver halide solvents for use in the present invention are thiosulfate, methanesulfonate, thiocyanate, and compounds represented by the above formulae (A), (B), (C), (D) and (E).

The compounds represented by formulae (A) to (E) are described in detail below.

In the following description, an aliphatic group, an aromatic hydrocarbon group and a heterocyclic group are as follows unless otherwise indicated.

An aliphatic group means a substituted or unsubstituted, straight chain, branched or cyclic alkyl group, a substituted or unsubstituted alkenyl group, or a substituted or unsubstituted alkynyl group. A divalent aliphatic group means a divalent group of these aliphatic groups, that is, a substituted or unsubstituted, straight chain, branched or cyclic alkylene group, a substituted or unsubstituted alkenylene group, or a substituted or unsubstituted alkynylene group. Examples of aliphatic groups include a methyl group, an ethyl group, a propyl group, a butyl group, an isopropyl group, a 2-hydroxypropyl group, a hexyl group, an octyl group, a vinyl group, a propenyl group, a butenyl group, a benzyl group and a phenethyl group.

An aromatic hydrocarbon group means a substituted or unsubstituted aryl group, which group may be monocyclic or condensed with an aromatic ring and a heterocyclic ring. A divalent aromatic hydrocarbon group means a substituted or unsubstituted arylene group, which group may be monocyclic or condensed with an aromatic ring and a heterocyclic ring. Examples of aromatic hydrocarbon groups include a phenyl group, a 2-chlorophenyl group, a 3-methoxyphenyl group and a naphthyl group.

A heterocyclic group means a 3- to 10-membered saturated or unsaturated, substituted or unsubstituted heterocyclic group having at least one of a nitrogen atom, an oxygen atom and a sulfur atom as a hetero atom, which group may be monocyclic or condensed with an aromatic ring and a heterocyclic ring. Examples of heterocyclic groups include a pyrrole ring, an imidazole ring, a pyrazole ring, a pyridine ring, a pyrazine ring, a pyrimidine ring, a triazole ring, a thiadiazole ring, an oxadiazole ring, a quinoxaline ring, a tetrazole ring, a thiazole ring, and an oxazole ring.

Further, each group in the present specification may be substituted unless otherwise indicated. Examples of such substituents include, for example, an alkyl group, an aralkyl group, an alkenyl group, an alkynyl group, an alkoxyl group, an aryl group, an amino group, an acylamino group, a sulfonamido group, a ureido group, a urethane group, an aryloxy group, a sulfamoyl group, a carbamoyl group, an alkylthio group, an arylthio group, a sulfonyl group, a sulfinyl group, an acyl group, a hydroxy group, a halogen atom, a cyano group, a sulfo group, a carboxy group, a phosphono group, an aryloxycarbonyl group, an alkoxycarbonyl group, an acyloxy group, a nitro group, a hydroxamic acid group, and a heterocyclic group.

The compound represented by formula (A) for use in the present invention is explained in detail below.

In formul a (A), $Q_{a1}$ preferably represents a nonmetal atomic group necessary for forming a 5- or 6-membered heterocyclic ring constituted with at least one atom of a carbon atom, a nitrogen atom, an oxygen atom, a sulfur atom and a selenium atom. This heterocyclic ring may be condensed with a carbocyclic aromatic ring or a heterocyclic aromatic ring.

Examples of heterocyclic rings include, for example, a tetrazole ring, a triazole ring, an imidazole ring, a thiadiazole ring, an oxadiazole ring, a selenadiazole ring, an oxazole ring, a thiazole ring, a benzoxazole ring, a benzothiazole ring, a benzimidazole ring, a pyrimidine ring, a triazaindene ring, a tetraazaindene ring, a pentaazaindene ring, etc.

$R_{a1}$ represents a carboxylic acid or a salt thereof (e.g., a sodium salt, a potassium salt, an ammonium salt, a calcium salt), a sulfonic acid or a salt thereof (e.g., a sodium salt, a potassium salt, an ammonium salt, a magnesium salt, a calcium salt), a phosphonic acid or a salt thereof (e.g., a sodium salt, a potassium salt, an ammonium salt), a substituted or unsubstituted amino group (e.g., unsubstituted amino, dimethylamino, diethylamino, methylamino, bismethoxyethylamino), or a substituted or unsubstituted ammonium group (e.g., trimethylammonium, triethylammonium, dimethylbenzylammonium). $L_{a1}$ represents a single bond, a divalent aliphatic group, a divalent aromatic hydrocarbon group, a divalent heterocyclic group, or a linking group of a combination with these groups. $L_{a1}$ preferably represents a divalent group, a single bond or an arbitrary combination of an alkylene group having from 1 to 10 carbon atoms (e.g., methylene, ethylene, propylene, butylene, isopropylene, 2-hydroxypropylene, hexylene, octylene), an alkenylene group having from 2 to 10 carbon atoms (e.g., vinylene, propenylene, butenylene), an aralkylene group having from 7 to 12 carbon atoms (e.g., phenethylene), an arylene group having from 6 to 12 carbon atoms (e.g., phenylene, 2-chlorophenylene, 3-methoxyphenylene, naphthylene), a heterocyclic group having from 1 to 10 carbon atoms (e.g., pyridyl, thienyl, furyl, triazolyl, imidazolyl), or $L_{a1}$ may be a group combining —CO—, —$SO_2$—, —$NR_{202}$—, —O— or —S— arbitrarily, wherein $R_{202}$ represents a hydrogen atom, an alkyl group having from 1 to 6 carbon atoms (e.g., methyl, ethyl, butyl, hexyl), an aralkyl group having from 7 to 10 carbon atoms (e.g., benzyl, phenethyl), or an aryl group having from 6 to 10 carbon atoms (e.g., phenyl, 4-methylphenyl).

$M_{a1}$ represents a hydrogen atom or a cation (e.g., an alkali metal atom such as a sodium atom and a potassium atom, an alkaline earth metal atom such as a magnesium atom and a calcium atom, or an ammonium group such as an ammonium group and a triethylammonium group).

Further, a heterocyclic ring and $R_{a1}$ represented by formula (A) may be substituted with a nitro group, a halogen atom (e.g., chlorine, bromine), a mercapto group, a cyano group, a substituted or unsubstituted alkyl group (e.g., methyl, ethyl, propyl, t-butyl, cyanoethyl), a substituted or unsubstituted aryl group (e.g., phenyl, 4-methanesulfonamidophenyl, 4-methylphenyl, 3,4-dichlorophenyl, naphthyl), a substituted or unsubstituted alkenyl group (e.g., allyl), a substituted or unsubstituted aralkyl group (e.g., benzyl, 4-methylbenzyl, phenethyl), a substituted or unsubstituted sulfonyl group (e.g., methanesulfonyl, ethanesulfonyl, p-toluenesulfonyl), a substituted or unsubstituted carbamoyl group (e.g., unsubstituted carbamoyl, methylcarbamoyl, phenylcarbamoyl), a substituted or unsubstituted sulfamoyl group (e.g., unsubstituted sulfamoyl, methylsulfamoyl, phenylsulfamoyl), a substituted or unsubstituted carbonamido group (e.g., acetamido, benzamido), a substituted or unsubstituted sulfonamido group (e.g., methanesulfonamido, benzenesulfonamido, p-toluenesulfonamido), a substituted or unsubstituted acyloxy group (e.g., acetyloxy, benzoyloxy), a substituted or unsubstituted sulfonyloxy group (e.g., methanesulfonyloxy), a substituted or unsubstituted ureido group (e.g., unsubstituted ureido, methylureido, ethylureido, phenylureido), a substituted or unsubstituted acyl group (e.g., acetyl, benzoyl), a substituted or unsubstituted oxycarbonyl group (e.g., methoxycarbonyl, phenoxycarbonyl), a substituted or unsubstituted oxycarbonylamino group (e.g., methoxycarbonylamino, phenoxycarbonylamino, 2-ethylhexyloxycarbonylamino), or a substituted or unsubstituted hydroxyl group.

q represents an integer of 1, 2 or 3, and when q is 2 or 3, a plurality of $R_{a1}$'s may be the same or different.

In formula (A), preferably $Q_{a1}$ represents a tetrazole ring, a triazole ring, an imidazole ring, an oxadiazole ring, a triazaindene ring, a tetraazaindene ring, or a pentaazaindene ring, $R_{a1}$ represents an alkyl group having from 1 to 6 carbon atoms substituted with one or two groups selected from a carboxylic acid or a salt thereof and a sulfonic acid or a salt thereof, and q represents 1 or 2.

The compound represented by formula (A) is preferably represented by formula (A-1):

(A-1)

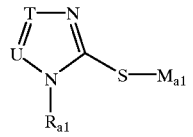

wherein $M_{a1}$ and $R_{a1}$ each has the same meaning as $M_{a1}$ and $R_{a1}$ in formula (A); T and U each represents C—$R_{a2}$ or N; and $R_{a2}$ represents a hydrogen atom, a halogen atom, a hydroxy group, a nitro group, an alkyl group, an alkenyl group, an aralkyl group, an aryl group, a carbonamido group, a sulfonamido group, a ureido group or $R_{a1}$, provided that when $R_{a2}$ represents $R_{a1}$, $R_{a1}$ may be the same with or different from $R_{a1}$ in formula (A).

The formula (A-1) is described in detail below.

T and U each represents C—$R_{a2}$ or N; and $R_{a2}$ represents a hydrogen atom, a halogen atom (e.g., chlorine, bromine), a hydroxy group, a nitro group, an alkyl group (e.g., methyl, ethyl, methoxyethyl, n-butyl, 2-ethylhexyl), an alkenyl group (e.g., allyl), an aralkyl group (e.g., benzyl, 4-methylbenzyl, phenethyl, 4-methoxybenzyl), an aryl group (e.g., phenyl, naphthyl, 4-methanesulfonamidophenyl, 4-methylphenyl), a carbonamido group (e.g., acetylamino, benzoylamino, methoxypropionylamino), a sulfonamido group (e.g., methanesulfonamido, benzenesulfonamido, p-toluenesulfonamido), a ureido group (e.g., unsubstituted ureido, methylureido, phenylureido), or $R_{a1}$, provided that when $R_{a2}$ represents $R_{a1}$, $R_{a1}$ may be the same with or different from $R_1$ in formula (A).

In formula (A-1), preferably T═U═N, and $R_{a1}$ represents an alkyl group having from 1 to 4 carbon atoms substituted with one or two groups selected from a carboxylic acid or a salt thereof and a sulfonic acid or a salt thereof.

Specific examples of the compounds represented by formula (A) for use in the present invention are shown below but the present invention is not limited thereto.
A-1.
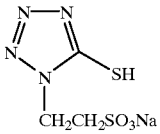
A-2.
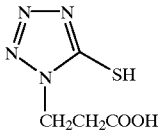
A-3.
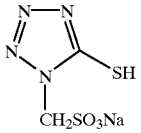
A-4.
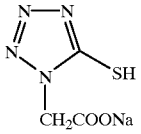
A-5.
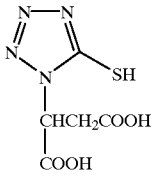
A-6.
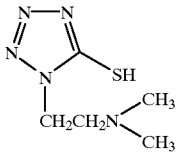
A-7.
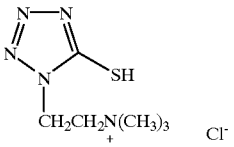
A-8.
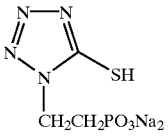
A-9.
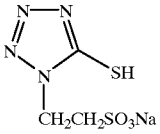
-continued
A-10.
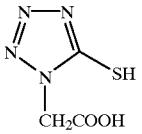
A-11
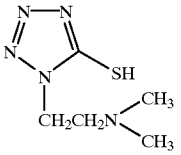
A-12.
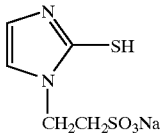
A-13.
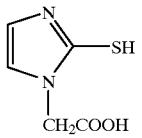
A-14.
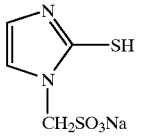
A-15.
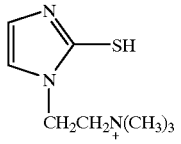
A-16.
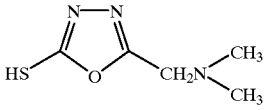
A-17.
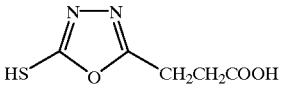
A-18.
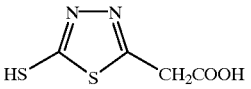
A-19.
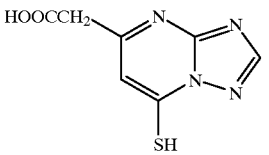
A-20.
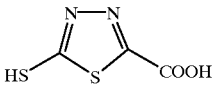

The compounds represented by formula (A) for use in the present invention can be synthesized according to the methods disclosed in *Berichte der Deutschen Chemischen Gesellschaft*, 28, 77 (1895), JP-A-60-61749, JP-A-60-147735, *Berichte der Deutschen Chemischen Gesellschaft*, 22, 568 (1889), ibid., 29, 2483 (1896), *J. Chem. Soc.*, 1932, 1806, *J. Am. Chem. Soc.*, 71, 4000 (1949), *Advances in Heterocyclic Chemistry*, 9, 165 (1968), *Organic Synthesis IV*, 569 (1963), *J. Am. Chem. Soc.*, 45, 2390 (1923), and *Chemische Berichte*, 9, 465 (1876).

The compound represented by formula (B) for use in the present invention is explained in detail below.

In formula (B), $Q_{b1}$ represents a 5- or 6-membered mesoionic ring constituted with a carbon atom, a nitrogen atom, an oxygen atom, a sulfur atom or a selenium atom, $X_{b1}^-$ represents —O⁻, —S⁻, or —N⁻$R_{b1}$, and $R_{b1}$ represents an aliphatic group, an aromatic hydrocarbon group or a heterocyclic group.

The mesoionic compound represented by formula (B) for use in the present invention is a compound group defined by W. Baker and W. D. Ollis in *Quart. Rev.*, 11, 15 (1957) and *Advances in Heterocyclic Chemistry*, 19, 1 (1976) as follows, that is, a mesoionic compound is a 5- or 6-membered heterocyclic compound, which cannot be expressed satisfactorily by one covalent structural formula or polar structural formula, has a sextet of π electron relating every atom constituting the ring, the ring is partially charged positive electricity and equilibrated with equal negative electricity on the atom or atomic group out of the ring.

Examples of the mesoionic rings represented by $Q_{b1}$ include an imidazolium ring, a pyrazolium ring, an oxazolium ring, a thiazolium ring, a triazolium ring, a tetrazolium ring, a thiadiazolium ring, an oxadiazolium ring, a thiatriazolium ring, and an oxatriazolium ring.

$R_{b1}$ represents a substituted or unsubstituted aliphatic group (e.g., methyl, ethyl, n-propyl, n-butyl, isopropyl, n-octyl, carboxymethyl, dimethylaminoethyl, cyclohexyl, 4-methylcyclohexyl, cyclopentyl, propenyl, 2-methylpropenyl, propargyl, butynyl, 1-methylpropargyl, benzyl, 4-methoxybenzyl), a substituted or unsubstituted aromatic group (e.g., phenyl, naphthyl, 4-methylphenyl, 3-methoxyphenyl, 4-ethoxycarbonylphenyl), or a substituted or unsubstituted heterocyclic group (e.g., pyridyl, imidazolyl, morpholino, triazolyl, tetrazolyl, thienyl).

Further, the mesoionic ring represented by $Q_{b1}$ may be substituted with substituents described in formula (A).

Moreover, the compound represented by formula (B) may form a salt (e.g., acetate, nitrate, salicylate, hydrochloride, iodate, bromate).

In formula (B), $X_{b1}^-$ preferably represents —S⁻.

The mesoionic compound represented by formula (B) for use in the present invention is preferably represented by the following formula (B-1).

(B-1)

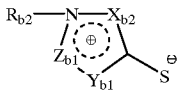

wherein $X_{b2}$ represents N or C—$R_{b3}$; $Y_{b1}$ represents O, S, N or N—$R_{b4}$; and $Z_{b1}$ represents N, N—$R_{b5}$ or C—$R_{b6}$.

$R_{b2}$, $R_{b3}$, $R_{b4}$, $R_{b5}$ and $R_{b6}$ each represents an aliphatic group, an aromatic group, a heterocyclic group, an amino group, an acylamino group, a sulfonamido group, a ureido group, a sulfamoylamino group, an acyl group or a carbamoyl group, provided that $R_{b3}$ and $R_{b6}$ may represent hydrogen atoms. Further, $R_{b2}$ and $R_{b3}$, $R_{b2}$ and $R_{b5}$, $R_{b2}$ and $R_{b6}$, $R_{b4}$ and $R_{b5}$, and $R_{b4}$ and $R_{b6}$ may form rings.

The compound represented by formula (B-1) is described in detail below.

The aliphatic group, aromatic group, heterocyclic group, amino group, acylamino group, sulfonamido group, ureido group, sulfamoylamino group, acyl group or carbamoyl group represented by $R_{b2}$, $R_{b3}$, $R_{b4}$, $R_{b5}$ and $R_{b6}$ may be substituted.

In formula (B-1), preferably $X_{b2}$ represents N or C—$R_{b3}$; $Y_{b1}$ represents N—$R_{b4}$, S or O; $Z_{b1}$ represents C—$R_{b6}$; $R_{b2}$, $R_{b3}$ and $R_{b6}$ each represents a substituted or unsubstituted alkyl group, a substituted or unsubstituted alkenyl group, a substituted or unsubstituted alkynyl group or a substituted or unsubstituted heterocyclic group, provided that $R_{b3}$ and $R_{b6}$ each may represent a hydrogen atom; and $R_{b4}$ represents a substituted or unsubstituted alkyl group, a substituted or unsubstituted alkenyl group, a substituted or unsubstituted alkynyl group, a substituted or unsubstituted heterocyclic group, or a substituted or unsubstituted amino group.

In formula (B-1), more preferably $X_{b2}$ represents N; $Y_{b1}$ represents N—$R_{b4}$; $Z_{b1}$ represents C—$R_{b6}$; $R_{b2}$ and $R_{b4}$ each represents an alkyl group having from 1 to 6, more preferably from 1 to 3, carbon atoms; and $R_{b6}$ represents a hydrogen atom or an alkyl group having from 1 to 6 carbon atoms, more preferably a hydrogen atom or an alkyl group having from 1 to 3 carbon atoms; provided that more preferably at least one alkyl group represented by $R_{b2}$, $R_{b4}$ and $R_{b6}$ is substituted with at least one of a carboxylic acid group, a sulfonic acid group, an amino group, and a phosphono group, in particular, a carboxylic acid group or a sulfonic acid group.

Further, the compound represented by the following formula (B-2) can be cited as an analogous compound to the compound represented by formula (B-1):

(B-2)

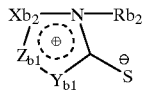

wherein $R_{b2}$, $X_{b2}$, $Y_{b1}$ and $Z_{b1}$ are completely the same as $R_{b2}$, $X_{b2}$, $Y_{b1}$ and $Z_{b1}$ in formula (B-1).

Specific examples of the compounds represented by formula (B) for use in the present invention are shown below but the present invention is not limited thereto.

(B-1)

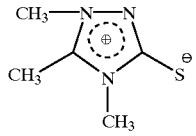

(B-2)

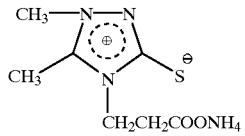

-continued
(B-3)
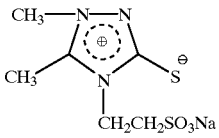
(B-4)
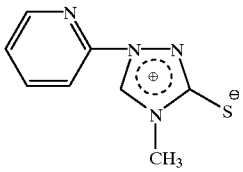
(B-5)
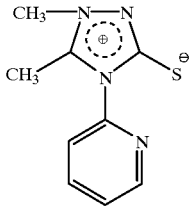
(B-6)
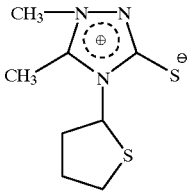
(B-7)
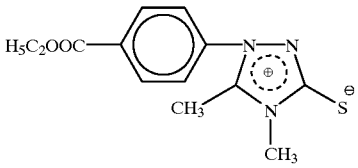
(B-8)
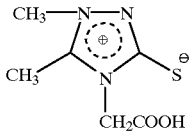
(B-9)
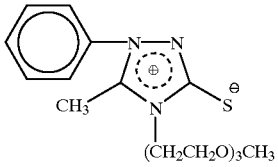
(B-10)
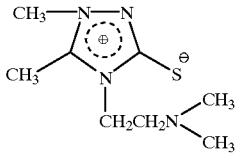
-continued
(B-11)
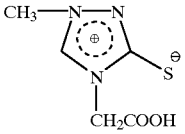
(B-12)
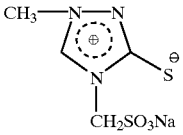
(B-13)
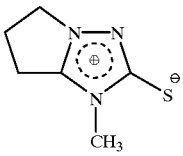
(B-14)
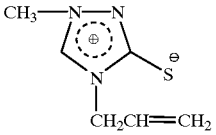
(B-15)
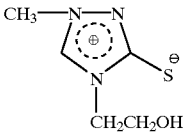
(B-16)
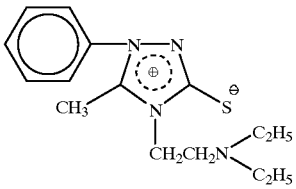
(B-17)
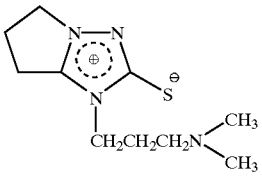
(B-18)
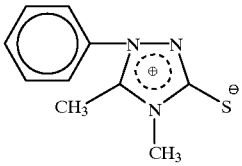
(B-19)
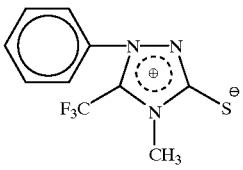

-continued
(B-20)
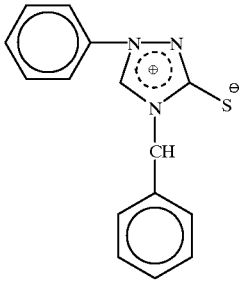
(B-21)
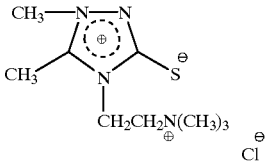
(B-22)
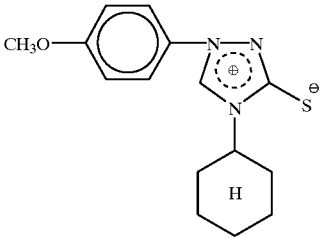
(B-23)
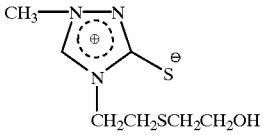
(B-24)
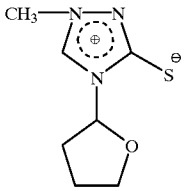
(B-25)
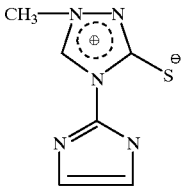
(B-26)
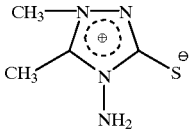
-continued
(B-27)
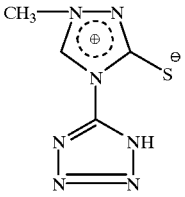
(B-28)
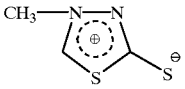
(B-29)
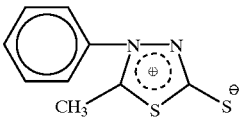
(B-30)
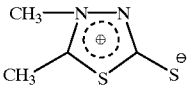
(B-31)
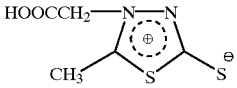
(B-32)
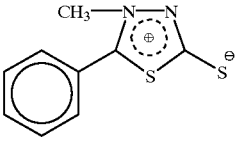
(B-33)
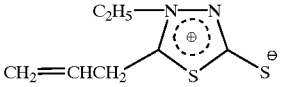
(B-34)
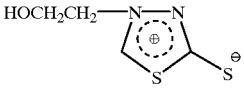
(B-35)
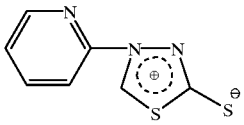
(B-36)
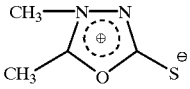
(B-37)
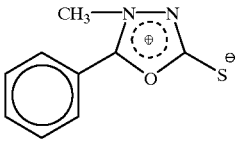

-continued (B-38)

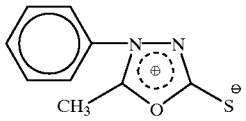

(B-39)

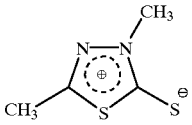

(B-40)

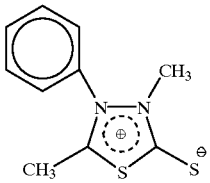

(B-41)

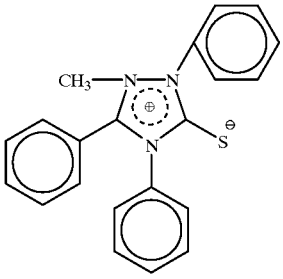

(B-42)

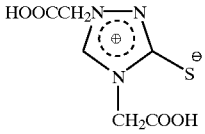

(B-43)

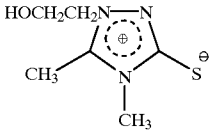

(B-44)

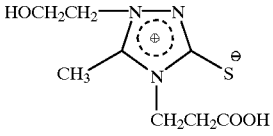

(B-45)

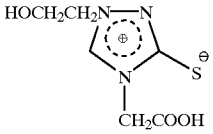

-continued (B-46)

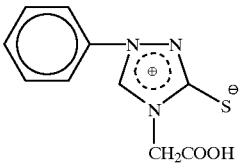

(B-47)

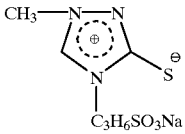

(B-48)

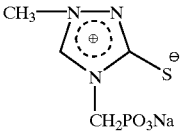

(B-49)

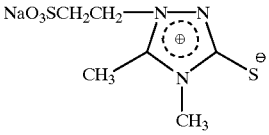

(B-50)

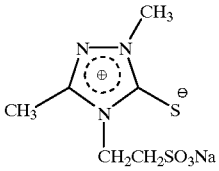

The compounds represented by formula (B) for use in the present invention can be synthesized according to the methods disclosed in JP-A-1-201659, JP-A-4-143755, etc.

The compound represented by formula (C) for use in the present invention is explained in detail below.

$L_{c1}$ and $L_{c3}$ each represents a substituted or unsubstituted aliphatic group having from 1 to 10 carbon atoms (e.g., methyl, ethyl, propyl, hexyl, isopropyl, carboxyethyl, benzyl, phenethyl, vinyl, propenyl, 1-methylvinyl), a substituted or unsubstituted aromatic group having from 6 to 12 carbon atoms (e.g., phenyl, 4-methylphenyl, 3-methoxyphenyl), or a substituted or unsubstituted heterocyclic group having from 1 to 10 carbon atoms (e.g., pyridyl, furyl, thienyl, imidazolyl); $L_{c2}$ represents a substituted or unsubstituted divalent aliphatic group having from 1 to 12 carbon atoms (e.g., methylene, ethylene, trimethylene, tetramethylene, pentamethylene, hexamethylene, 1-methylethylene, 1-hydroxytrimethylene, 1,2-xylylene), a substituted or unsubstituted divalent aromatic group having from 6 to 12 carbon atoms (e.g., phenylene, naphthylene), a substituted or unsubstituted divalent heterocyclic linking group having from 1 to 10 carbon atoms (e.g., 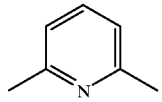 , 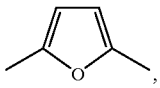 , -continued

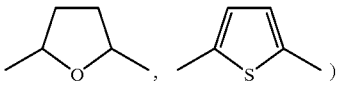

or a linking group of a combination with these groups

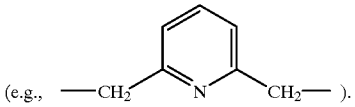

$A_{c1}$ and $A_{c2}$ each represents —S—, —O—, —$NR_{c20}$—, —CO—, —CS—, —$SO_2$— or a group of an arbitrary combination of these groups, and as the groups of arbitrary combinations thereof, for example, —$CONR_{,c21}$—, —$NR_{c22}CO$—, —$NR_{c23}CONR_{c24}$—, —COO—, —OCO—, —$SO_2NR_{c25}$—, —$NR_{c26}SO_2$—, —$NR_{c27}CONR_{c28}$—, etc., can be cited.

r represents an integer of from 1 to 10.

Provided at least one of $L_{c1}$ and $L_{c3}$ is substituted with —$SO_3M_{c1}$, —$PO_3M_{c2}M_{c3}$, —$NR_{c1}(R_{c2})$ (this group may be in the form of a salt such as hydrochloride and acetate, e.g., unsubstituted amino, methylamino, dimethylamino, N-methyl-N-hydroxyethylamino, N-ethyl-N-carboxyethylamino), —$N^+R_{c3}(R_{c4})(R_{c5}).X_{c1}^-$ (e.g., trimethylammonio chloride), —$SO_2NR_{c6}(R_{c7})$ (e.g., unsubstituted sulfamoyl, dimethylsulfamoyl), —$NR_{c8}SO_2R_{c9}$ (e.g., methanesulfonamido, benzenesulfonamido), —$CONR_{c19}(R_{c11})$ (e.g., unsubstituted carbamoyl, N-methylcarbamoyl, N,N-bis(hydroxyethyl)carbamoyl), —$NR_{c12}COR_{c13}$ (e.g., formamido, acetamido, 4-methylbenzoylamino), —$SO_2R_{c14}$ (e.g., methanesulfonyl, 4-chlorophenylsulfonyl), —PO[—$NR_{c15}(R_{c16})]_2$ (e.g., unsubstituted phosphonamido, tetramethylphosphonamido), —$NR_{c17}CONR_{c18}(R_{c19})$ (e.g., unsubstituted ureido, N,N-dimethylureido), a heterocyclic group (e.g., pyridyl, imidazolyl, thienyl, tetrahydrofuranyl), or —$COOM_{c4}$.

$M_{c1}$, $M_{c2}$, $M_{c3}$ and $M_{c4}$ each represents a hydrogen atom or a counter cation (e.g., an alkali metal atom such as a sodium atom and a potassium atom, an alkaline earth metal atom such as a magnesium atom and a calcium atom, or an ammonium group such as ammonium and triethylammonium).

$R_{c1}$ to $R_{c28}$ each represents a hydrogen atom, a substituted or unsubstituted aliphatic group having from 1 to 12 carbon atoms (e.g., methyl, ethyl, propyl, hexyl, isopropyl, benzyl, phenethyl, vinyl, propenyl, 1-methylvinyl), or a substituted or unsubstituted aromatic group having from 6 to 12 carbon atoms (e.g., phenyl, 4-methylphenyl, 3-methoxyphenyl); $X_{c1}^-$ represents a counter anion (e.g., a halogen ion such as a chlorine ion, a bromine ion, a nitric acid ion, a sulfuric acid ion, an acetic acid ion, a p-toluenesulfonic acid ion).

When each group of $L_{c1}$, $L_{c2}$, $L_{c3}$, $R_{c1}$, to $R_{c28}$ has substituents, examples of the substituents include a lower alkyl group having from 1 to 4 carbon atoms (e.g., methyl, ethyl), an aryl group having from 6 to 10 carbon atoms (e.g., phenyl, 4-methylphenyl), an aralkyl group having from 7 to 10 carbon atoms (e.g., benzyl), an alkenyl group having from 2 to 4 carbon atoms (e.g., propenyl), an alkoxyl group having from 1 to 4 carbon atoms (e.g., methoxy, ethoxy), a halogen atom (e.g., chlorine, bromine), a cyano group, a nitro group, a carboxylic acid group (it may be in the form of a salt), and a hydroxy group.

Further, when r is 2 or more, $A_{c1}$ and $L_{c2}$ may be arbitrary combination described above.

At least one of $A_{c1}$ and $A_{c2}$ represents —S—.

In formula (C), preferably at least one of $L_{c1}$ and $L_{c3}$ represents an alkyl group having from 1 to 6 carbon atoms substituted with —$SO_3M_{c1}$, —$PO_3M_{c2}M_{c3}$, —$NR_{c1}(R_{c2})$, —$N^+R_{c3}(R_{c4})(R_{c5}).X_{c1}^-$, a heterocyclic group or —$COOM_{c4}$; $L_{c2}$ represents an alkylene group having from 1 to 6 carbon atoms; $A_{c1}$ and $A_{c2}$ each represents —S—, —O—, or —$NR_{c20}$—; $R_{c1}$, $R_{c2}$, $R_{c3}$, $R_{c4}$, $R_{c5}$ and $R_{c20}$ each represents a hydrogen atom or an alkyl group having from 1 to 6 carbon atoms; and r represents an integer of from 1 to 6.

In formula (C), more preferably $L_{c1}$ and $L_{c3}$ each represents an alkyl group having from 1 to 4 carbon atoms substituted with —$SO_3M_{c1}$, —$PO_3M_{c2}M_{c3}$, or —$COOM_{c4}$; $A_{c1}$ and $A_{c2}$ each represents —S—; and r represents an integer of from 1 to 3.

Specific examples of the compounds represented by formula (C) for use in the present invention are shown below but the present invention is not limited thereto.

C-1.

$NaO_3S(CH_2)_2S(CH_2)_2S(CH_2)_2SO_3Na$

C-2.

$NaO_3S(CH_2)_2-(SCH_2CH_2)_2-S(CH_2)_2SO_3Na$

C-3.

$NaO_3S(CH_2)_2-(SCH_2CH_2)_3-S(CH_2)_2SO_3Na$

C-4.

$NaO_3S(CH_2)_2-(SCH_2CH_2)_4-S(CH_2)_2SO_3Na$

C-5.

$NaO_3S(CH_2)_3S(CH_2)_2S(CH_2)_3SO_3Na$

C-6.

$NaO_3S(CH_2)_3-(SCH_2CH_2)_2-S(CH_2)_3SO_3Na$

C-7.

$NaO_3S(CH_2)_3-(SCH_2CH_2)_3-S(CH_2)_3SO_3Na$

C-8.

$NaO_3S(CH_2)_3S(CH_2)_2O(CH_2)_2S(CH_2)_3SO_3Na$

C-9.

$NaO_3S(CH_2)_2S(CH_2)_2N(CH_3)(CH_2)_2S(CH_2)_2SO_3Na$

C-10.

$KO_3S(CH_2)_2S(CH_2)_2N((CH_2)_2SO_3K)(CH_2)_2S(CH_2)_2SO_3K$

C-11.

$NaO_3S(CH_2)_3S(CH_2)_2CONH(CH_2)_2NHCO(CH_2)_2S(CH_2)_3SO_3Na$

C-12.

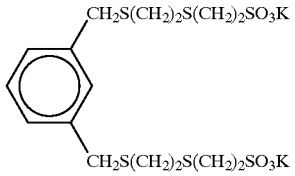

C-13.

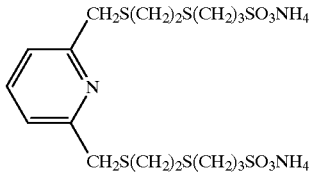

C-14.

$Na_2O_3P(CH_2)_2S(CH_2)_2S(CH_2)_2PO_3Na_2$

C-15.

$Na_2O_3P(CH_2)_2-(SCH_2CH_2)_2S(CH_2)_2PO_3Na_2$

-continued

C-16.

$Na_2O_3P(CH_2)_3$—(SCH$_2$CH$_2$)$_3$S(CH$_2$)$_3$PO$_3$Na$_2$

C-17.

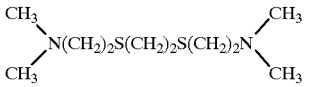

C-18.

$(CH_3)_3\overset{+}{N}(CH_2)_2S(CH_2)_2S(CH_2)_2\overset{+}{N}(CH_3)_3$ $2Cl^-$

C-19.

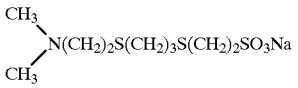

C-20.

$(CH_3)_3\overset{+}{N}(CH_2)_2S(CH_2)_2S(CH_2)_2SO_3Na$

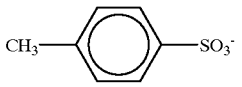

C-21.

$H_2N(CH_2)_2S(CH_2)_2S(CH_2)_2NH_2$

C-22.

$H_2NO_2S(CH_2)_2S(CH_2)_2S(CH_2)_2SO_2NH_2$

C-23.

$CH_3SO_2\underset{\underset{CH_3}{|}}{N}(CH_2)_2NH(CH_2)_2S(CH_2)_2CONH_2$

C-24.

$CH_3S(CH_2)_3SO_2(CH_2)_3S(CH_2)_2SO_3Na$

C-25.

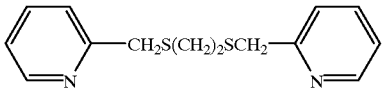

C-26.

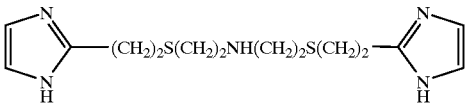

C-27.

$H_2N\overset{\overset{S}{\|}}{C}NH(CH_2)_2S(CH_2)_2S(CH_2)_2SO_3Na$

The compounds represented by formula (C) for use in the present invention can be synthesized according to the methods disclosed in JP-A-2-44355 and EP-A-458277.

The compound represented by formula (D) for use in the present invention is explained in detail below.

In formula (D), examples of the aliphatic group, aromatic group and heterocyclic group represented by $X_d$, $Y_d$, $R_{d1}$, $R_{d2}$, $R_{d3}$, $R_{d4}$, $R_{d5}$, $R_{d6}$ and $R_{d7}$ include a substituted or unsubstituted alkyl group having from 1 to 10 carbon atoms (e.g., methyl, ethyl, propyl, hexyl, isopropyl, carboxyethyl, sulfoethyl, aminoethyl, dimethylaminoethyl, phosphonopropyl, carboxymethyl, hydroxyethyl), a substituted or unsubstituted alkenyl group having from 2 to 10 carbon atoms (e.g., vinyl, propenyl, 1-methylvinyl), a substituted or unsubstituted aralkyl group having from 7 to 12 carbon atoms (e.g., benzyl, phenethyl, 3-carboxyphenylmethyl, 4-sulfophenylethyl), a substituted or unsubstituted aryl group having from 6 to 12 carbon atoms (e.g., phenyl, naphthyl, 4-carboxyphenyl, 3-sulfophenyl), and a substituted or unsubstituted heterocyclic group having from 1 to 10 carbon atoms (e.g., a 5- or 6-membered ring such as pyridyl, furyl, thienyl, imidazolyl, pyrrolyl, pyrazolyl, pyrimidinyl, quinolyl, piperidyl, pyrrolidyl is preferred).

Further, these alkyl, alkenyl, aralkyl, aryl and heterocyclic groups may be substituted. Examples of substituents include, for example, an alkyl group, an aralkyl group, an alkenyl group, an alkynyl group, an aryl group, an alkoxyl group, an aryloxy group, an acylamino group, a ureido group, a urethane group, a sulfonylamino group, a sulfamoyl group, a carbamoyl group, a sulfonyl group, a sulfinyl group, an alkyloxycarbonyl group, an aryloxycarbonyl group, an acyl group, an acyloxy group, a halogen atom, a cyano group and a nitro group. These groups may further be substituted. When there are 2 or more substituents, they may be the same or different.

In formula (D), $X_d$ and $Y_d$ may form a ring but do not enolize. Examples of the rings formed by $X_d$ and $Y_d$ include, for example, a 4-imidazoline-2-thione ring, an imidazolidine-2-thione ring, a thiazoline-2-thione ring, a 4-thiazolidine-2-thione ring, a 4-oxazoline-2-thione ring, an oxazolidine-2-thione ring, a pyrrolidine-2-thione ring, and a benzo-condensed ring of each ring.

Provided, in formula (D), at least one of $X_d$ and $Y_d$ is substituted with at least one of a carboxylic acid or a salt thereof (e.g., an alkali metal salt, an ammonium salt), a sulfonic acid or a salt thereof (e.g., an alkali metal salt, an ammonium salt), a phosphonic acid or a salt thereof (e.g., an alkali metal salt, an ammonium salt), an amino group (e.g., unsubstituted amino, dimethylamino, methylamino, hydrochloride of dimethylamino) or ammonium (e.g., trimethylammonium, dimethylbenzylammonium), and a hydroxyl group.

In formula (D) , the cation represented by $R_{d6}$ and $R_{d7}$ is a hydrogen atom, alkali metal or ammonium.

In formula (D), preferably $X_d$ and $Y_d$ each represents an alkyl group having from 1 to 10 carbon atoms, a heterocyclic group having from 1 to 10 carbon atoms, —N($R_{d1}$)$R_{d2}$ having from 0 to 10 carbon atoms, —N($R_{d3}$)N($R_{d4}$)$R_{d5}$ having from 0 to 10 carbon atoms, or —O$R_{d6}$ having from 0 to 10 carbon atoms, each of the above groups is substituted with at least 1 or 2 of a carboxylic acid or a salt thereof, a sulfonic acid or a salt thereof, a phosphonic acid or a salt thereof, an amino group or an ammonium group, and a hydroxyl group; and $R_{d1}$, $R_{d2}$, $R_{d3}$, $R_{d4}$, $R_{d5}$ and $R_{d6}$ each represents a hydrogen atom or an alkyl group.

In formula (D), more preferably $X_d$ and $Y_d$ each represents an alkyl group having from 1 to 6 carbon atoms, —N($R_{d1}$)$R_{d2}$ having from 0 to 6 carbon atoms, —N($R_{d3}$)N($R_{d4}$)$R_{d5}$ having from 0 to 6 carbon atoms, or —O$R_{d6}$ having from 0 to 6 carbon atoms, each of the above groups is substituted with at least 1 or 2 groups selected from a carboxylic acid or a salt thereof, and a sulfonic acid or a salt thereof; and $R_{d1}$, $R_{d2}$, $R_{d3}$, $R_{d4}$, $R_{d5}$ and $R_{d6}$ each represents a hydrogen atom or an alkyl group.

Specific examples of the compounds represented by formula (D) for use in the present invention are shown below but the present invention is not limited thereto.

D-1.

$H_2N\overset{\overset{S}{\|}}{C}NHCH_2SO_3Na$

D-2.

$H_2N\overset{\overset{S}{\|}}{C}NHCH_2CH_2SO_3Na$

-continued
D-3.
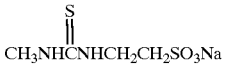
D-4.
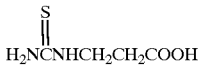
D-5.
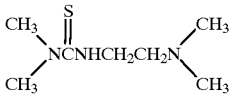
D-6.
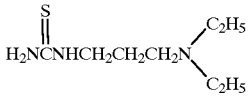
D-7.
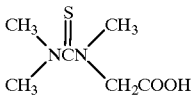
D-8.
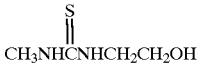
D-9.
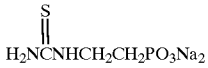
D-10.
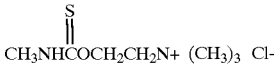
D-11.
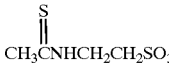
D-12.
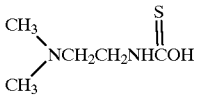
D-13.
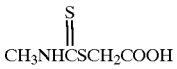
D-14.
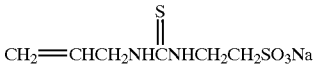
D-15.
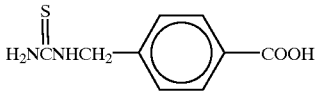
D-16.
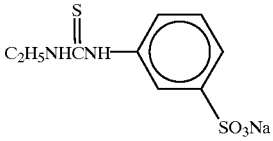
D-17.
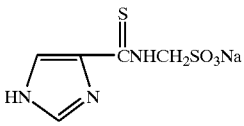
-continued
D-18.
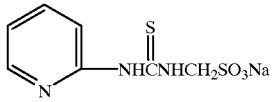
D-19.
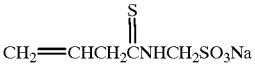
D-20.
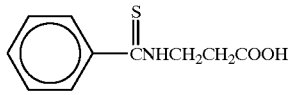
D-21.
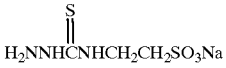
D-22.
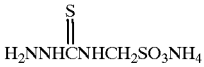
D-23.
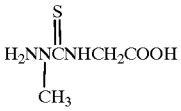
D-24.
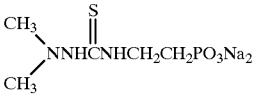
D-25.
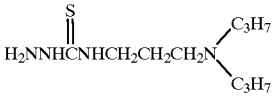
D-26.
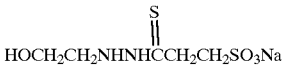
D-27.
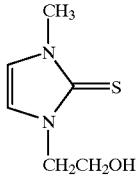
D-28.
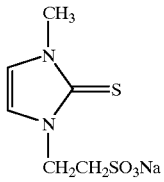
D-29.
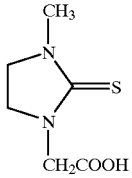

-continued

D-30.

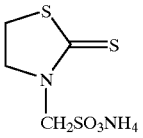

D-31.

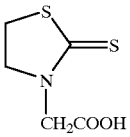

D-32.

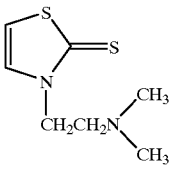

D-33.

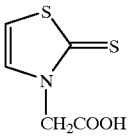

D-34.

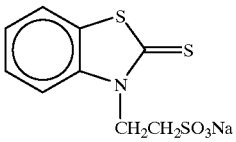

D-35.

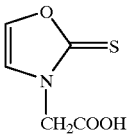

D-36.

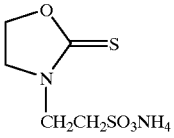

D-37.

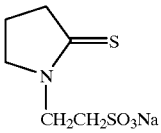

The compounds represented by formula (D) for use in the present invention can be synthesized by known methods, for example, *J. Org. Chem.*, 24, 470–473 (1959), *J. Heterocycl. Chem.*, 4, 605–609 (1967), *Yakushi* (*Journal of Chemicals*), 82, 36–45 (1962), JP-B-39-26203, JP-A-63-229449, and West German Patent Publication (OLS) No. 2,043,944 can be referred to.

The compound represented by formula (E) for use in the present invention is explained in detail below.

In formula (E), $R_{e1}$, $R_{e2}$, $R_{e3}$ and $R_{e4}$ each represents a hydrogen atom, an alkyl group or an alkenyl group.

The alkyl group may have substituents such as a hydroxy group, a carboxyl group, a sulfo group, an amino group or a nitro group, and the carbon atom number is preferably from 1 to 5, and 1 or 2 is particularly preferred.

The alkenyl group may have the above-described substituents, and the carbon atom number is preferably from 2 to 5, and 2 or 3 is particularly preferred.

Above all, $R_{e1}$, $R_{e2}$, $R_{e3}$ and $R_{e4}$ each preferably represents a hydrogen atom or a substituted or unsubstituted alkyl group having 1 or 2 carbon atoms, and particularly preferably $R_{e1}$ represents a substituted alkyl group. Substituents therefor is preferably a hydroxy group, a carboxyl group or a sulfo group, and particularly preferably a carboxyl group or a sulfo group.

Specific examples of the compounds represented by formula (E) for use in the present invention are shown below but the present invention is not limited thereto.

(E-1) Imidazole
(E-2) 1-Methylimidazole
(E-3) 2-Methylimidazole
(E-4) 4-Methylimidazole
(E-5) 4-Hydroxymethylimidazole
(E-6) 1-Ethylimidazole
(E-7) 1-Vinylimidazole
(E-8) 4-Aminomethylimidazole
(E-9) 2,4-Dimethylimidazole
(E-10) 2,4,5-Trimethylimidazole
(E-11) 2-Aminoethylimidazole
(E-12) 2-Nitroethylimidazole
(E-13) 1-Carboxymethyl-2-methylimidazole
(E-14) 1-Carboxymethyl-2,4-dimethylimidazole
(E-15) 1-Carboxyethyl-2-methyl-4-β-hydroxyethylimidazole
(E-16) 1-Sulfoethyl-2-methylimidazole
(E-17) 1-Sulfoethyl-2,4-dimethylimidazole
(E-18) 1-Sulfomethyl-4,5-dimethylimidazole
(E-19) 1-Sulfomethyl-2,5-dimethylimidazole
(E-20) 1-Sulfoethylimidazole Of the silver halide solvents for use in the present invention, preferred are sodium thiosulfate, sodium methanethiosulfonate, A-1, A-2, A-3, A-4, A-9, A-10, B-3, B-8, B-9, B-11, B-12, D-2 and D-3, and particularly preferred are A-1, A-2, A-3, A-4, B-3, B-8, B-9, B-11 and B-12.

The addition amount of the silver halide solvent according to the present invention is preferably from 0.1 to 50 mmol, more preferably from 0.1 to 10 mmol, and most preferably from 0.5 to 5.0 mmol, per liter of a color developing solution. If the addition amount is less than 0.1 mmol/liter, the effect of the present invention becomes very small and if it exceeds 50 mmol/liter, fog density of the unexposed area extremely increases.

The silver halide solvent for use in the present invention can be used in combination of two or more according to the purpose.

It is preferred that the photographic material of the present invention should have the specific photographic sensitivity of 160 or more.

The specific photographic sensitivity in the present invention is determined according to the method disclosed in JP-A-63-236035.

This measuring method is corresponding to JIS K7614-1981, except that the development processing is completed within the period of from 30 minutes to 6 hours after sensitometry exposure, and development processing is carried out using Fuji color standard processing recipe CN-16.

The specific photographic sensitivity in the present invention is more preferably 200 or more. The upper limit thereof is 3,200.

The color developing solutions used in development processing I and II for use in the present invention are explained below. Development processing I according to the present invention is processing corresponding to Kodak C-41 which is the processing for color negative films widely used in these days and is designed so that preferred gradation can be obtained, in general, in 3 minutes and 15 seconds. Development processing II is processing the speed of development processing I is increased and is contrived to obtain the gradation which approximates to the gradation in development processing I in 1 minute of color developing time by enhancing the development activity by increasing the concentration of a developing agent and raising the processing temperature. However, when a photographic material beyond the scope of the present invention is processed, as the development of the lowermost red-sensitive layer is delayed, gradations cannot be completely made to coincide with.

Development processing I is development processing characterized in that color development processing is carried out in 3 minutes to 3 minutes and 15 seconds of the color developing time at the temperature of a color developing solution of from 37 to 39° C. using a color developing solution containing from 15 to 20 mmol/liter of 2-methyl-4-[N-ethyl-N-(β-hydroxyethyl)amino]aniline as a color developing agent.

Development processing II is development processing characterized in that color development processing is carried out in 50 seconds to 70 seconds, preferably 60 seconds, of the color developing time at the temperature of a color developing solution of from 43 to 47° C., preferably 45° C., using a color developing solution containing from 35 to 40 mmol/liter, preferably from 37 to 38 mmol/liter, of 2-methyl-4-[N-ethyl-N-(β-hydroxyethyl)amino]aniline as a color developing agent, and containing at least one silver halide solvent selected from the group consisting of thiosulfate, methanesulfonate, thiocyanate, the compounds represented by the above formulae (A), (B), (C), (D) and (E). Compound B-3 described above as a specific example is preferably used as a silver halide solvent and the addition amount is from 0.5 to 2.0 mmol/liter, preferably from 0.8 to 1.2 mmol/liter.

Development processing II is prescribed by adjusting the gradation of the uppermost light-sensitive layer of the photographic material (in general, a blue-sensitive layer) within the above range to coincide with the gradation obtained in development processing I.

The pH of the color developing solutions in development processing I and II is 10.05. It is preferred to use carbonate to maintain the pH of the processing solution 10.05. The addition amount thereof is preferably 0.1 mol/liter or more and from 0.2 to 0.3 mol/liter is particularly preferred.

Hydroxylamine and sulfite are preferably used as preservatives for a color developing agent. The addition amount of hydroxylamine is preferably from 0.05 to 0.2 mol/liter. The addition amount of sulfite is preferably from 0.02 to 0.04 mol/liter.

A bromine ion can be added to a color developing solution for adjusting developing speed.

Further, various chelating agent can be added to a color developing solution.

The processing steps after color development of development processing I and II (a desilvering step, a washing step) may be common to development processing I and II, and the processing solutions in development processing A and B described later can be used.

Specific examples of development processing I and development processing II are described below. When these two processes are conducted, the gradations of the uppermost light-sensitive layer (in general, a blue-sensitive layer) of the photographic material are contrived to almost coincide with.

Specific Examples of Development Processing Steps I and II

Development Processing I-1

Processing Step of Development Processing I-1

| Processing Step | Processing Time | Processing Temperature (° C.) |
|---|---|---|
| Color Development | 3 min 15 sec | 38 |
| Bleaching | 1 min 00 sec | 38 |
| Blixing | 3 min 15 sec | 38 |
| Washing (1) | 1 min 00 sec | 38 |
| Washing (2) | 1 min 00 sec | 38 |
| Drying | 2 min 00 sec | 60 |

Processing Solution of Development Processing I-1

| Color Developing Solution | Tank Solution (g) |
|---|---|
| Diethylenetriaminepentaacetic Acid | 1.0 |
| 1-Hydroxyethylidene-1,1-diphosphonic Acid | 2.0 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-Ethyl-N-(β-hydroxyethyl)amino]-2-methylaniline Sulfate | 4.5 |
| Water to make | 1.0 liter |
| pH (adjusted with potassium hydroxide and sulfuric acid) | 10.05 |

| Bleaching Solution | Tank Solution (g) |
|---|---|
| Ammonium Ethylenediaminetetraacetato Ferrate Dihydrate | 120.0 |
| Disodium Ethylenediaminetetraacetate | 10.0 |
| Ammonium Bromide | 100.0 |
| Ammonium Nitrate | 10.0 |
| Bleach Accelerating Agent $(CH_3)_2N—CH_2—CH_2—S—S—CH_2—CH_2—N(CH_3)_2.2HCl$ | 0.005 mol |
| Aqueous Ammonia (27%) | 15.0 ml |

-continued

| Bleaching Solution | Tank Solution (g) |
|---|---|
| Water to make | 1.0 liter |
| pH (adjusted with aqueous ammonia and nitric acid) | 6.3 |

| Blixing Solution | Tank Solution (g) |
|---|---|
| Ammonium Ethylenediaminetetraacetato Ferrate Dihydrate | 50.0 |
| Disodium Ethylenediaminetetraacetate | 5.0 |
| Sodium Sulfite | 12.0 |
| Aqueous Solution of Ammonium Thiosulfate (700 g/liter) | 240.0 ml |
| Aqueous Ammonia (27%) | 6.0 ml |
| Water to make | 1.0 liter |
| pH (adjusted with aqueous ammonia and acetic acid) | 7.2 |

Washing Water (tank solutions (1) and (2) are common)

City water was passed through a mixed bed column packed with an H-type strongly acidic cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 0.15 g/liter of sodium sulfate were added thereto. The pH of this washing water was in the range of from 6.5 to 7.5.

Development Processing II-1

Processing Step of Development Processing II-1

| Processing Step | Processing Time | Processing Temperature (° C.) |
|---|---|---|
| Color Development | 60 sec | 45 |
| Bleaching | 1 min 00 sec | 38 |
| Blixing | 3 min 15 sec | 38 |
| Washing (1) | 1 min 00 sec | 38 |
| Washing (2) | 1 min 00 sec | 38 |
| Drying | 2 min 00 sec | 60 |

Processing Solution of Development Processing II-1

| Color Developing Solution | Tank Solution (g) |
|---|---|
| Diethylenetriaminepentaacetic Acid | 2.0 |
| 1-Hydroxyethylidene-1,1-diphosphonic Acid | 3.0 |
| Sodium Sulfite | 3.9 |
| Potassium Carbonate | 37.5 |
| Potassium Bromide | 2.0 |
| Potassium Iodide | 1.3 mg |
| Hydroxylamine Sulfate | 4.5 |
| Silver Halide Solvent (Compound B-3) | 0.27 |
| 2-Ethyl-4-[N-ethyl-N-(β-hydroxyethyl)-amino]aniline Sulfate | 11.0 |
| Water to make | 1.0 liter |
| pH (adjusted with potassium hydroxide and sulfuric acid) | 10.05 |

Bleaching Solution

Common to development processing I-1.

Blixing Solution

Common to development processing I-1.

Washing Water

Both tank solutions (1) and (2) are common to development processing I-1.

Next, development processing A and development processing B for use in the present invention are described in detail below.

Development processing A and development processing B for use in the present invention each comprises a color development step, a desilvering step and a drying step. Preferred specific examples thereof are shown below but the present invention is not limited thereto.

(1) Color Development—Bleaching—Fixing—Washing—Stabilization—Drying (2) Color Development—Bleaching—Blixing Fixing—Washing—Stabilization—Drying (3) Color Development—Blixing—Washing—Stabilization—Drying (4) Color Development—Bleaching—Blixing—Washing—Stabilization—Drying (5) Color Development—Blixing—Fixing—Washing—Stabilization—Drying (6) Color Development—Bleaching—Washing—Fixing—Washing—Stabilization—Drying In the above processing steps, washing step before stabilization can be omitted. Further, the final stabilization can also be omitted. In development processing A and development processing B for use in the present invention, the desilvering step after color development may be the same or different.

Color development processing A in development processing A according to the present invention is explained below.

The color developing time in color development processing A for use in the present invention is from 150 seconds to 200 seconds, preferably from 165 seconds to 195 seconds.

The color developing time can be varied according to the kind and the concentration of the developing agent and the concentration of halogen ion (in particular, $Br^-$) in the processing solution, and the temperature and pH of the processing solution.

As the developing agent in color development processing A for use in the present invention, 2-methyl-4-[N-ethyl-N-(β-hydroxyethyl)amino]aniline, 2-methyl-4-[N-ethyl-N-(3-hydroxypropyl)amino]aniline, 2-methyl-4-[N-ethyl-N-(4-hydroxybutyl)amino]aniline are preferably used, and 2-methyl-4-[N-ethyl-N-(β-hydroxyethyl)amino]aniline is particularly preferably used. The concentration of the developing agent is from 15 mmol to 20 mmol, preferably from 15 mmol to 18 mmol, per liter of the processing solution. These developing agents are preferably hydrochloride, p-toluene-sulfonate or sulfate.

The concentration of the bromine ion is determined by the dissolution amount of $Br^-$ from the silver halide color photographic material and the amount of $Br^-$ supplemented to the color developing solution. The addition amount thereof is from 6 mmol to 14 mmol, preferably from 9 mmol to 13 mmol, per liter of the processing solution, for maintaining the stability of the photographic characteristics at the time of continuous processing.

The temperature of the processing solution is from 37° C. to 40° C., preferably from 37° C. to 39° C.

The pH of the processing solution is from 9.9 to 10.3, preferably from 10.0 to 10.2.

Specifically, the color developing solution and the color developing replenisher using CN-16, CN-16X, CN-16Q, CN-16FA and CN-16L which are the processing agents for a color negative film manufactured by Fuji Photo Film Co., Ltd., or the color developing solution using C-41, C-41B, C-41RA, which are the processing agents for a color negative film manufactured by Eastman Kodak Company, can preferably be used.

Color development processing B in development processing B according to the present invention is explained below.

The color developing time in color development processing B for use in the present invention is from 25 seconds to 90 seconds, preferably from 35 seconds to 75 seconds, and most preferably from 45 seconds to 65 seconds.

The color developing time according to the present invention is a time including a crossover time (the time from coming out of the color developing solution until entering the processing solution of the next step). The crossover time is preferably as short as possible, but from the performance of the processor, it is preferably from 2 seconds to 10 seconds, more preferably from 3 seconds to 7 seconds.

The color developing time in color development processing B can also be varied, as in color development processing A, according to the kind and the concentration of the developing agent and the concentration of halogen ion (in particular, $Br^-$) in the processing solution, and the temperature and pH of the processing solution.

The developing agent in color development processing B for use in the present invention is a p-phenylenediamine derivative and preferred representative examples are shown below.

(D-1) 2-Methyl-4-[N-ethyl-N-(β-hydroxyethyl)amino] aniline (D-2) 2-Methyl-4-[N-ethyl-N-(3-hydroxypropyl)amino] aniline (D-3) 2-Methyl-4-[N-ethyl-N-(4-hydroxybutyl)amino] aniline (D-4) 2-Methyl-N,N-diethyl-p-phenylenediamine (D-5) 2-Methyl-4-[N-ethyl-N-(β-methanesulfonamidoethyl)amino]aniline (D-6) 2-Methoxy-4-[N-ethyl-N-(β-hydroxyethyl)amino] aniline (D-7) 4-Methyl-3-methoxy-N,N-bis(3-hydroxypropyl) aniline (D-8) 4-Amino-3-isopropyloxy-N,N-bis(β-hydroxyethyl) aniline (D-9) 1-(β-Hydroxyethyl)-5-amino-6-methylindoline (D-10) 1,2,3,4-Tetrahydro-1-(3,4-dihydroxybutyl)-2,2,4,7-tetramethyl-6-aminoquinoline (D-11) 1,2,3,4-Tetrahydro-1-(β-hydroxyethyl)-4-hydroxymethyl-6-amino-7-methylquinoline In color development processing B for use in the present invention, D-1, D-2, D-3, D-6, D-7, D-8, D-10 and D-11 are preferred, D-1, D-2 and D-3 are more preferred, and D-1 is most preferred.

The concentration of the developing agent is from 25 mmol to 80 mmol, preferably from 25 mmol to 60 mmol, more preferably from 27 mmol to 50 mmol, and most preferably from 30 mmol to 45 mmol, per liter of the processing solution.

The above developing agents can be used in combination of two or more within the above range of the concentration of the developing agent.

In color development processing B for use in the present invention, a bromine ion is particularly important as an antifoggant, and the concentration of $Br^-$ is from 15 mmol to 60 mmol, preferably from 16 mmol to 42 mmol, and particularly preferably from 16 mmol to 35 mmol, per liter of the processing solution.

The temperature of the processing solution is from 40° C. to 60° C., preferably from 42° C. to 55° C., and particularly preferably from 43° C. to 50° C.

The pH of the processing solution is from 9.9 to 11.0, preferably from 10.0 to 10.5.

Further, the color developing solution of development processing B for use in the present invention contains at least one of the above-described silver halide solvents according to the present invention. The amount to be used, preferred compounds and the usage thereof are as described above.

The color developing solutions of the color development processing A and/or B for use in the present invention can contain the following compounds.

For example, in addition to hydroxylamine and diethylhydroxylamine, various preservatives such as the hydroxylamines represented by formula (I) of JP-A-3-144446, sulfite, hydrazines, e.g., N,N-biscarboxymethylhydrazine, phenylsemicarbazides, triethanolamine and catecholsulfonic acids, an organic solvent such as ethylene glycol and diethylene glycol, a development accelerator such as benzyl alcohol, polyethylene glycol, quaternary ammonium salt, and amines, a dye-forming coupler, a competitive coupler, an auxiliary developing agent such as 1-phenyl-3-pyrazolidone, a thickener, and various chelating agents typified by aminopolycarboxylic acid, aminopolyphosphonic acid, alkylphosphonic acid, and phosphonocarboxylic acid, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids can be enumerated as representatives.

Of the above, substituted hydroxylamine is most preferred as preservatives, above all, diethylhydroxylamine, monomethylhydroxylamine, or hydroxylamine which has a substituent such as an alkyl group substituted with a water-soluble group, e.g., a sulfo group, a carboxyl group or a hydroxyl group is preferred. Most preferred are N,N-bis(2-sulfoethyl)hydroxylamine, monomethylhydroxylamine and diethylhydroxylamine.

The color developing solutions of the color development processing A and/or B for use in the present invention can contain arbitrary antifoggants. Alkali metal halides such as sodium chloride, potassium bromide and potassium iodide, and organic antifoggants can be used as such an antifoggant. Representative examples of the organic antifoggants include, for example, nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

Various buffering agents are preferably used for maintaining the pH of the color developing solutions of the color development processing A and/or B for use in the present invention, for example, carbonate, phosphate, borate, tetraborate, hydroxybenzoate, glycyl salt, N,N-dimethylglycine salt, leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxyaminomethane salt, and lysine salt can be used. The use of carbonate is particularly preferred.

The addition amount of the buffering agent to the developing agent is preferably 0.1 mol/liter or more and from 0.1 mol/liter to 0.4 mol/liter is particularly preferred.

Further, biodegradable compounds are preferably used as a chelating agent, for example, the chelating agents disclosed in JP-A-63-146998, JP-A-63-199295, JP-A-63-267750, JP-A-63-267751, JP-A-2-229146, JP-A-3-186841, German Patent 3,739,610 and European Patent 468,325 can be cited as such a chelating agent.

The processing solutions in a processing tank and a replenisher tank of a color developing solution are preferred to be shielded with a liquid, such as a high boiling point organic solvent, to reduce the contact area with air. Liquid paraffin is most preferred as such a liquid shielding agent, and the use in a replenisher tank is most preferred.

The replenishing amount is from 30 to 800 ml, preferably from 50 to 500 ml or so per $m^2$ of the photographic material.

The color developing solutions in development processing A and B for use in the present invention can contain an optional development accelerator, if necessary.

For example, the thioether based compounds disclosed in JP-B-37-16088, JP-B-37-5987, JP-B-38-7826, JP-B-44-12380, JP-B-45-9019 and U.S. Pat. No. 3,813,247, the p-phenylenediamine based compounds disclosed in JP-A-52-49829 and JP-A-50-15554, the quaternary ammonium salts disclosed in JP-A-50-137726, JP-B-44-30074, JP-A-56-156826 and JP-A-52-43429, the amine based compounds disclosed in U.S. Pat. Nos. 2,494,903, 3,128,182, 4,230,796, 3,253,919, JP-B-41-11431, U.S. Pat. Nos. 2,482,546, 2,596,926, and 3,582,346, and the polyalkylene oxides disclosed in JP-B-37-16088, JP-B-42-25201, U.S. Pat. No. 3,128,183, JP-B-41-11431, JP-B-42-23883 and U.S. Pat. No. 3,532,501, and also 1-phenyl-3-pyrazolidones and imidazoles can be added as a development accelerator, if necessary.

Next, the desilvering step in development processing A and B for use in the present invention is described in detail below.

As a bleaching agent for use in a processing solution which has a bleaching ability, aminopolycarboxylic acid iron(III) complex, persulfate, bromate, hydrogen peroxide, and red prussiate can be used, but aminopolycarboxylic acid iron(III) complex is most preferably used.

The iron(III) complex salt for use in the present invention may be added as previously formed iron complex salt and dissolved, or a complex-forming compound may be added with iron(III) salt (e.g., ferric sulfate, ferric chloride, ferric bromide, ferric nitrate, ammonium ferric sulfate) and form a complex salt in a solution having the bleaching ability.

The complex-forming compound may be added in a little excessive amount than the amount required to form complexes with the ferric ion. When it is added in an excessive amount, an excessive amount within the range of from 0.01 to 10% is preferred.

As the compound which forms ferric complex salt in a solution having the bleaching ability in the present invention, the following compounds can be enumerated but the present invention is not limited thereto. Examples thereof include ethylenediaminetetraacetic acid (EDTA), 1,3-propanediaminetetraacetic acid (1,3-PDTA), diethylenetriaminepentaacetic acid, 1,2-cyclohexanediaminetetraacetic acid, iminodiacetic acid, methyliminodiacetic acid, N-(2-acetamido)iminodiacetic acid, nitrilotriacetic acid, N-(2-carboxyethyl)iminodiacetic acid, N-(2-carboxymethyl)iminodipropionic acid, β-alaninediacetic acid, 1,4-diaminobutanetetraacetic acid, glycol ether diaminetetraacetic acid, N-(2-carboxyphenyl) iminodiacetic acid, ethylenediamine-N-(2-carboxyphenyl)-N,N',N'-triacetic acid, ethylenediamine-N,N'-disuccinic acid, 1,3-diaminopropane-N,N'-disuccinic acid, ethylenediamine-N,N'-dimalonic acid, and 1,3-diaminopropane-N,N'-dimalonic acid.

The concentration of the ferric complex salt in the solution having the bleaching ability in the present invention is appropriately from 0.005 to 1.0 mol/liter, preferably from 0.01 to 0.50 mol/liter, and more preferably from 0.02 to 0.30 mol/liter.

Further, the concentration of the ferric complex salt in the replenisher of the solution having the bleaching ability in the present invention is preferably from 0.005 to 2 mol/liter, more preferably from 0.01 to 1.0 mol/liter.

Various compounds can be used as bleaching accelerators in the bath having the bleaching ability or the previous baths thereof, for example, the compounds which have a mercapto group or a disulfido group disclosed in U.S. Pat. No. 3,893,858, German Patent 1,290,812, JP-A-53-95630, and *Research Disclosure*, No. 17129 (July, 1978); the thiourea-based compounds disclosed in JP-B-45-8506, JP-A-52-20832, JP-A-53-32735, and U.S. Pat. No. 3,706,561; and halides such as iodine ion and bromine ion are preferred for excellent bleaching ability.

In addition, the bath having the bleaching ability applicable to the present invention can contain a rehalogenating agent such as bromide (e.g., potassium bromide, sodium bromide, ammonium bromide), chloride (e.g., potassium chloride, sodium chloride, ammonium chloride) or iodide (e.g., ammonium iodide). The bath having the bleaching ability for use in the present invention can contain, if required, one or more inorganic or organic compounds having a pH buffering ability such as borax, sodium metaborate, acetic acid, sodium acetate, sodium carbonate, potassium carbonate, phosphorous acid, phosphoric acid, sodium phosphate, citric acid, sodium citrate, tartaric acid, malonic acid, succinic acid and glutaric acid, and alkali metal or an ammonium salt of these compounds, or a corrosion inhibitor such as ammonium nitrate and guanidine.

Further, in addition, various brightening agents, defoaming agents, surfactants, organic solvents such as polyvinyl pyrrolidone and methanol can be added to the bath having the bleaching ability.

The components of the fixing agent in a blixing solution and a fixing solution are known fixing agents, that is, water-soluble silver halide solvents such as thiosulfate, e.g., sodium thiosulfate and ammonium thiosulfate; thiocyanate, e.g., sodium thiocyanate and ammonium thiocyanate; thioether compounds, e.g., ethylene-bisthioglycolic acid and 3,6-dithia-1,8-octanediol, mesoionic compounds and thioureas. These compounds can be used in combination of one or two or more. Moreover, the special blixing solution comprising the combination of the fixing agent and halide such as a large amount of potassium iodide as disclosed in JP-A-55-155354 can also be used. The use of thiosulfate, in particular, ammonium thiosulfate and sodium thiosulfate is preferred in the present invention. The amount of the fixing agent is preferably from 0.3 to 2 mol/liter, more preferably from 0.5 to 1.0 mol/liter.

It is preferred for the blixing solution and the fixing solution for use in the present invention to contain sulfite (or bisulfite and metabisulfite) as a preservative, in particular, in the amount of from 0.08 to 0.4 mol/liter, more preferably from 0.1 to 0.3 mol/liter. With the amount of within this range and using the final bath according to the present invention, not only the capacity of the magnetic recording layer has been extremely improved, but the image storage stability showed desired results.

The blixing solution and the fixing solution for use in the present invention can contain aldehydes (e.g., benzaldehyde, acetaldehyde), ketones (e.g., acetone), ascorbic acids, and hydroxylamines, if required, in addition to the compounds which release sulfite ions as the above described preservatives such as sulfite (e.g., sodium sulfite, potassium sulfite, ammonium sulfite), bisulfite (e.g., ammonium bisulfite, sodium bisulfite, potassium bisulfite), and metabisulfite (e.g., potassium metabisulfite, sodium metabisulfite, ammonium metabisulfite).

Further, the bleaching solution, the blixing solution and the fixing solution for use in the present invention can contain a buffering agent, a brightening agent, a chelating agent, a defoaming agent and an antimold, as required.

The pH of the bleaching solution and the blixing solution for use in the present invention is preferably from 4.5 to 6.2, more preferably from 5 to 6. The pH higher or lower than this range sometimes cannot exhibit sufficient capacity of the magnetic recording layer. The pH of the fixing solution is preferably from 5 to 8 or so.

The replenishment rate to the bleaching solution, the blixing solution and the fixing solution for use in the present invention is from 50 to 2,000 ml, and particularly preferably from 100 to 1,000 ml, per $m^2$ of the photographic material. The overflow generated from the washing bath or the stabilizing bath, the next baths, may be replenished to the bleaching bath, the blixing bath and the fixing bath, if required.

The processing temperature of the bleaching solution, the blixing solution and the fixing solution is from 20 to 50° C., preferably from 30 to 45° C. The processing time is from 10 seconds to 3 minutes, preferably from 20 seconds to 2 minutes.

In carrying out the processing, it is particularly preferred to subject the processing solution having the bleaching ability of the present invention to aeration to maintain the photographic characteristics in extremely stabilized conditions. Various methods known in the art can be used for aeration including blowing air into the processing solution having the bleaching ability, or absorbing air using an ejector.

In carrying out the air blowing, it is preferred to discharge air into the solution using a diffuser having fine pores. Such a diffuser is widely used in an aeration tank in the activated sludge processing. With regard to the aeration, the item disclosed in *Z-121, Using Process C-41*, 3rd Edition, pages BL-1 to BL-2, published by Eastman Kodak Company (1982) can be utilized. In the processing using the processing solution having the bleaching ability for use in the present invention, vigorous stirring is preferred and the practical example disclosed in JP-A-3-33847, p. 8, right upper column, line 6 to left lower column, line 2 can be utilized as it is.

Stirring as vigorous as possible in the desilvering process is preferred. Specific examples of the methods of forced stirring include the method wherein a jet of the processing solution is impinged on the surface of the emulsion of the photographic material as disclosed in JP-A-62-183460, the method wherein the stirring effect is raised using a rotating means as disclosed in JP-A-62-183461, the method wherein the photographic material is moved with a wiper blade, which is installed in the solution, in contact with the surface of the emulsion, and the generated turbulent flow at the surface of the emulsion increases the stirring effect, and the method wherein the circulating flow rate of the entire processing solution is increased. These means for increasing the stirring level are effective for the bleaching solution, the blixing solution and the fixing solution. It is supposed that the increased stirring level increases the rate of supply of the bleaching agent and the fixing agent to the emulsion film and, as a result, increases the desilvering rate. Further, the above means of increasing stirring are more effective when a bleaching accelerator is used, and it is possible to extremely increase the bleaching accelerating effect and to eliminate the fixing hindrance action due to the bleaching accelerator.

The automatic processors which are used in the present invention preferably have the means of transporting photographic materials as disclosed in JP-A-60-191257, JP-A-60-191258, and JP-A-60-191259. As described in the above JP-A-60-191257, such a transporting means can greatly reduce the carryover of the processing solution from the previous bath to the next bath and effectively prevent the deterioration of the capacity of the processing solution, and is especially effective in reducing the processing time of each processing step and reducing the replenishment rate of each processing solution.

The amount of washing water in the washing step of development processing A and B for use in the present invention can be selected from a wide range according to the characteristics and the application of the photographic materials (for example, the materials used such as couplers, etc.), the temperature of a washing water, the number of washing tanks (the number of washing stages), the replenishing system, that is, whether a countercurrent system or a concurrent system, and other various conditions. Of the foregoing conditions, the relationship between the number of washing tanks and the amount of water in a multistage countercurrent system can be obtained by the method described in *Journal of the Society of Motion Picture and Television Engineers*, Vol. 64, pages 248 to 253 (May, 1955). According to the multistage countercurrent system of the above literature, the amount of the washing water can be greatly reduced, however, problems arise that bacteria proliferate due to the increased residence time of the water in the tanks, and suspended matters produced thereby adhere to the photographic material. In processing of the color photographic material of the present invention, the method of reducing the calcium ion and magnesium ion concentrations as disclosed in JP-A-62-288838 can be used as a very effective means for overcoming these problems. Also, the isothiazolone compounds and the thiabendazoles as disclosed in JP-A-57-8542, the chlorine based antibacterial agents such as chlorinated sodium isocyanurate, in addition, the benzotriazole, and the antibacterial agents disclosed in Hiroshi Horiguchi, *Bohkin Bohbai no Kagaku* (*Antibacterial and Antifungal Chemistry*), published by Sankyo Shuppan K. K. (1986), *Biseibutsu no Mekkin, Sakkin, Bohbai Gijutsu* (*Germicidal and Antifungal Techniques of Microorganisms*), edited by Eisei Gijutsukai, published by Kogyo Gijutsukai (1982), and *Bohkin Bohbai Zai Jiten* (*Antibacterial and Antifungal Agents Thesaurus*), edited by Nippon Bohkin Bohbai Gakkai (1986), can be used.

The pH of the washing water in the processing of the photographic material of the present invention is generally from 3 to 9 and preferably from 4 to 8. The temperature and the time of a washing step can be selected variously according to the characteristics and the end use purpose of the photographic material to be processed, but is generally from 15 to 45° C. for 20 seconds to 10 minutes, and preferably from 25 to 40° C. for 30 seconds to 5 minutes. Further, the photographic material of the present invention can be processed directly with a stabilizing solution without employing a washing step as described above. Any known methods as disclosed in JP-A-57-8543, JP-A-58-14834 and JP-A-60-220345 can be used in such a stabilizing process.

A stabilizing solution contains dye image stabilizing compounds, for example, formaldehyde, benzaldehydes such as m-hydroxybenzaldehyde, bisulfite addition products of formaldehyde, hexamethylenetetramine and derivatives thereof, hexahydrotriazine and derivatives thereof, dimethylolurea, N-methylol compounds such as N-methylolpyrazole, organic acids and pH buffers. The preferred amount added of these compounds is from 0.001 to 0.02 mol per liter of the stabilizing solution, but the lower the concentration of the free formaldehyde in the stabilizing solution, the less is the splashing of the formaldehyde gas, and is preferred. From these points, m-hydroxybenzaldehyde, hexamethylenetetramine, N-methylolazoles such as N-methylolpyrazole disclosed in JP-A-4-270344, and azolylmethylamines such as N,N'-bis(1,2,4-triazol-1-ylmethyl)piperazine, etc., disclosed in JP-A-4-313753 are preferred as dye image stabilizers. In particular, a combined use of azoles such as 1,2,4-triazole disclosed in JP-A-4-359249 (corresponding to EP-A-519190) with azolylmethylamine such as 1,4-bis(1,2,4-triazol-1-ylmethyl)piperazine, and derivatives thereof is preferred because the high image stability can be obtained thereby and also low vapor pressure of the formaldehyde is generated thereby. Further, it is preferred to include various compounds in the stabilizing solution, if necessary, for example, ammonium compounds such as ammonium chloride and amm onium sulfite, metal compounds such as Bi and Al, a brightening agent, a hardening agent, alkanolamine disclosed in U.S. Pat. No. 4,786,583, and preservatives which can be included in the aforementioned fixing solution and blixing solution, e.g., sulfinic acid compounds as disclosed in JP-A-1-231051.

A washing water and/or a stabilizing solution can contain various surfactants to prevent the generation of water marks during drying of the processed photographic materials. Nonionic surfactants are preferably used above all, and ethylene oxide addition product of alkylphenl is particularly preferred. Octyl-, nonyl-, dodecyl-, and dinonylphenol are preferred as the alkylphenol and the addition mol number of the ethylene oxide is preferably from 8 to 14. Further, it is preferred to use silicone based surfactants having high defoaming ability.

A washing water and/or a stabilizing solution are preferred to contain various kinds of chelating agents. Preferred chelating agents include aminopolycarboxylic acid, e.g., ethylenediaminetetraacetic acid and diethylenetriaminepentaacetic acid, organic phosphonic acid, e.g., 1-hydroxyethylidene-1,1-diphosphonic acid, N,N,N'-trimethylenephosphonic acid, diethylenetriamine-N,N,N',N'-tetramethylenephosphonic acid, and a hydrolysis product of a maleic anhydride polymer disclosed in EP-A-345172, and the like.

The overflow generated by the replenishment of the above described washing water and/or stabilizing solution can be reused in other steps such as a desilvering step, etc.

When the above each processing solution is concentrated due to evaporation by the processing using an automatic processor, etc., it is preferred to replenish an appropriate amount of water, compensating solution, or replenisher of each processing solution to compensate for the concentration by evaporation. There is no particular limitation on the method of supplying the water, but the following methods are preferred of all, e.g., a method wherein a separate monitoring water tank is established with the bleaching tank, and the amount of water evaporated from the bleaching tank is calculated from the amount of water evaporated from the monitoring water tank, and water is replenished to the bleaching tank in proportion to this amount of evaporation, which is disclosed in JP-A-1-254959 and JP-A-1-254960, and a method wherein a liquid level sensor or an overflow sensor is used to compensate for the evaporated amount of water, disclosed in JP-A-3-248155, JP-A-3-249644, JP-A-3-249645 and JP-A-3-249646. The water to be added to the processing solution for compensating for the evaporated portion of each processing solution may be city water, but the deionized water or sterilized water which is preferably used in the above washing step is preferred.

The method of searching for the gradient in the present invention is explained.

First, the test sample of a photographic material is wedgewise exposed to a light source having energy distribution of 4,800° K of black body radiation, and after the designated development processing is conducted, absorption densities of cyan, magenta and yellow are measured by status M condition to obtain a characteristic curve. Each point of fog+0.2, +0.5, +1.0 and +1.5 of the absorption densities of cyan, magenta and yellow to the logarithm of exposure amount (axis of abscissa) is plotted from the characteristic curve obtained, and these points are linearly approximated by the least square method. The inclination of the straight line obtained is defined as the gradient γ of the photographic material and γ of each of cyan, magenta and yellow is taken as γ (C), γ (M) and γ (Y), respectively.

When development processing I and development processing II are carried out, the gradients of yellow, magenta and cyan obtained by these development processing, $\gamma_I(C)$, $\gamma_I(M)$, $\gamma_I(Y)$, and $\gamma_{II}(C)$, $\gamma_{II}(M)$, $\gamma_{II}(Y)$, respectively, of the photographic material of the present invention satisfy the following conditions:

$0.8 \leqq \gamma_{II}(C)/\gamma_I(C) \leqq 1.2$ $0.8 \leqq \gamma_{II}(M)/\gamma_I(M) \leqq 1.2$ $0.8 \leqq \gamma_{II}(Y)/\gamma_I(Y) \leqq 1.2$ More preferably they satisfy the following conditions:

$0.9 \leqq \gamma_{II}(C)/\gamma_I(C) \leqq 1.1$ $0.9 \leqq \gamma_{II}(M)/\gamma_I(M) \leqq 1.1$ $0.9 \leqq \gamma_{II}(Y)/\gamma_I(Y) \leqq 1.1$ When these conditions are not satisfied, the tint of the color of the print obtained from the color negative film developed by at least either one of development processing A or B breaks and the color reproduction worth appreciating cannot be obtained.

In the present invention, $\gamma_I(C)$, $\gamma_I(M)$, $\gamma_I(Y)$, $\gamma_{II}(C)$, $\gamma_{II}(M)$, $\gamma_{II}(Y)$ each is preferably from 0.50 to 0.90, more preferably from 0.60 to 0.85, and particularly preferably from 0.65 to 0.80.

The photographic material of the present invention comprises a red-sensitive layer, a green-sensitive layer and a blue-sensitive layer provided in this order from the support side. However, the order of arrangement can be reversed depending on the purpose, alternatively, the light-sensitive layers may be arranged in such a way that a layer having a different spectral sensitivity is interposed between layers having the same spectral sensitivity. Light-insensitive layers may be provided between the above-described silver halide light-sensitive layers, and on the uppermost layer and beneath the lowermost layer of the silver halide light-sensitive layers. These light-insensitive layers may contain couplers, DIR compounds and color mixing preventives described below. As the plurality of silver halide emulsion layers constituting each unit light-sensitive layer, a two-layer structure of a high sensitivity emulsion layer and a low sensitivity emulsion layer can be preferably used with the emulsion layers being arranged so as to decrease in sensitivity toward a support in turn as disclosed in German Patent 1,121,470 and British Patent 923,045. In addition, a low sensitivity emulsion layer may be provided farther from the support and a high sensitivity emulsion layer may be provided nearer to the support as disclosed in JP-A-57-112751, JP-A-62-200350, JP-A-62-206541 and JP-A-62-206543.

In one specific example, a low sensitivity blue-sensitive layer (BL)/a high sensitivity blue-sensitive layer (BH)/a high sensitivity green-sensitive layer (GH)/a low sensitivity green-sensitive layer (GL)/a high sensitivity red-sensitive layer (RH)/a low sensitivity red-sensitive layer (RL), or BH/BL/GL/GH/RH/RL, or BH/BL/GH/GL/RL/RH can be arranged in this order from the side farthest from the support.

A blue-sensitive layer/GH/RH/GL/RL can be arranged in this order from the side farthest from the support as disclosed in JP-B-55-34932. Further, a blue-sensitive layer/GL/RL/GH/RH can be arranged in this order from the side farthest from the support as disclosed in JP-A-56-25738 and JP-A-62-63936.

Further, useful arrangements include the arrangement in which there are three layers having different degrees of sensitivities with the sensitivity being lower towards the support such that the upper layer is a silver halide emulsion layer having the highest sensitivity, the middle layer is a silver halide emulsion layer having a lower sensitivity than that of the upper layer, and the lower layer is a silver halide emulsion layer having a lower sensitivity than that of the middle layer, as disclosed in JP-B-49-15495. In the case of the structure of this type comprising three layers having different degrees of sensitivity, the layers in the unit layer of the same spectral sensitivity may be arranged in the order of a middle sensitivity emulsion layer/a high sensitivity emulsion layer/a low sensitivity emulsion layer, from the side farthest from the support, as disclosed in JP-A-59-202464.

Alternatively, the layers can be arranged in the order of a high sensitivity emulsion layer/a low sensitivity emulsion layer/a middle sensitivity emulsion layer, or a low sensitivity emulsion layer/a middle sensitivity emulsion layer/a high sensitivity emulsion layer. Moreover, the arrangement may be varied as indicated above in the case where there are four or more layers.

For improving color reproducibility, a donor layer (CL) for an interlayer effect having a different spectral sensitivity distribution from a main light-sensitive layer such as BL, GL and RL may preferably be provided adjacent or close to the main light-sensitive layer, as disclosed in U.S. Pat. Nos. 4,663,271, 4,705,744, 4,707,436, JP-A-62-160448 and JP-A-63-89850.

The silver halides preferably used in the present invention are silver iodobromide, silver iodochloride or silver iodochlorobromide containing about 30 mol % or less of silver iodide, and particularly preferably used are silver iodobromide or silver iodochlorobromide containing from about 2 mol % to about 10 mol % of silver iodide.

Silver halide grains in a photographic emulsion may have a regular crystal form such as a cubic, octahedral or tetradecahedral form, an irregular crystal form such as a spherical or plate-like form, a form which has crystal defects such as twin crystal planes, or a form which is a composite of these forms.

The silver halide grains may be a fine grain having a grain size of about 0.2 μm or less, or large size grains having a projected area diameter of up to about 10 μm, and the emulsion may be a polydisperse emulsion or a monodisperse emulsion.

The silver halide photographic emulsions for use in the present invention can be prepared using the methods disclosed, for example, in *Research Disclosure* (hereinafter abbreviated to *RD*), No. 17643 (December, 1978), pages 22 and 23, "I. Emulsion Preparation and Types", *RD*, No. 18716 (November, 1979), page 648, *RD*, No. 307105 (November, 1989), pages 863 to 865, P. Glafkides, *Chimie et Physique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964).

The monodisperse emulsions disclosed in U.S. Pat. Nos. 3,574,628, 3,655,394 and British Patent 1,413,748 are also preferred.

Further, tabular grains having an aspect ratio of about 3 or more can also be used in the present invention. Tabular grains can be easily prepared according to the methods disclosed, for example, in Gutoff, *Photographic Science and Engineering*, Vol. 14, pages 248 to 257 (1970), U.S. Pat. Nos. 4,434,226, 4,414,310, 4,433,048, 4,439,520 and British Patent 2,112,157.

The crystal structure may be uniform, or the interior and exterior parts of the grains may be comprised of different halogen compositions, or the grains may have a layered structure. Silver halides which have different compositions may be joined with an epitaxial junction or may be joined with compounds other than a silver halide, such as silver thiocyanate or lead oxide. Further, mixtures of grains which have various crystal forms may also be used.

The above described emulsions may be of the surface latent image type wherein the latent image is primarily formed on the surface, or of the internal latent image type wherein the latent image is formed within the grains, or of a type wherein the latent image is formed both at the surface and within the grains, but a negative type emulsion is essential. Of the internal latent image types, the emulsion may be a core/shell type internal latent image type emulsion as disclosed in JP-A-63-264740, and a method for preparation of such a core/shell type internal latent image type emulsion is disclosed in JP-A-59-133542. The thickness of the shell of this emulsion varies depending on the development process, but is preferably from 3 to 40 nm, and particularly preferably from 5 to 20 nm.

The silver halide emulsion for use in the present invention is usually subjected to physical ripening, chemical ripening and spectral sensitization. Additives for use in such processes are disclosed in *RD*, No. 17643, *RD*, No. 18716, and *RD*, No. 307105, and the locations of these disclosures are summarized in a table below.

In the photographic material of the present invention, two or more different types of emulsions which are different in terms of at least one of the characteristics of grain size, grain size distribution, halogen composition, the form of the grains, or light sensitivity of the light-sensitive silver halide emulsion can be used in admixture in the same layer.

It is preferred to use the silver halide grains having a fogged grain surface as disclosed in U.S. Pat. No. 4,082,553, the silver halide grains having a fogged grain interior as disclosed in U.S. Pat. No. 4,626,498 and JP-A-59-214852, or colloidal silver in light-sensitive silver halide emulsion layers and/or substantially light-insensitive hydrophilic colloid layers. Silver halide grains having a fogged grain interior or surface are silver halide grains which can be developed uniformly (not imagewise) irrespective of whether these grains are in an unexposed part or an exposed part of the photographic material, and methods for the preparation thereof are disclosed in U.S. Pat. No. 4,626,498 and JP-A-59-214852. The silver halide which forms the internal nuclei of a core/shell type silver halide grains having a fogged grain interior may have different halogen compositions. The silver halide having a fogged grain interior or surface may be any of silver chloride, silver chlorobromide, silver iodobromide, or silver chloroiodobromide. The average grain size of these fogged silver halide grains is preferably from 0.01 to 0.75 μm, and particularly preferably from 0.05 to 0.6 μm. Further, the form of the grains may be regular grains and may be a polydisperse emulsion, but a monodisperse emulsion (at least 95% of which have a grain size within ±40% of the average grain size in terms of the weight or number of silver halide grains) is preferred.

The use of light-insensitive fine grained silver halides is preferred in the present invention. Light-insensitive fine grained silver halides are fine grained silver halides which are not sensitive to light upon imagewise exposure for obtaining color images and which do not substantially undergo development during development processing, and they are preferably not pre-fogged. The fine grained silver halide has a silver bromide content of from 0 to 100 mol %, and may contain silver chloride and/or silver iodide, if necessary. The fine grained silver halides which have a silver iodide content of from 0.5 to 10 mol % are preferred. The average grain size of the fine grained silver halide (the average value of the diameters of the circles corresponding to the projected areas) is preferably from 0.01 to 0.5 μm, more preferably from 0.02 to 0.2 μm.

The fine grained silver halide can be prepared by the same methods as the preparation of generally used light-sensitive silver halides. In the preparation of the fine grained silver halide, the surface of the silver halide grains does not need to be optically sensitized and also does not need to be spectrally sensitized. However, it is preferred to previously include known stabilizers such as triazole based, azaindene based, benzothiazolium based, or mercapto based compounds, or zinc compounds in the fine grained silver halide before addition to the coating solution. Colloidal silver can be included in the layer containing the fine grained silver halide grains.

The coating weight of silver in the photographic material of the present invention is preferably 6.0 g/m$^2$ or less, and most preferably 4.5 g/m$^2$ or less.

Photographic additives which can be used in the present invention are disclosed in RD and the locations related thereto are indicated in the table below.

| | Type of Additives | RD 17643 | RD 18716 | RD 307105 |
|---|---|---|---|---|
| 1. | Chemical Sensitizers | page 23 | page 648, right column | page 866 |
| 2. | Sensitivity Increasing Agents | | page 648, right column | — |
| 3. | Spectral Sensitizers and Supersensitizers | pages 23–24 | page 648, right column to page 649, right column | pages 866–868 |
| 4. | Brightening Agents | page 24 | page 647, right column | page 868 |
| 5. | Light Absorbing Agents, Filter Dyes, and Ultraviolet Absorbing Agents | pages 25–26 | page 649, right column to page 650, left column | page 873 |
| 6. | Binders | page 26 | page 651, left coiumn | pages 873–874 |
| 7. | Plasticizers and Lubricants | page 27 | page 650, right column | page 876 |
| 8. | Coating Aids and Surfactants | pages 26–27 | page 650, right column | pages 875–876 |
| 9. | Antistatic Agents | page 27 | page 650, right column | pages 876–877 |
| 10. | Matting Agents | — | — | pages 878–879 |

Various dye-forming couplers can be used in the present invention, and the following couplers are particularly preferred.

Yellow Couplers:

The couplers represented by formula (I) or (II) disclosed in EP-A-502424; the couplers represented by formula (1) or (2) disclosed in EP-A-513496 (in particular, Y-28 on page 18); the couplers represented by formula (I) disclosed in claim 1 of EP-A-568037; the couplers represented by formula (I), column 1, lines 45 to 55 of U.S. Pat. No. 5,066,576; the couplers represented by formula (I), paragraph 0008 of JP-A-4-274425; the couplers disclosed in claim 1 on page 40 of EP-A-498381 (in particular, D-35 on page 18); the couplers represented by formula (Y) on page 4 of EP-A-447969 (in particular, Y-1 (page 17) and Y-54 (page 41)); and the couplers represented by any of formulae (II) to (IV), column 7, lines 36 to 58 of U.S. Pat. No. 4,476,219 (in particular, II-17 and II-19 (column 17), and II-24 (column 19)).

Magenta Couplers:

L-57 (page 11, right lower column), L-68 (page 12, right lower column), and L-77 (page 13, right lower column) of JP-A-3-39737; [A-4]-63 (page 134), and [A-4]-73 and [A-4]-75 (page 139) of European Patent 456257; M-4 and M-6 (page 26) and M-7 (page 27) of European Patent 486965; M-45 (page 19) of EP-A-571959; (M-1) (page 6) of JP-A-5-204106; and M-22, paragraph 0237 of JP-A-4-362631.

Cyan Couplers:

CX-1, CX-3, CX-4, CX-5, CX-11, CX-12, CX-14 and CX-15 (pages 14 to 16) of JP-A-4-204843; C-7 and C-10 (page 35), C-34 and C-35 (page 37), and (I-1) and (I-17) (pages 42 and 43) of JP-A-4-43345; and the couplers represented by formula (Ia) or (Ib) disclosed in claim 1 of JP-A-6-67385.

Polymer Couplers:

P-1 and P-5 (page 11) of JP-A-2-44345.

Couplers the Colored Dyes of Which Have an Appropriate Diffusibility:

The couplers disclosed in U.S. Pat. No. 4,366,237, British Patent 2,125,570, EP-B-96873 and German Patent 3,234,533 are preferred as couplers the colored dyes of which have an appropriate diffusibility.

Couplers for Correcting the Unnecessary Absorption of Colored Dyes:

Examples of preferred couplers for correcting the unnecessary absorption of colored dyes include the yellow colored cyan couplers represented by formula (CI), (CII), (CIII) or (CIV) disclosed on page 5 of EP-A-456257 (in particular, YC-86 on page 84); the yellow colored magenta couplers ExM-7 (page 202), EX-1 (page 249), and EX-7 (page 251) disclosed in EP-A-456257; the magenta colored cyan couplers CC-9 (column 8) and CC-13 (column 10) disclosed in U.S. Pat. No. 4,833,069; the coupler (2) (column 8) of U.S. Pat. No. 4,837,136; and the colorless masking couplers represented by formula (A) disclosed in claim 1 of WO 92/11575 (in particular, the compounds disclosed on pages 36 to 45).

Examples of compounds (inclusive of couplers) which release photographically useful residual groups of compounds upon reacting with the oxidation product of a developing agent include the following:

Development Inhibitor Releasing Compounds:

the compounds represented by formula (I), (II), (III) or (IV) disclosed on page 11 of EP-A-378236 (in particular, T-101 (page 30), T-104 (page 31), T-113 (page 36), T-131 (page 45), T-144 (page 51) and T-158 (page 58)); the compounds represented by formula (I) disclosed on page 7 of EP-A-436938 (in particular, D-49 (page 51)); the compounds represented by formula (1) disclosed in EP-A-568037 (in particular, (23) (page 11); and the compounds represented by formula (I), (II) or (III) disclosed on pages 5 and 6 of EP-A-440195 (in particular, I-(1) on page 29);

Bleaching Accelerator Releasing Compounds:

the compounds represented by formula (I) or (I') disclosed on page 5 of EP-A-310125 (in particular, (60) and (61) on page 61); and the compounds represented by formula (I) disclosed in claim 1 of JP-A-6-59411 (in particular, (7) on page 7);

Ligand Releasing Compounds:

the compounds represented by LIG-X disclosed in claim 1 of U.S. Pat. No. 4,555,478 (in particular, the compounds in lines 21 to 41, column 12);

Leuco Dye Releasing Compounds:

compounds 1 to 6, columns 3 to 8 of U.S. Pat. No. 4,749,641;

Fluorescent Dye Releasing Compounds:

the compounds represented by COUP-DYE disclosed in claim 1 of U.S. Pat. No. 4,774,181 (in particular, compounds 1 to 11, columns 7 to 10);

Development Accelerator Releasing or Fogging Agent Releasing Compounds:

the compounds represented by formula (1), (2) or (3), column 3 of U.S. Pat. No. 4,656,123 (in particular, (I-22), column 25); and compound ExZK-2, lines 36 to 38, page 75 of EP-A-450637; and Compounds Which Release Dyes the Color of Which is Restored After Elimination:

the compounds represented by formula (I) disclosed in claim 1 of U.S. Pat. No. 4,857,447 (in particular, Y-1 to Y-19, columns 25 to 36).

Preferred additives other than couplers are listed below:

Dispersion Mediums of Oil-Soluble Organic Compound:

P-3, P-5, P-16, P-19, P-25, P-30, P-42, P-49, P-54, P-55, P-66, P-81, P-85, P-86 and P-93 (pages 140 to 144) of JP-A-62-215272;

Latexes for Impregnation of Oil-Soluble Organic Compound:

the latexes disclosed in U.S. Pat. No. 4,199,363;

Scavengers for the Oxidation Product of a Developing Agent:

the compounds represented by formula (I), lines 54 to 62, column 2 of U.S. Pat. No. 4,978,606 (in particular, I-(1), I-(2), I-(6) and I-(12), columns 4 and 5); and the compounds represented by the formula disclosed in lines 5 to 10, column 2 of U.S. Pat. No. 4,923,787 (in particular, compound 1, column 3);

Stain Inhibitors:

the compounds represented by formula (I), (II) or (III), lines 30 to 33, page 4 of EP-A-298321 (in particular, I-47, I-72, III-1 and III-27, pages 24 to 48);

Discoloration Inhibitors:

A-6, A-7, A-20, A-21, A-23, A-24, A-25, A-26, A-30, A-37, A-40, A-42, A-48, A-63, A-90, A-92, A-94 and A-164 (pages 69 to 118) of EP-A-298321; II-1 to III-23, columns 25 to 38 of U.S. Pat. No. 5,122,444 (in particular, III-10); I-1 to III-4, pages 8 to 12 of EP-A-471347 (in particular, II-2); and A-1 to A-48, columns 32 to 40 of U.S. Pat. No. 5,139,931 (in particular, A-39 and A-42);

Compounds for Reducing the Using Amounts of Color Intensifiers and Color Mixing Preventives:

I-1 to II-15, pages 5 to 24 of EP-A-411324 (in particular, I-46);

Formaldehyde Scavengers:

SCV-1 to SCV-28, pages 24 to 29 of EP-A-477932 (in particular, SCV-8);

Hardening Agents:

H-1, H-4, H-6, H-8 and H-14 on page 17 of JP-A-1-214845; the compounds represented by any of formulae (VII) to (XII), columns 13 to 23 of U.S. Pat. No. 4,618,573 (H-1 to H-54); the compounds represented by formula (6), right lower column, page 8 of JP-A-2-214852 (H-1 to H-76) (in particular, H-14); and the compounds disclosed in claim 1 of U.S. Pat. No. 3,325,287;

Development Inhibitor Precursors:

P-24, P-37 and P-39, pages 6 and 7 of JP-A-62-168139; and the compounds disclosed in claim 1 of U.S. Pat. No. 5,019,492 (in particular, compounds 28 and 29, column 7);

Fungicides and Biocides:

I-1 to III-43, columns 3 to 15 of U.S. Pat. No. 4,923,790 (in particular, II-1, II-9, II-10, II-18 and III-25);

Stabilizers and Antifoggants:

I-1 to (14), columns 6 to 16 of U.S. Pat. No. 4,923,793 (in particular, I-1, 60, (2) and (13)); and compounds 1 to 65, columns 25 to 32 of U.S. Pat. No. 4,952,483 (in particular, compound 36);

Chemical Sensitizers:

triphenylphosphine selenide; and compound 50 disclosed in JP-A-5-40324;

Dyes:

a-1 to b-20, pages 15 to 18 (in particular, a-1, a-12, a-18, a-27, a-35, a-36, and b-5), and V-1 to V-23, pages 27 to 29 (in particular, V-1) of JP-A-3-156450; F-I-1 to F-II-43, pages 33 to 55 of EP-A-445627 (in particular, F-I-11 and F-II-8); III-1 to III-36, pages 17 to 28 of EP-A-457153 (in particular, III-1 and III-3); crystallite dispersions of Dye-1 to Dye-124, pages 8 to 26 of WO 88/04794; compounds 1 to 22, pages 6 to 11 of EP-A-319999 (in particular, compound 1); compounds D-1 to D-87 represented by any of formulae (1) to (3), pages 3 to 28 of EP-A-519306; compounds 1 to 22 represented by formula (I), columns 3 to 10 of U.S. Pat. No. 4,268,622; and compounds (1) to (31) represented by formula (I), columns 2 to 9 of U.S. Pat. No. 4,923,788;

Ultraviolet Absorbing Agents:

compounds (18b) to (18r) represented by formula (1), 101 to 427, pages 6 to 9 of JP-A-46-3335; compounds (3) to (66) represented by formula (I), pages 10 to 44, and compounds HBT-1 to HBT-10 represented by formula (III), page 14, of EP-A-520938; and compounds (1) to (31) represented by formula (1), columns 2 to 9 of EP-A-521823.

The present invention can be applied to various color photographic materials such as color negative films for general and cinematographic uses, color reversal films for slide and television uses, color papers, color positive films and color reversal papers. The present invention can also preferably be applied to the film units equipped with lenses as disclosed in JP-B-2-32615 and JP-B-U-3-39784 (the term "JP-B-U" as used herein means an "examined Japanese utility model publication").

Suitable supports which can be used in the present invention are disclosed, for example, in *RD*, No. 17643, page 28, *RD*, No. 18716, from page 647, right column to page 648, left column, and *RD*, No. 307105, page 879.

The photographic material of the present invention has a total film thickness of all the hydrophilic colloid layers on the side where the silver halide emulsion layers are located of preferably 28 μm or less, more preferably 23 μm or less, still more preferably 18 μm or less, and most preferably 16 μm or less. Further, the film swelling rate $T_{1/2}$ is preferably 30 seconds or less, more preferably 20 seconds or less. $T_{1/2}$ is defined as the time to reach ½ of the saturated film thickness, taking 90% of the maximum swollen film thickness reached when being processed at 30° C. for 3 minutes and 15 seconds in a color developing solution as the saturated film thickness. The film thickness means the film thickness measured under conditions of 25° C., 55% relative humidity (stored for 2 days), and $T_{1/2}$ can be measured using a swellometer of the type described in A. Green, *Photogr. Sci. Eng.*, Vol. 19, No. 2, pages 124 to 129. $T_{1/2}$ can be adjusted by adding hardening agents to gelatin which is used as a binder, or by changing the aging conditions after coating. Further, a swelling factor of from 150% to 400% is preferred. The swelling factor can be calculated from the maximum swollen film thickness obtained under the conditions described above using the equation: (maximum swollen film thickness—film thickness)/film thickness.

The provision of hydrophilic colloid layers (known as backing layers) having a total dry film thickness of from 2 μm to 20 μm on the side of the support opposite to the side on which emulsion layers are provided is preferred in the photographic material of the present invention. The inclusion of the above described light absorbing agents, filter dyes, ultraviolet absorbing agents, antistatic agents, hardening agents, binders, plasticizers, lubricants, coating aids, and surfactants in the backing layers is preferred. The swelling factor of the backing layer is preferably from 150 to 500%.

A magnetic recording layer for use in the present invention is explained below.

A magnetic recording layer for use in the present invention is a layer coated on a support with an aqueous or organic solvent based coating solution comprising magnetic grains dispersed in a binder.

Examples of the magnetic grains for use in the present invention include ferromagnetic iron oxide such as $\gamma$-$Fe_2O_3$, Co-adhered $\gamma$-$Fe_2O_3$, Co-adhered magnetite, Co-containing magnetite, ferromagnetic chromium dioxide, ferromagnetic metal, ferromagnetic alloy, hexagonal system Ba ferrite, Sr ferrite, Pb ferrite, and Ca ferrite. Co-adhered ferromagnetic iron oxide such as Co-adhered $\gamma$-$Fe_2O_3$ is preferred. The shape of the grain may be any of acicular shape, a granular shape, a spherical shape, a cubic shape, or a plate-like shape. The specific surface area ($S_{BET}$) is preferably 20 $m^2/g$ or more, and particularly preferably 30 $m^2/g$ or more. The saturation magnetization ($\sigma_s$) of the ferromagnetic substance is preferably from $3.0\times10^4$ to $3.0\times10^5$ A/m and particularly preferably from $4.0\times10^4$ to $2.5\times10^5$ A/m. The ferromagnetic grains may be surface treated with silica and/or alumina and organic materials. Further, the surface of the magnetic grains may be treated with a silane coupling agent or a titanium coupling agent as disclosed in JP-A-6-161032. In addition, the magnetic grains the surfaces of which are covered with inorganic or organic substance as disclosed in JP-A-4-259911 and JP-A-5-81652 can also be used.

The binders which can be used for the magnetic grains includes the thermoplastic resins, thermosetting resins, radiation curable resins, reactive type resins, acid-, alkali- or biodegradable polymers, natural polymers (e.g., cellulose derivatives, sugar derivatives), and mixtures thereof disclosed in JP-A-4-219569. The above described resins have a Tg of from −40° C. to 300° C., and a weight average molecular weight of from 2,000 to 1,000,000. Examples of the binders include vinyl based copolymers, cellulose derivatives such as cellulose diacetate, cellulose triacetate, cellulose acetate propionate, cellulose acetate butyrate and cellulose tripropionate, acrylic resins, and polyvinyl acetal resins. Gelatin is also preferably used. Cellulose di(tri) acetate is particularly preferred. The binder can be subjected to curing treatment by adding epoxy based, aziridine based or isocyanate based crosslinking agent. Examples of the isocyanate based crosslinking agents include isocyanates such as tolylenediisocyanate, 4,4'-diphenylmethanediisocyanate, hexamethylenediisocyanate and xylenediisocyanate, reaction products of these isocyanates with polyalcohols (e.g., a reaction product of 3 mol of tolylenediisocyanate with 1 mol of trimethylolpropane), and polyisocyanate formed by condensation of these isocyanates, and they are disclosed in JP-A-6-59357.

The above magnetic substances are dispersed in a binder preferably using, as disclosed in JP-A-6-35092, a kneader, a pin type mill, and an annular type mill, and the combined use thereof is also preferred. The dispersants disclosed in JP-A-5-88283 or other known dispersants can be used. The thickness of a magnetic recording layer is from 0.1 μm to 10 μm, preferably from 0.2 μm to 5 μm, and more preferably from 0.3 μm to 3 μm. The weight ratio of the magnetic grains to the binder is preferably from 0.5/100 to 60/100, and more preferably from 1/100 to 30/100. The coating amount of the magnetic grains is from 0.005 to 3 $g/m^2$, preferably from 0.01 to 2 $g/m^2$, and more preferably from 0.02 to 0.5 $g/m^2$. Transmission yellow density of the magnetic recording layer is preferably from 0.01 to 0.50, more preferably from 0.03 to 0.20, and particularly preferably from 0.04 to 0.15. A magnetic recording layer can be provided on the back surface of the photographic support entirely or in stripe by coating or printing. Coating of a magnetic recording layer can be carried out by means of air doctor coating, blade coating, air knife coating, squeeze coating, impregnation coating, reverse-roll coating, transfer-roll coating, gravure coating, kiss coating, cast coating, spray coating, dip coating, bar coating, or extrusion coating, and the coating solution disclosed in JP-A-5-341436 is preferably used.

A magnetic recording layer may be provided with functions of lubrication improvement, curling adjustment, antistatic property, adhesion prevention and head abrasion, or another functional layer having these functions may be provided, and at least one kind or more of the grains are preferably abrasives of non-spherical inorganic grains having Mohs' hardness of 5 or more. The composition of the non-spherical inorganic grain is preferably oxide such as aluminum oxide, chromium oxide, silicon dioxide, titanium dioxide, etc., carbide such as silicon carbide and titanium carbide, and fine powders such as diamond. The surface of these abrasives may be treated with a silane coupling agent or a titanium coupling agent. These grains may be added to a magnetic recording layer, or may be overcoated on a magnetic recording layer (e.g., a protective layer, a lubricating layer). The above described binders can be used at this time, preferably the same binders as the binder of the magnetic recording layer are used. Photographic materials having magnetic recording layers are disclosed in U.S. Pat. Nos. 5,336,589, 5,250,404, 5,229,259, 5,215,874 and European Patent 466130.

The polyester support for use in the present invention is described below, but details including photographic materials described above, processing, cartridges and examples are disclosed in Kokai-Giho, Kogi No. 94-6023 (Hatsumei-Kyokai, Mar. 15, 1994). The polyester for use in the present invention comprises diol and aromatic dicarboxylic acid as essential components, and as aromatic dicarboxylic acids, 2,6-, 1,5-, 1,4- and 2,7-naphthalenedicarboxylic acid, terephthalic acid, isophthalic acid, and phthalic acid, and as diols, diethylene glycol, triethylene glycol, cyclohexanedimethanol, bisphenol A, and bisphenol can be enumerated. Polymerized polymers thereof include homopolymers such as polyethylene terephthalate, polyethylene naphthalate, polycyclohexanedimethanol terephthalate and the like. Particularly preferred is polyester comprising from 50 mol % to 100 mol % of 2,6-naphthalenedicarboxylic acid. Particularly preferred above all is polyethylene 2,6-naphthalate. The average molecular weight of them is about 5,000 to 200,000. Tg of the polyester for use in the present invention is 50° C. or more, and 90° C. or more is preferred.

The polyester support is heat treated at 40° C. or more and less than Tg, more preferably Tg minus 20° C. or more to less than Tg for the purpose of being reluctant to get curling habit. The heat treatment may be carried out at constant temperature within this range or may be carried out with cooling. The heat treatment time is from 0.1 hours to 1,500 hours, preferably from 0.5 hours to 200 hours. The heat treatment of the support may be carried out in a roll state or may be carried out in a web state while transporting. The surface of the support may be provided with concave and convex (e.g., coating conductive inorganic fine grains such as $SnO_2$ or $Sb_2O_5$) to improve the surface state. Also, it is preferred to make some designs such that the edge is knurled to slightly increase the height only of the edge, thereby preventing the difference in level due to the edge from imparting the evenness of support wound thereon. The heat treatment may be carried out at any stage of after formation of the support, after the surface treatment, after coating of a backing layer (an antistatic agent, a sliding agent, etc.), or after undercoating, but preferably conducted after coating of an antistatic agent.

An ultraviolet absorbing agent may be incorporated into the polyester support. Further, light piping can be prevented by including the commercially available dye or pigment for polyester such as Diaresin manufactured by Mitsubishi Kasei Corp. or Kayaset manufactured by Nippon Kayaku Co., Ltd.

To ensure adhesion of the support and the constitutional layers of the photographic material, the surface activation treatment is preferably carried out, such as a chemical treatment, a mechanical treatment, a corona discharge treatment, a flame treatment, an ultraviolet treatment, a high frequency treatment, a glow discharge treatment, an active plasma treatment, a laser treatment, a mixed acid treatment, and an ozone oxidation treatment, and preferred of them are an ultraviolet irradiation treatment, a flame treatment, a corona discharge treatment, and a glow discharge treatment.

An undercoating method is described below. An undercoat layer may be a single layer or may be two or more layers. The binder for an undercoat layer include copolymers with monomers selected from vinyl chloride, vinylidene chloride, butadiene, methacrylic acid, acrylic acid, itaconic acid and maleic anhydride being starting materials, as well as polyethyleneimine, an epoxy resin, grafted gelatin, nitrocellulose and gelatin. Compounds which swell the support include resorcin and p-chlorophenol. A gelatin hardening agent for an undercoat layer include chromium salt (chrome alum), aldehydes (formaldehyde, glutaraldehyde), isocyanates, active halide compounds (2,4-dichloro-6-hydroxy-s-triazine), epichlorohydrin resins, and active vinyl sulfone compounds. $SiO_2$, $TiO_2$, inorganic fine grains or polymethyl methacrylate copolymer fine grains (0.01 to 10 $\mu$m) may be contained as a matting agent.

Further, antistatic agents are preferably used in the present invention. Examples of such antistatic agents include high polymers containing carboxylic acid and carboxylate, sulfonate, cationic polymer, and ionic surfactant compounds.

The most preferred antistatic agents are fine grains of a crystalline metal oxide of at least one grain selected from ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω·cm or less, more preferably $10^5$ Ω·cm or less and having a grain size of from 0.001 to 1.0 $\mu$m or fine grains of composite oxides of them (Sb, P, B, In, S, Si, C), further, fine grains of a metal oxide in the form of sol or fine grains of these composite oxides. The addition amount to the photographic material is preferably from 5 to 500 mg/m$^2$ and particularly preferably from 10 to 350 mg/m$^2$. The ratio of the conductive crystalline oxides or composite oxides thereof to the binder is preferably from 1/300 to 100/1 and more preferably from 1/100 to 100/5.

It is preferred for the photographic material of the present invention to have a sliding property. The sliding agent-containing layer is preferably provided on both of light-sensitive layer surface and backing layer surface. Preferred sliding property is a dynamic friction coefficient of from 0.01 to 0.25. Measurement at this time is conducted using a stainless steel ball having a diameter of 5 mm at a transporting speed of 60 cm/min (25° C., 60% RH). In this evaluation, when the opposite material is replaced with the light-sensitive layer surface, almost the same level of value can be obtained.

Examples of the sliding agent which can be used in the present invention include polyorganosiloxane, higher fatty acid amide, higher fatty acid metal salt, higher fatty acid and higher alcohol ester. As polyorganosiloxane, polydimethylsiloxane, polydiethylsiloxane, polystyrylmethylsiloxane, and polymethylphenylsiloxane can be used. The addition layer is preferably the outermost layer of the emulsion layer or a backing layer. In particular, polydimethylsiloxane or esters having a long chain alkyl group are preferred.

The photographic material of the present invention preferably contains a matting agent. The matting agent may be added to either of the emulsion layer side or the backing layer side but it is particularly preferably to be added to the outermost layer of the emulsion layer. The matting agent may be either soluble or insoluble in the processing solution, preferably both types are used in combination. For example, polymethyl methacrylate, poly(methyl methacrylate/methacrylic acid=9/1 or 5/5 (mol ratio)), and polystyrene grains are preferably used. The average grain size is preferably from 0.8 to 10 μm, and grain size distribution is preferably narrow, preferably 90% or more of the entire grain number accounts for 0.9 to 1.1 times of the average grain size. For increasing the matting property, fine grains having a grain size of 0.8 μm or less are preferably added at the same time. For example, polymethyl methacrylate (0.2 μm), poly(methyl methacrylate/methacrylic acid=9/1 (mol ratio), 0.3 μm), polystyrene grains (0.25 μm), and colloidal silica (0.03 μm) are enumerated.

The film patrone preferably used in the present invention is described below. The main material of the patrone for use in the present invention may be metal or synthetic plastics.

Preferred plastic materials are polystyrene, polyethylene, polypropylene, polyphenyl ether, etc. Further, the patrone for use in the present invention may contain various antistatic agents, and carbon black, metal oxide grains, nonionic, anionic, cationic and betaine based surfactants or polymers can be preferably used. Such a patrone static prevented is disclosed in JP-A-1-312537 and JP-A-1-312538. In particular, those having the resistivity of $10^{12}$ Ω or less at 25° C., 25% RH are preferred. Usually, plastic patrone is produced using plastics including carbon black or a pigment to impart light shielding. The size of the patrone may be 135 size of the present as it is, or for miniaturizing a camera, it is effective that the diameter of the cartridge of 25 mm of the present 135 size may be decreased to 22 mm or less. The capacity of the case of the patrone is 30 $cm^3$ or less and preferably 25 $cm^3$ or less. The weight of the plastics used for the patrone and patrone case is preferably from 5 g to 15 g.

Further, the patrone may be a type of sending out the film by revolving a spool. Further, it may be the structure such that the tip of the film is encased in the body of the patrone and the tip of the film is sent to outside through the port of the patrone by revolving the axle of the spool in the feeding direction of the film. These are disclosed in U.S. Pat. Nos. 4,834,306 and 5,226,613. The photographic film for use in the present invention may be a so-called raw film before development or may be a photographic film development processed. Further, a raw film and a processed film may be contained in the same new patrone, or may be stored in different patrones.

The present invention will be illustrated in more detail with reference to examples below, but these are not to be construed as limiting the invention.

EXAMPLE 1

1) Support

The support which was used in the present invention was prepared as follows.

100 weight parts of polyethylene-2,6-naphthalate polymer and 2 weight parts of Tinuvin P. 326 (product of Ciba Geigy), as an ultraviolet absorbing agent, were dried, then melted at 300° C., subsequently, extruded through a T-type die, and stretched 3.3 times in a machine direction at 140° C. and then 3.3 times in a transverse direction at 130° C., and further thermal fixed for 6 seconds at 250° C. and the PEN film having the thickness of 90 μm was obtained. Appropriate amounts of blue dyes, magenta dyes and yellow dyes were added to this PEN film (I-1, I-4, I-6, I-24, I-26, I-27 and II-5 disclosed in Kokai-Giho, Kogi No. 94-6023). Further, the film was wound on to a stainless steel spool having a diameter of 20 cm and provided heat history at 110° C. for 48 hours to obtain a support reluctant to get curling habit.

2) Coating of Undercoat Layer

After both surfaces of the above support were subjected to corona discharge, UV discharge and glow discharge treatments, on one side of the support an undercoat solution having the following composition was coated (10 cc/$m^2$, using a bar coater): 0.1 g/$m^2$ of gelatin, 0.01 g/$m^2$ of sodium α-sulfo-di-2-ethylhexylsuccinate, 0.04 g/$m^2$ of salicylic acid, 0.2 g/$m^2$ of p-chlorophenol, 0.012 g/$m^2$ of $(CH_2{=}CHSO_2CH_2CH_2NHCO)_2CH_2$, and 0.02 g/$m^2$ of polyamideepichlorohydrin polycondensation product. The undercoat layer was provided on the hotter side at the time of stretching. Drying was conducted at 115° C. for 6 minutes (the temperature of the roller and transporting device of the drying zone was 115° C.).

3) Coating of Backing Layer

On one side of the above support after undercoat layer coating, an antistatic layer, a magnetic recording layer and a sliding layer having the following compositions were coated as backing layers.

3-1) Coating of Antistatic Layer 0.2 g/$m^2$ of a dispersion of fine grain powder of a stannic oxide-antimony oxide composite having the average grain size of 0.005 μm and specific resistance of 5 Ω·cm (the grain size of the second agglomerate: about 0.08 μm), 0.05 g/$m^2$ of gelatin, 0.02 g/$m^2$ of $(CH_2{=}CHSO_2CH_2CH_2NHCO)_2CH_2$, 0.005 g/$m^2$ of polyoxyethylene-p-nonylphenol (polymerization degree: 10) and 0.22 g/$m^2$ of resorcin were coated.

3-2) Coating of Magnetic Recording Layer 0.06 g/$m^2$ of cobalt-γ-iron oxide which was coating-treated with 3-polyoxyethylene-propyloxytrimethoxysilane (polymerization degree: 15) (15 wt %) (specific surface area: 43 $m^2$/g, major axis: 0.14 μm, minor axis: 0.03 μm, saturation magnetization: 89 emu/g, $Fe^{+2}/Fe^{+3}$ is 6/94, the surface was treated with 2 wt %, respectively, based on the iron oxide, of aluminum oxide and silicon oxide), 1.1 g/$m^2$ of diacetyl cellulose (dispersion of the iron oxide was carried out using an open kneader and a sand mill) and 75 mg/$m^2$ of $C_2H_5C[CH_2OCONH{-}C_6H_3(CH_3)NCO]_3$ as a curing agent, with acetone, methyl ethyl ketone, cyclohexanone and dibutyl phthalate as solvents, were coated with a bar coater to obtain a magnetic recording layer having the film thickness of 1.2 μm. As a sliding agent, 15 mg/$m^2$ of $C_6H_{13}CH(OH)C_{10}OH_{20}COOC_{40}H_{81}$, as matting agents, 50 mg/$m^2$ of silica grains (1.0 μm) and 10 mg/$m^2$ of an aluminum oxide abrasive (0.20 μm and 1.0 μm) coating-treated with 3-polyoxyethylene-propyloxytrimethoxysilane (polymerization degree: 15) (15 wt %) were added. Drying was conducted at 115° C. for 6 minutes (the temperature of the roller and transporting device of the drying zone was 115° C.). The increase of the color density of $D^B$ of the magnetic recording layer by X-light (a blue filter) was about 0.1, and saturation magnetization moment of the magnetic recording layer was 4.2 emu/g, coercive force was $7.3\times10^4$ A/m, and rectangular ratio was 65%.

3-3) Preparation of Sliding Layer

A mixture of diacetyl cellulose (25 mg/$m^2$), $C_6H_{13}CH(OH)C_{10}H_{20}COOC_{40}H_{81}$ (6 mg/$m^2$) and polydimethylsiloxane (molecular weight: 3,000) (1.5 mg/$m^2$) was coated. This mixture was dissolved in xylene/propylene glycol monomethyl ether (1/1) by heating at 105° C., and the solution was poured into propylene glycol monomethyl ether (10 time amount) at room temperature and dispersed, and the dispersion was further dispersed in acetone (average grain size:

0.01 μm) and then added to the coating solution. Drying was conducted at 115° C. for 6 minutes (the temperature of the roller and transporting device of the drying zone was 115° C.). The thus-obtained sliding layer showed excellent characteristics of dynamic friction coefficient of 0.06 (a stainless steel hard ball of 5 mmϕ, load: 100 g, speed: 6 cm/min), static friction coefficient of 0.08 (a clip method), and dynamic friction coefficient of 0.20 between the surface of the emulsion described below and the sliding layer.

4) Coating of Light-Sensitive Layer

Next, each layer having the following composition was multilayer coated on the opposite side of the above obtained backing layer and a color negative film was prepared as Sample No. 101.

Composition of Light-Sensitive Layer

The main components for use in each layer are classified as follows:

ExC: Cyan Coupler

ExM: Magenta Coupler

ExY: Yellow Coupler

ExS: Sensitizing Dye

UV: Ultraviolet Absorber

HBS: High Boiling Point Organic Solvent

H: Hardening Agent for Gelatin

The numeral corresponding to each component indicates the coated weight in unit of g/m$^2$, and the coated weight of silver halide is shown as the calculated weight of silver. Further, in the case of a sensitizing dye, the coated weight is indicated in unit of mol per mol of silver halide in the same layer.

First Layer: Antihalation Layer

| | |
|---|---|
| Black Colloidal Silver | 0.09 as silver |
| Gelatin | 1.60 |
| ExM-1 | 0.12 |
| ExF-1 | $2.0 \times 10^{-3}$ |
| Solid Dispersion Dye ExF-2 | 0.030 |
| Solid Dispersion Dye ExF-3 | 0.040 |
| HBS-1 | 0.15 |
| HBS-2 | 0.02 |

Second Layer: Interlayer

| | |
|---|---|
| Silver Iodobromide Emulsion M | 0.065 as silver |
| ExC-2 | 0.04 |
| Polyethyl Acrylate Latex | 0.20 |
| Gelatin | 1.04 |

Third Layer: Low Sensitivity Red-Sensitive Emulsion Layer

| | |
|---|---|
| Silver Iodobromide Emulsion A | 0.25 as silver |
| Silver Iodobromide Emulsion B | 0.25 as silver |
| EXS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExY-5 | 0.010 |
| Cpd-2 | 0.025 |
| HBS-1 | 0.10 |
| Gelatin | 0.87 |

Fourth Layer: Middle Sensitivity Red-Sensitive Emulsion Layer

| | |
|---|---|
| Silver Iodobromide Emulsion B | 0.35 as silver |
| Silver Iodobromide Emulsion C | 0.35 as silver |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.72 |

Fifth Layer: High Sensitivity Red-Sensitive Emulsion Layer

| | |
|---|---|
| Silver Iodobromide Emulsion D | 1.40 as silver |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExY-5 | 0.020 |
| ExC-7 | 0.010 |
| Cpd-2 | 0.050 |
| HBS-1 | 0.22 |
| HBS-2 | 0.050 |
| Gelatin | 1.00 |

Sixth Layer: Interlayer

| | |
|---|---|
| Cpd-1 | 0.090 |
| Solid Dispersion Dye ExF-4 | 0.030 |
| HBS-1 | 0.050 |
| Polyethyl Acrylate Latex | 0.15 |
| Gelatin | 1.10 |

Seventh Layer: Low Sensitivity Green-Sensitive Emulsion Layer

| | |
|---|---|
| Silver Iodobromide Emulsion E | 0.15 as silver |
| Silver Iodobromide Emulsion F | 0.10 as silver |
| Silver Iodobromide Emulsion G | 0.10 as silver |
| ExS-4 | $3.0 \times 10^{-5}$ |
| ExS-5 | $2.1 \times 10^{-4}$ |
| ExS-6 | $8.0 \times 10^{-5}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |

Eighth Layer: Middle Sensitivity Green-Sensitive Emulsion Layer

| | |
|---|---|
| Silver Iodobromide Emulsion H | 0.80 as silver |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |

-continued

| | |
|---|---|
| HBS-1 | 0.13 |
| HBS-3 | $4.0 \times 10^{-3}$ |
| Gelatin | 0.80 |

Ninth Layer: High Sensitivity Green-Sensitive Emulsion Layer

| | |
|---|---|
| Silver Iodobromide Emulsion I | 1.25 as silver |
| ExS-4 | $3.7 \times 10^{-5}$ |
| ExS-5 | $8.1 \times 10^{-5}$ |
| ExS-6 | $3.2 \times 10^{-5}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethyl Acrylate Latex | 0.15 |
| Gelatin | 1.30 |

Tenth Layer: Yellow Filter Layer

| | |
|---|---|
| Yellow Colloidal Silver | 0.015 as silver |
| Cpd-1 | 0.16 |
| Solid Dispersion Dye ExF-5 | 0.060 |
| Solid Dispersion Dye ExF-6 | 0.060 |
| Oil-Soluble Dye ExF-7 | 0.010 |
| HBS-1 | 0.60 |
| Gelatin | 0.60 |

Eleventh Layer: Low Sensitivity Blue-Sensitive Emulsion Layer

| | |
|---|---|
| Silver Iodobromide Emulsion J | 0.09 as silver |
| Silver Iodobromide Emulsion K | 0.09 as silver |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |

-continued

| | |
|---|---|
| HBS-1 | 0.28 |
| Gelatin | 1.10 |

Twelfth Layer: High Sensitivity Blue-Sensitive Emulsion Layer

| | |
|---|---|
| Silver Iodobromide Emulsion L | 1.00 as silver |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.65 |

Thirteenth Layer: First Protective Layer

| | |
|---|---|
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.7 |

Fourteenth Layer: Second Protective Layer

| | |
|---|---|
| Silver Iodobromide Emulsion M | 0.10 as silver |
| H-1 | 0.40 |
| B-1 (diameter: 1.7 $\mu$m) | $5.0 \times 10^{-2}$ |
| B-2 (diameter: 1.7 $\mu$m) | 0.15 |
| B-3 | 0.05 |
| S-1 | 0.20 |
| Gelatin | 0.70 |

Further, W-1 to W-3, B-4 to B-6, F-1 to F-17, iron salt, lead salt, gold salt, platinum salt, palladium salt, iridium salt and rhodium salt were appropriately included in each layer to improve storage stability, processing properties, pressure resistance, fungicidal and biocidal properties, antistatic properties and coating properties.

TABLE 3

| Emulsion | Average AgI Content (%) | Variation Coefficient of the AgI Content among Grains (%) | Average Diameter Corresponding to Sphere ($\mu$m) | Variation Coefficient of the Grain Size (%) | Projected Area Diameter Corresponding to Circle ($\mu$m) | Diameter/ Thickness Ratio |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 5.4 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 9.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |

TABLE 3-continued

| Emulsion | Average AgI Content (%) | Variation Coefficient of the AgI Content among Grains (%) | Average Diameter Corresponding to Sphere (μm) | Variation Coefficient of the Grain Size (%) | Projected Area Diameter Corresponding to Circle (μm) | Diameter/ Thickness Ratio |
|---|---|---|---|---|---|---|
| L | 14.0 | 25 | 1.28 | 26 | 1.46 | 3.5 |
| M | 1.0 | — | 0.07 | 15 | — | 1 |

In Table 3:
(1) Emulsions J, K and L were reduction sensitized during preparation of the grains using thiourea dioxide and thiosulfonic acid according to the examples of JP-A-2-191938 (corresponding to U.S. Pat. 5,061,614).
(2) Emulsions A to I were gold, sulfur, and selenium sensitized, respectively, in the presence of the spectral sensitizing dyes which are described at each light-sensitive layer and sodium thiocyanate according to the examples of JP-A-3-237450 (corresponding to EP-A-443453).
(3) Low molecular weight gelatin was used in the preparation of the tabular grains according to the examples of JP-A-1-158426.
(4) In tabular grains, there were observed such dislocation lines as disclosed in JP-A-3-237450 (corresponding to EP-A-443453), using a high pressure electron microscope.
(5) Emulsion L comprised double structure grains containing an internal high iodide core as disclosed in JP-A-60-143331.

Preparation of Dispersion of Organic Solid Dispersion Dye

ExF-3 shown below was dispersed according to the following method. That is, water and 200 g of Pluronic F88 (ethylene oxide/propylene oxide block copolymer) manufactured by BASF Co. were added to 1,430 g of a wet cake of the dye containing 30% of methanol, and stirred to obtain a slurry having 6% dye concentration. Next, 1,700 ml of zirconia beads having an average diameter of 0.5 mm were filled in an ultravisco mill (UVM-2) manufactured by Imex Co., the slurry was passed and the content was pulverized at a peripheral speed of about 10 m/sec and discharge amount of 0.5 l/min for 8 hours. Beads were removed by filtration, water was added to dilute the dispersion to dye concentration of 3%, then heated at 90° C. for 10 hours for stabilization. The average grain size of the obtained fine grains of the dye was 0.60 μm and the extent of distribution of grain sizes (standard deviation of grain sizes×100/average grain size) was 18%.

Solid dispersions of ExF-4, ExF-5 and ExF-6 were obtained in the same manner. The average grain sizes of fine grains of the dyes were 0.45 μm, 0.54 μm and 0.52 μm, respectively. ExF-2 was dispersed according to the microprecipitation dispersion method by pH shift disclosed in the example of JP-A-3-182743. The average grain size of fine grains of the dye was 0.05 μm.

ExC-1

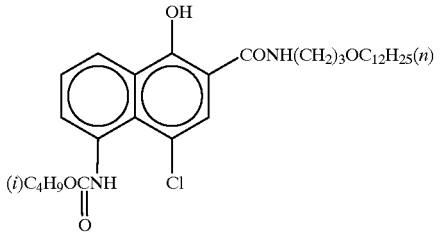

ExC-2

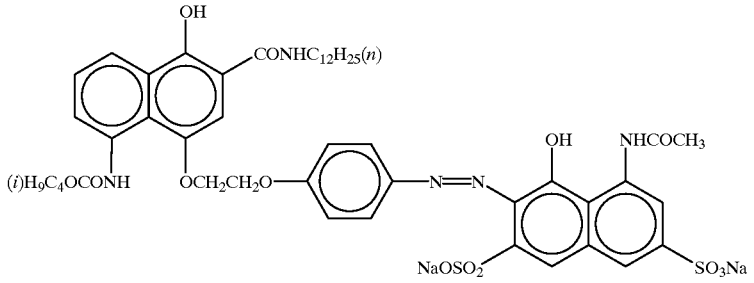

-continued
ExC-3
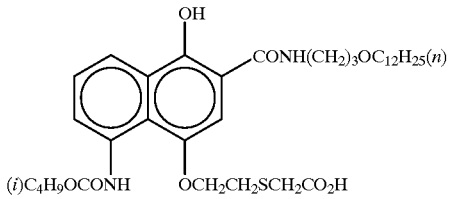
ExC-4
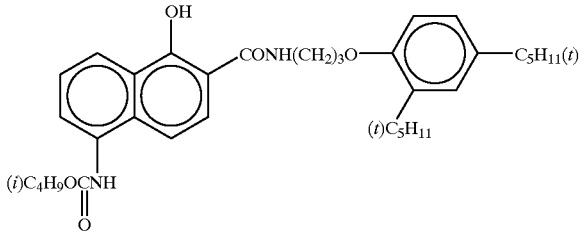
ExC-5
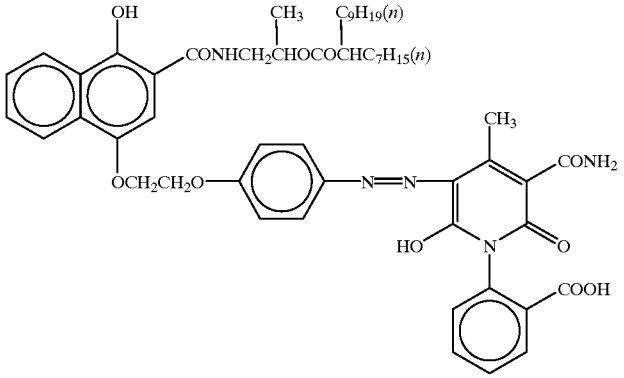
ExC-6
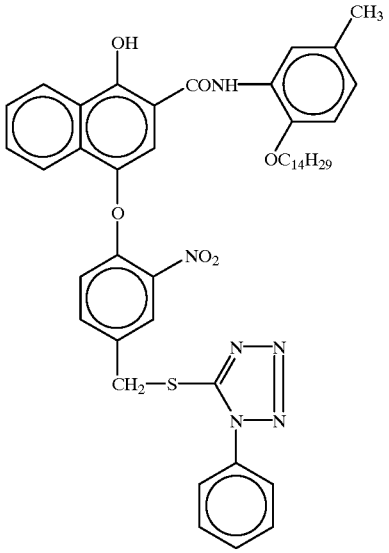
ExC-7
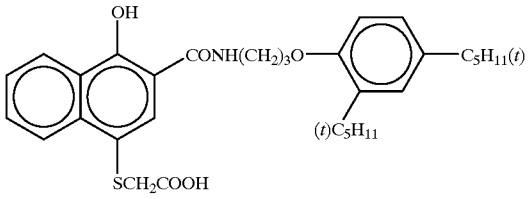

-continued
ExC-8
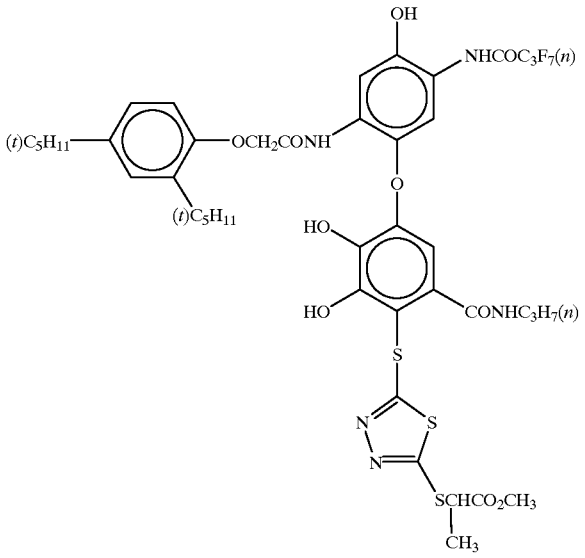
ExM-1
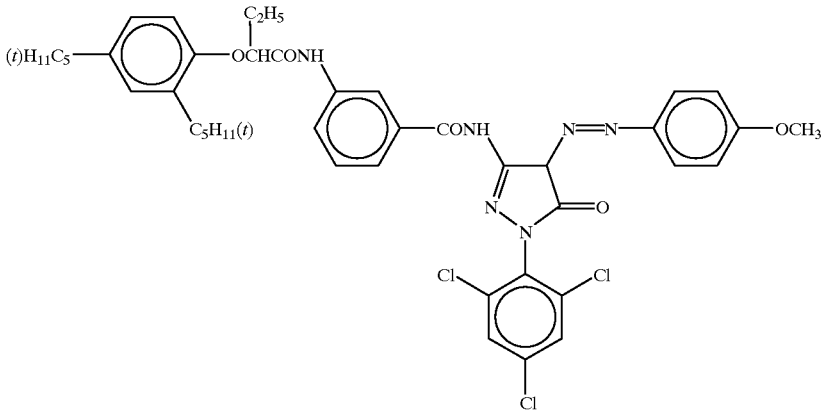
ExM-2
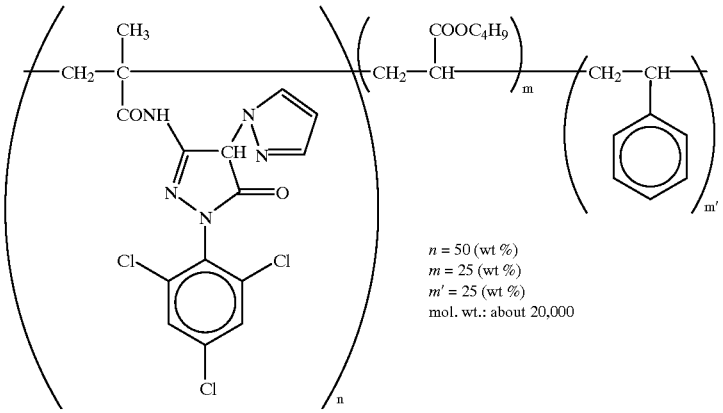

-continued
ExM-3
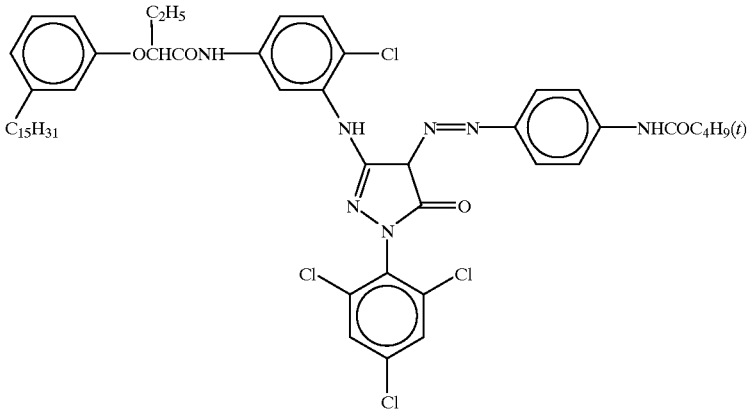
ExM-4
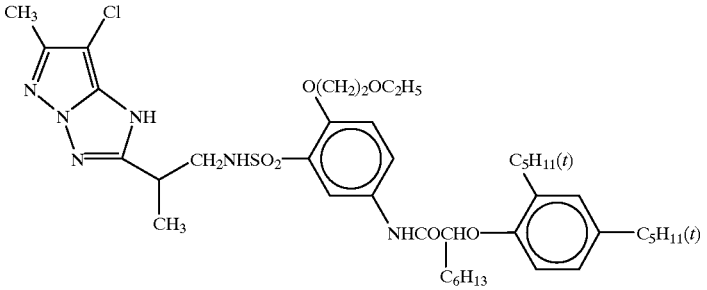
ExM-5
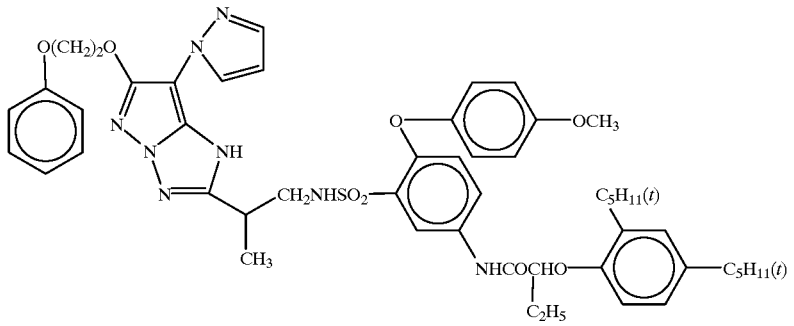
ExY-1
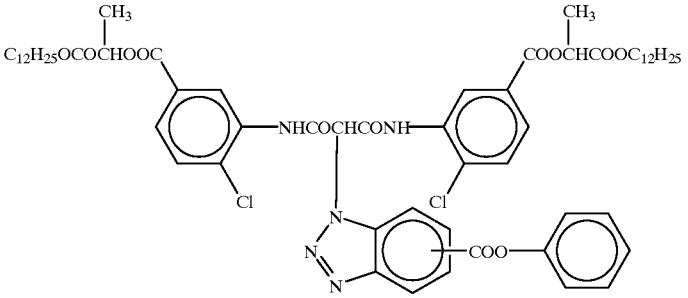

-continued
ExY-2
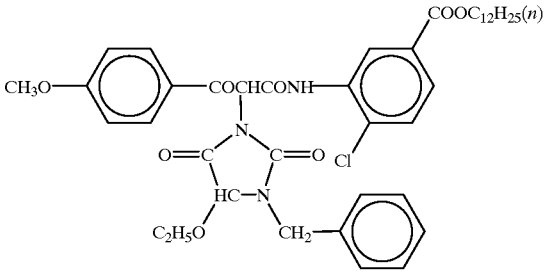
ExY-3
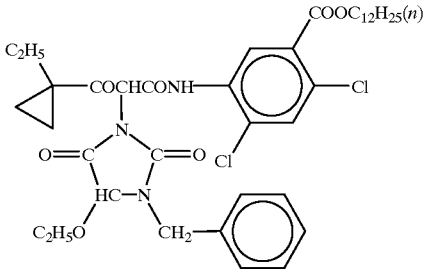
ExY-4
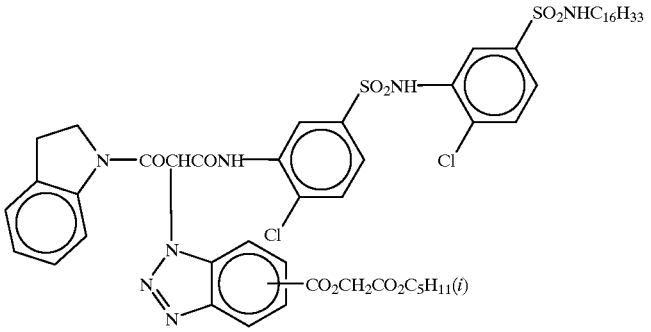
ExY-5
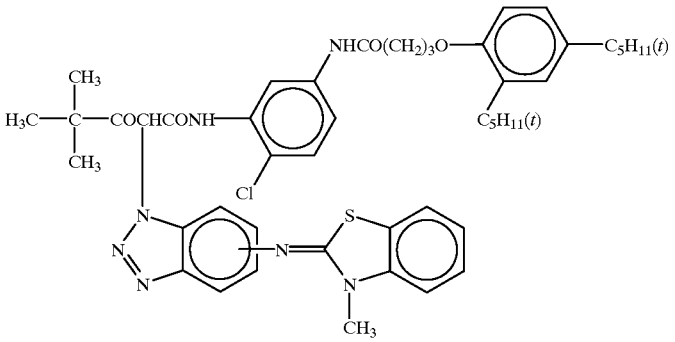
ExF-1
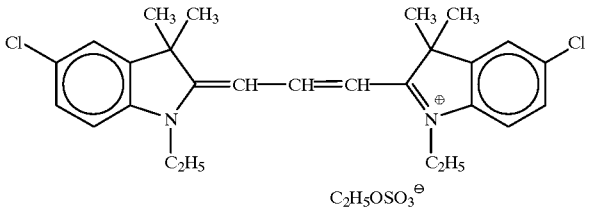

-continued
ExF-2
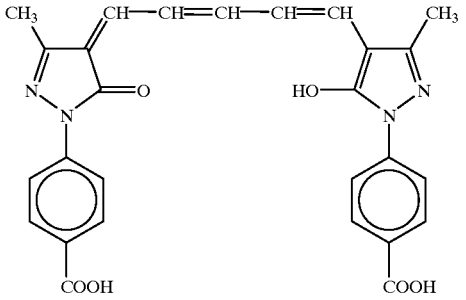
ExF-3
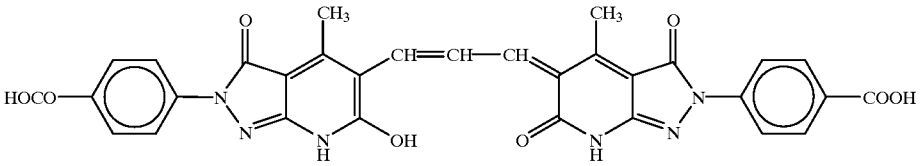
ExF-4
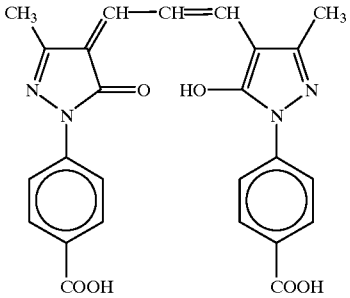
ExF-5
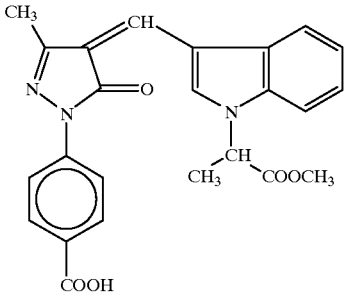
ExF-6
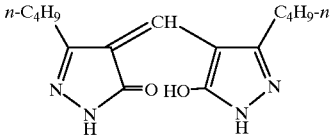
ExF-7
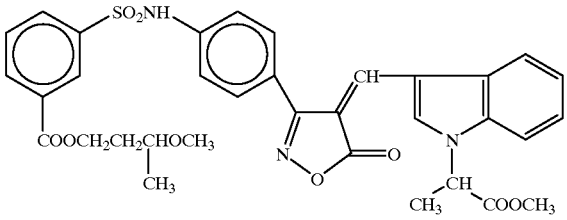

-continued
Cpd-1
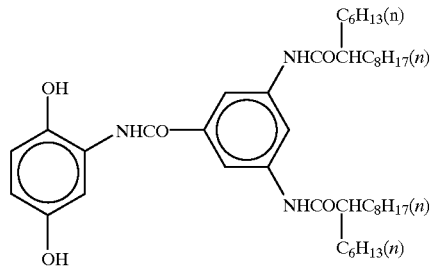
Cpd-2
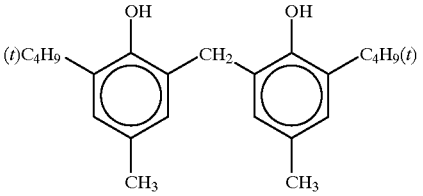
Cpd-3
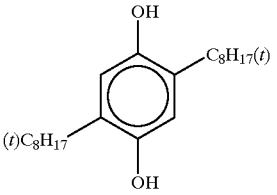
UV-1
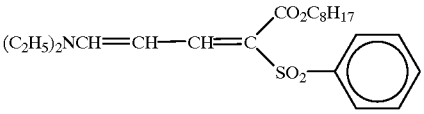
UV-2
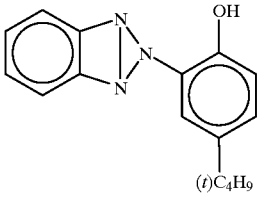
UV-3
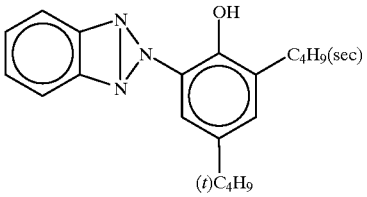
HBS-1
Tricresyl Phosphate
HBS-2
Di-n-butyl Phthalate
HBS-3
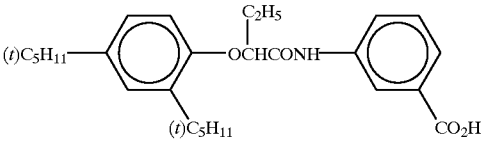
HBS-4
Tri(2-ethylhexyl) Phosphate -continued
ExS-1
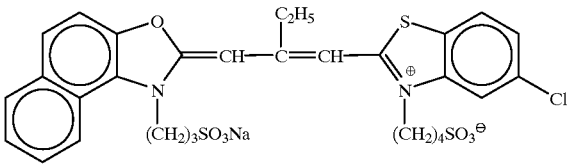
ExS-2
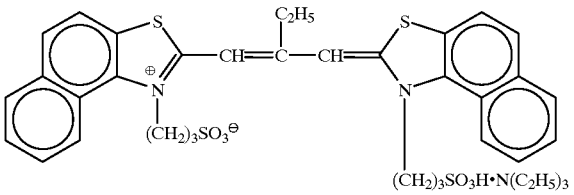
ExS-3
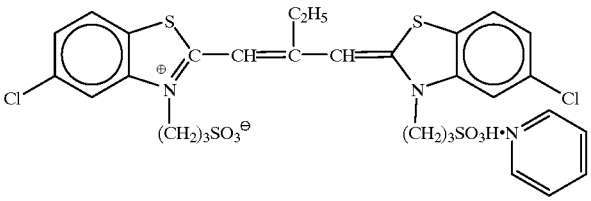
ExS-4
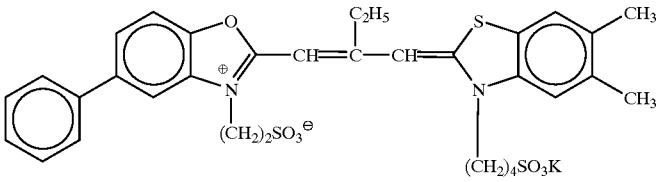
ExS-5
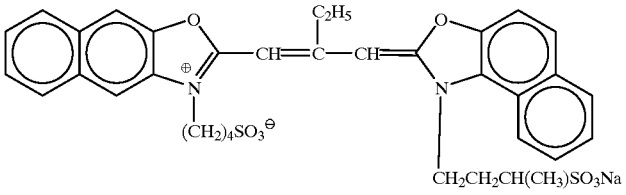
ExS-6
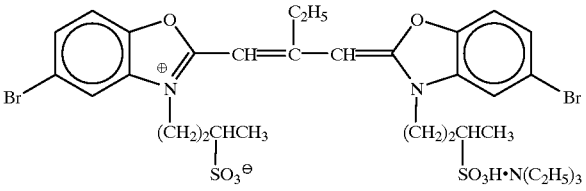
ExS-7
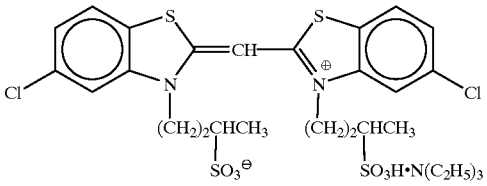
S-1
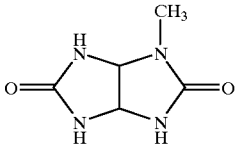

-continued
H-1
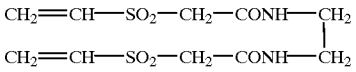
B-1
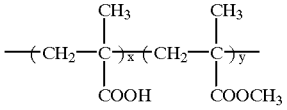
$x/y$ = 10/90 (weight ratio)
average molecular weight:
about 35,000
B-2
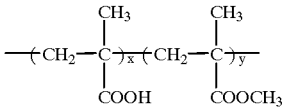
$x/y$ = 40/60 (weight ratio)
average molecular weight:
about 20,000
B-3
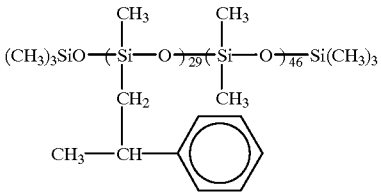
(mol ratio)
average molecular weight:
about 8,000
B-4
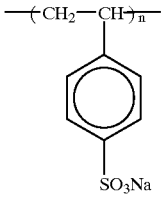
average molecular weight:
about 750,000
B-5
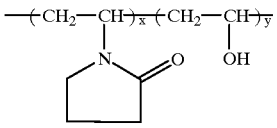
$x/y$ = 70/30 (weight ratio)
average molecular weight:
about 17,000
B-6
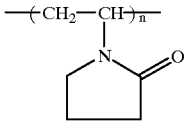
average molecular weight:
about 10,000
W-1
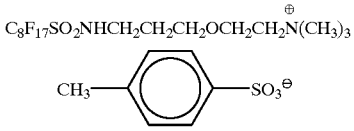
W-2
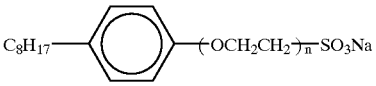
$n$ = 2 ~ 4
W-3
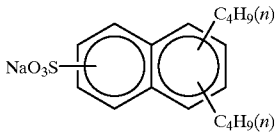
F-1
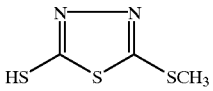

-continued
F-2
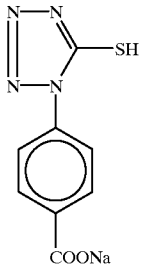
F-3
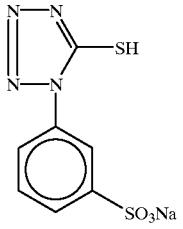
F-4
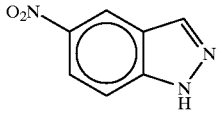
F-5
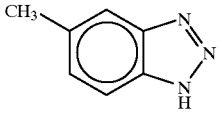
F-6
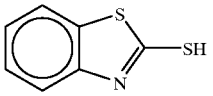
F-7
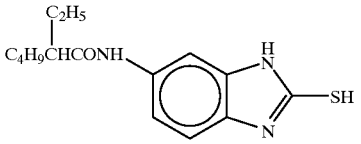
F-8
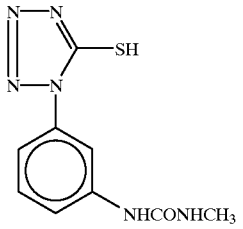
F-9
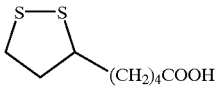
F-10
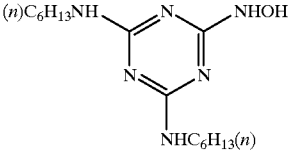

-continued

F-11

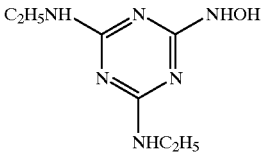

F-12

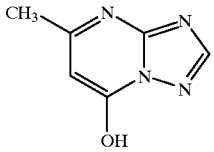

F-13

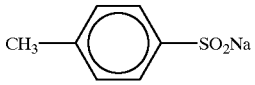

F-14

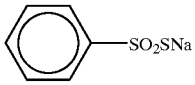

F-15

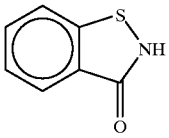

F-16

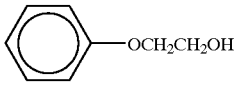

F-17

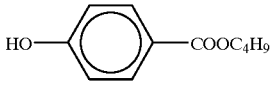

The thus prepared photographic material was cut to a size of 24 mm in width and 160 cm in length, and two perforations of 2 mm square at an interval of 5.8 mm were provided 0.7 mm inside from one side width direction in the length direction of the photographic material. The sample provided with this set of two perforations at intervals of 32 mm was prepared and encased in the plastic film cartridge explained in FIG. 1 to FIG. 7 in U.S. Pat. No. 5,296,887.

FM signals were recorded between the above perforations of the sample from the side of the magnetic recording layer coated on the support using a head capable of in and out of 2,000 turns with head gap of 5 $\mu$m at a feed rate of 1,000 mm/s.

Sample Nos. 102 to 113 were prepared by replacing DIR coupler ExC-6 contained in the third, fourth and fifth layers of Sample No. 101 with comparative coupler Ex-1 shown below (DIR coupler disclosed in JP-B-5-84891) and the DIR couplers for use in the present invention as shown in Table 4. The addition amount of each DIR coupler was adjusted such that the gradation of the red-sensitive layer, when exposed to white light and processed by development processing I, coincided with that of Sample No. 101.

Ex-1 (DIR coupler D-4 disclosed in JP-B-5-84891)

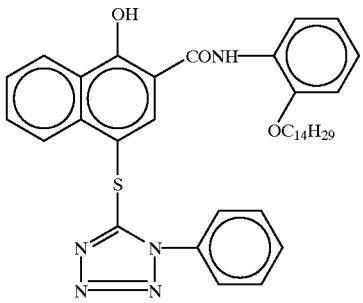

Each of these samples were wedgewise exposed to white light and processed by the above-described development processing I-1 and II-1. Each of the obtained processed samples was measured for absorption densities of cyan, magenta and yellow to obtain the characteristic curve. From the characteristic curve obtained, gradients of the cyan, magenta and yellow of the samples subjected to development processing I-1 were found out and designated $\gamma_I$(C), $\gamma_I$(M) and $\gamma_I$(Y), respectively, and those of the samples subjected to development processing II-1 were also found out similarly and designated $\gamma_{II}$(C), $\gamma_{II}$(M) and $\gamma_{II}$(Y), respectively. The ratios of the gradients of cyan, magenta and yellow between development processing I-1 and development processing II-1 were calculated.

The results obtained are shown in Table 4.

Next, evaluation of the color turbidity of magenta to cyan density was conducted in the following procedure using the same samples.

(1) Each sample was subjected to double exposure as follows.

First exposure: imagewise exposure by red light

Second exposure: each sample was further subjected to uniform exposure to green light in the exposure amount which gives magenta density of 1.7 at unexposed part of the red light of Sample No. 101

(2) Each sample was processed by development processing I-1 and II-1.

(3) With respect to each sample processed, the value subtracted the magenta density at cyan fog part from the magenta density at the point giving cyan density of 1.8 was found out, and this value was taken as color turbidity.

The smaller the value, the smaller is the color turbidity and the higher is the color reproducibility of the photographic material.

With respect to sharpness, development processing I and II were conducted using the above samples and MTF value of 15 cycle/mm of magenta image measured by MTF method (Modulation Transfer Function) was obtained. The results obtained are indicated as relative values taking the value of Sample No. 101 of development processing I as 100.

The test results of color turbidity and sharpness are shown in Table 5.

From the results in Tables 4 and 5, it can be seen that the photographic materials having less gradient fluctuation in rapid processing and less degradation of color reproducibility and sharpness can be designed using the DIR couplers which release diffusible development inhibitors for use in the present invention.

TABLE 4

| Sample No. | DIR Coupler in 3rd and 4th Layers | DIR Coupler in 5th Layer | Ratio of Gradient of Yellow $\gamma_{II}(Y)/\gamma_{I}(Y)$ | Ratio of Gradient of Magenta $\gamma_{II}(M)/\gamma_{I}(M)$ | Ratio of Gradient of Cyan $\gamma_{II}(C)/\gamma_{I}(C)$ | Remarks |
|---|---|---|---|---|---|---|
| 101 | ExC-6 | ExC-6 | 0.98 | 1.01 | 0.66 | Comparison |
| 102 | Ex-1 | ExC-6 | 0.97 | 1.02 | 0.66 | Comparison |
| 103 | Ex-1 | Ex-1 | 0.97 | 1.01 | 0.65 | Comparison |
| 104 | (2) | ExC-6 | 1.01 | 1.01 | 0.99 | Invention |
| 105 | (3) | ExC-6 | 1.01 | 1.00 | 0.91 | Invention |
| 106 | (4) | ExC-6 | 1.00 | 1.02 | 0.98 | Invention |
| 107 | (7) | ExC-6 | 1.00 | 1.02 | 0.85 | Invention |
| 108 | (11) | ExC-6 | 1.01 | 1.02 | 0.99 | Invention |
| 109 | (31) | ExC-6 | 1.02 | 1.02 | 0.99 | Invention |
| 110 | (34) | ExC-6 | 1.01 | 1.01 | 0.98 | Invention |
| 111 | (2) | (2) | 1.02 | 1.02 | 1.02 | Invention |
| 112 | (3) | (3) | 1.03 | 1.02 | 0.98 | Invention |
| 113 | (4) | (4) | 1.02 | 1.01 | 1.02 | Invention |

TABLE 5

| Sample No. | Color Turbidity (processing I-1) | Color Turbidity (processing II-1) | Sharpness (processing I-1) | Sharpness (processing II-1) | Remarks |
|---|---|---|---|---|---|
| 101 | −0.32 | −0.28 | 100 | 90 | Comparison |
| 102 | −0.27 | −0.22 | 98 | 86 | Comparison |
| 103 | −0.25 | −0.18 | 95 | 83 | Comparison |
| 104 | −0.33 | −0.35 | 100 | 98 | Invention |
| 105 | −0.35 | −0.36 | 99 | 96 | Invention |
| 106 | −0.33 | −0.36 | 101 | 99 | Invention |
| 107 | −0.35 | −0.35 | 100 | 98 | Invention |
| 108 | −0.32 | −0.33 | 99 | 98 | Invention |
| 109 | −0.33 | −0.36 | 100 | 99 | Invention |
| 110 | −0.32 | −0.37 | 100 | 98 | Invention |
| 111 | −0.35 | −0.43 | 102 | 101 | Invention |
| 112 | −0.35 | −0.43 | 102 | 100 | Invention |
| 113 | −0.36 | −0.45 | 102 | 101 | Invention |

EXAMPLE 2

Sample Nos. 101 and 113 prepared in Example 1 were processed by development processing I-1 and development processing wherein the silver halide solvent B-3 in development processing II-1 was replaced with each of the compounds shown in Table 6 in equimolar amounts (development processing II-2 to II-13) and evaluation of each sample was conducted in the same manner as in Example 1. Further, with respect to color turbidity and sharpness, only the results in development processing II are shown. The results of sharpness was expressed in relative values taking the result of Sample No. 101 processed by development processing II-1 was taken as 100.

The results obtained are shown in Tables 7 and 8.

TABLE 6

| Test No. | Sample No. | Development Processing I | Development Processing II No. | Silver Halide Solvent | Remarks |
|---|---|---|---|---|---|
| T201 | 101 | I-1 | II-1 | B-3 | Comparison |
| T202 | " | " | II-2 | Not added*1 | Comparison |
| T203 | " | " | II-3 | Sodium sulfite | Comparison |
| T204 | " | " | II-4 | Sodium thiosulfate | Comparison |
| T205 | " | " | II-5 | Sodium methanethiosulfonate | Comparison |
| T206 | " | " | II-6 | Sodium thiocyanate | Comparison |
| T207 | " | " | II-7 | A-1 | Comparison |
| T208 | " | " | II-8 | A-9 | Comparison |
| T209 | " | " | II-9 | B-8 | Comparison |
| T210 | " | " | II-10 | B-12 | Comparison |
| T211 | " | " | II-11 | C-1 | Comparison |
| T212 | " | " | II-12 | D-3 | Comparison |
| T213 | " | " | II-13 | E-16 | Comparison |
| T214 | 113 | " | II-1 | B-3 | Invention |
| T215 | 113 | I-1 | II-2 | Not added*1 | Comparison |
| T216 | " | " | II-3 | Sodium sulfite | Comparison |
| T217 | " | " | II-4 | Sodium thiosulfate | Invention |
| T218 | " | " | II-5 | Sodium methanethiosulfonate | Invention |
| T219 | " | " | II-6 | Sodium Thiocyanate | Invention |
| T220 | " | " | II-7 | A-1 | Invention |
| T221 | " | " | II-8 | A-9 | Invention |
| T222 | " | " | II-9 | B-8 | Invention |
| T223 | " | " | II-10 | B-12 | Invention |
| T224 | " | " | II-11 | C-1 | Invention |
| T225 | " | " | II-12 | D-3 | Invention |
| T226 | " | " | II-13 | E-16 | Invention |

*1) 3.9 g/liter of sodium sulfite was added.

TABLE 7

| Test No. | Development Processing I | Development Processing II | Ratio of Gradient of Yellow $\gamma_{II}(Y)/\gamma_{I}(Y)$ | Ratio of Gradient of Magenta $\gamma_{II}(M)/\gamma_{I}(M)$ | Ratio of Gradient of Cyan $\gamma_{II}(C)/\gamma_{I}(C)$ | of Cyan Remarks |
|---|---|---|---|---|---|---|
| T201 | I-1 | II-1 | 0.98 | 1.01 | 0.66 | Comparison |
| T202 | " | II-2 | 0.92 | 0.95 | 0.63 | Comparison |
| T203 | " | II-3 | 0.93 | 0.95 | 0.64 | Comparison |
| T204 | " | II-4 | 0.96 | 0.98 | 0.65 | Comparison |
| T205 | " | II-5 | 0.95 | 0.97 | 0.64 | Comparison |
| T206 | " | II-6 | 0.96 | 0.97 | 0.65 | Comparison |
| T207 | " | II-7 | 0.98 | 1.00 | 0.67 | Comparison |
| T208 | " | II-8 | 0.98 | 1.00 | 0.66 | Comparison |
| T209 | " | II-9 | 1.00 | 1.01 | 0.67 | Comparison |
| T210 | " | II-10 | 1.01 | 1.01 | 0.67 | Comparison |
| T211 | " | II-11 | 0.97 | 1.00 | 0.66 | Comparison |
| T212 | " | II-12 | 0.98 | 1.00 | 0.65 | Comparison |
| T213 | " | II-13 | 0.97 | 1.01 | 0.65 | Comparison |
| T214 | I-1 | II-1 | 1.02 | 1.01 | 1.02 | Invention |
| T215 | " | II-2 | 0.93 | 0.96 | 0.68 | Comparison |
| T216 | " | II-3 | 0.96 | 0.98 | 0.73 | Comparison |
| T217 | " | II-4 | 0.99 | 0.99 | 0.91 | Invention |

TABLE 7-continued

| Test No. | Development Processing I | Development Processing II | Ratio of Gradient of Yellow $\gamma_{II}(Y)/\gamma_{I}(Y)$ | Ratio of Gradient of Magenta $\gamma_{II}(M)/\gamma_{I}(M)$ | Ratio of Gradient of Cyan $\gamma_{II}(C)/\gamma_{I}(C)$ | of Cyan Remarks |
|---|---|---|---|---|---|---|
| T218 | " | II-5 | 0.99 | 0.99 | 0.92 | Invention |
| T219 | " | II-6 | 1.00 | 0.98 | 0.89 | Invention |
| T220 | " | II-7 | 1.02 | 1.01 | 0.99 | Invention |
| T221 | " | II-8 | 1.00 | 1.00 | 0.96 | Invention |
| T222 | " | II-9 | 1.02 | 1.02 | 1.00 | Invention |
| T223 | " | II-10 | 1.03 | 1.001 | 1.01 | Invention |
| T224 | " | II-11 | 1.00 | 1.00 | 0.97 | Invention |
| T225 | " | II-12 | 0.99 | 1.01 | 0.94 | Invention |
| T226 | " | II-13 | 0.99 | 1.00 | 0.95 | Invention |

TABLE 8

| Sample No. | Development Processing II | Color Turbidity (development processing II) | Sharpness (development processing II) | Remarks |
|---|---|---|---|---|
| T201 | II-1 | −0.28 | 100 | Comparison |
| T202 | II-2 | −0.27 | 99 | Comparison |
| T203 | II-3 | −0.29 | 101 | Comparison |
| T204 | II-4 | −0.28 | 100 | Comparison |
| T205 | II-5 | −0.29 | 102 | Comparison |
| T206 | II-6 | −0.30 | 101 | Comparison |
| T207 | II-7 | −0.29 | 101 | Comparison |
| T208 | II-8 | −0.29 | 100 | Comparison |
| T209 | II-9 | −0.28 | 100 | Comparison |
| T210 | II-10 | −0.29 | 102 | Comparison |
| T211 | II-11 | −0.29 | 103 | Comparison |
| T212 | II-12 | −0.28 | 101 | Comparison |
| T213 | II-13 | −0.28 | 102 | Comparison |
| T214 | II-1 | −0.45 | 112 | Invention |
| T215 | II-2 | −0.35 | 103 | Comparison |
| T216 | II-3 | −0.39 | 108 | Comparison |
| T217 | II-4 | −0.43 | 110 | Invention |
| T218 | II-5 | −0.44 | 110 | Invention |
| T219 | II-6 | −0.44 | 111 | Invention |
| T220 | II-7 | −0.45 | 113 | Invention |
| T221 | II-8 | −0.44 | 111 | Invention |
| T222 | II-9 | −0.45 | 112 | Invention |
| T223 | II-10 | −0.46 | 112 | Invention |
| T224 | II-11 | −0.44 | 111 | Invention |
| T225 | II-12 | −0.45 | 110 | Invention |
| T226 | II-13 | −0.44 | 111 | Invention |

As is apparent from the above results, the present invention can provide an image-forming method using the photographic material of the present invention and the silver halide solvent for use in the present invention with which an image excellent in the balance of gradation in rapid processing, color reproducibility and sharpness can be obtained.

EXAMPLE 3

Sample Nos. 101 to 113 prepared in Example 1 were processed by development processing A-1 and B-1 shown below and gradients, $\gamma_A(Y)/\gamma_B(Y)$, $\gamma_A(M)/\gamma_B(M)$ and $\gamma_A(C)/\gamma_B(C)$, color turbidity and sharpness in development processing A-1 and B-1 were evaluated in the same manner as in Example 1.

Running processing was conducted by development processing A-1 and B-1 using photographed Sample No. 101 until the replenished amount of each color developing replenisher reached 3 times of the tank capacity, and these solutions were used in the processing of the above evaluation.

Processing Step of Development Processing A-1 and Composition of the Solution

Processing Step

| Step | Processing Time | Processing Temperature (° C.) | Replenishment Rate* (ml) | Tank Capacity (liter) |
|---|---|---|---|---|
| Color Development | 3 min 5 sec | 38.0 | 23 | 17 |
| Bleaching | 50 sec | 38.0 | 5 | 5 |
| Blixing | 50 sec | 38.0 | — | 5 |
| Fixing | 50 sec | 38.0 | 16 | 5 |
| Washing | 30 sec | 38.0 | 34 | 3.5 |
| Stabilization (1) | 20 sec | 38.0 | — | 3 |
| Stabilization (2) | 20 sec | 38.0 | 20 | 3 |
| Drying | 1 min 30 sec | 60 | | |

*Replenishment rate: per 1.1 meter of 35 mm wide photographic material (corresponding to a 24 Ex. film)

Stabilization was conducted in a countercurrent system from (2) to (1), and the overflow from the washing tank was all introduced into the fixing tank. The upper portion of the bleaching tank and the upper portion of the fixing tank of the automatic processor were notched so that the overflow produced by the supply of the replenishers to the bleaching tank and the fixing tank were all introduced into the bleach-fixing (blixing) tank. Further, the amount of carryover of the developing solution into the bleaching step, the amount of carryover of the bleaching solution to the blixing step, the amount of carryover of the blixing solution to the fixing step, and the amount of carryover of the fixing solution to the washing step were 2.5 ml, 2.0 ml, 2.0 ml, and 2.0 ml per 1.1 meter of 35 mm wide photographic material, respectively. Further, the crossover time was 6 seconds in each case, and this time is included in the processing time of the previous step.

The composition of each processing solution is described below.

Color Developing Solution

| | Tank Solution (g) | Replenisher (g) |
|---|---|---|
| Diethylenetriaminepentaacetic Acid | 2.0 | 2.0 |
| 1-Hydroxyethylidene-1,1-diphosphonic Acid | 2.0 | 2.0 |

-continued

Color Developing Solution

| | Tank Solution (g) | Replenisher (g) |
|---|---|---|
| Sodium Sulfite | 3.9 | 5.1 |
| Potassium Carbonate | 37.5 | 39.0 |
| Potassium Bromide | 1.4 | 0.4 |
| Potassium Iodide | 1.3 mg | — |
| Hydroxylamine Sulfate | 2.4 | 3.3 |
| Disodium N,N-Bis(sulfonatoethyl)-hydroxylamine | 1.5 | 2.0 |
| 2-Methyl-4-[N-ethyl-N-(β-hydroxy-ethyl)amino]aniline Sulfate | 4.8 | 6.5 |
| Water to make | 1.0 l | 1.0 l |
| pH (adjusted with potassium hydroxide and sulfuric acid) | 10.05 | 10.15 |

Bleaching Solution

| | Tank Solution (g) | Replenisher (g) |
|---|---|---|
| Ammonium 1,3-Diaminopropanetetra-acetato Ferrate Monohydrate | 130 | 195 |
| Ammonium Bromide | 70 | 105 |
| Ammonium Nitrate | 14 | 21 |
| Hydroxyacetic Acid | 50 | 75 |
| Acetic Acid | 40 | 60 |
| Water to make | 1.0 l | 1.0 l |
| pH (adjusted with aqueous ammonia) | 4.4 | 4.4 |

Blixing Tank Solution

The mixed solution of 15/85 mixture (volume ratio) of the above bleaching tank solution and the following fixing tank solution (pH: 7.0)

| Fixing Solution | Tank Solution (g) | Replenisher (g) |
|---|---|---|
| Ammonium Sulfite | 19 | 57 |
| Aqueous Ammonium Thiosulfate Solution (700 g/liter) | 280 ml | 840 ml |
| Imidazole | 15 | 45 |
| Ethylenediaminetetraacetic Acid | 15 | 45 |
| Water to make | 1.0 l | 1.0 l |
| pH (adjusted with aqueous ammonia and acetic acid) | 7.4 | 7.45 |

Washing Water

The same composition as in Example 1 was used.

Stabilizing Solution

The same composition as in Example 1 was used.

Processing Step of Development Processing B-1 and Composition of the Solution

Processing Step

| Step | Processing Time (sec) | Processing Temperature (° C.) | Replenishment Rate* (ml) | Tank Capacity (liter) |
|---|---|---|---|---|
| Color Development | 60 | 45.0 | 260 | 1 |
| Bleaching | 20 | 45.0 | 130 | 1 |
| Fixing | 40 | 45.0 | 100 | 1 |
| Washing (1) | 15 | 45.0 | - | 1 |
| Washing (2) | 15 | 45.0 | - | 1 |
| Washing (3) | 15 | 45.0 | 400 | 1 |
| Drying | 45 | 80 | | |

*Replenishment rate: per $m^2$ of a photographic material

From washing (3) to fixing tank in a multistage counter-current cascade system

The composition of each processing solution is described below.

| Color Developing Solution | Tank Solution (g) | Replenisher (g) |
|---|---|---|
| Diethylenetriaminepentaacetic Acid | 2.0 | 4.0 |
| 1-Hydroxyethylidene-1,1-diphosphonic Acid | 3.3 | 3.3 |
| Sodium Sulfite | 3.9 | 6.5 |
| Potassium Carbonate | 37.5 | 39.0 |
| Potassium Bromide | 2.0 | — |
| Potassium Iodide | 1.3 mg | — |
| Disodium N,N-Bis(sulfonatoethyl)-hydroxylamine | 12.0 | 17.0 |
| 2-Methyl-4-[N-ethyl-N-(β-hydroxy-ethyl)amino]aniline Sulfate | 11.5 | 15.0 |
| Silver Halide Solvent | 0.27 | 0.44 |
| Water to make | 1.0 l | 1.0 l |
| pH (adjusted with potassium hydroxide and sulfuric acid) | 10.05 | 10.25 |

| Bleaching Solution | Tank Solution (g) | Replenisher (g) |
|---|---|---|
| Ammonium 1,3-Diaminopropanetetra-acetato Ferrate Monohydrate | 0.33 | 0.50 |
| Ferric Nitrate 9 Hydrate | 0.30 | 4.5 |
| Ammonium Bromide | 0.80 | 1.20 |
| Ammonium Nitrate | 0.20 | 0.30 |
| Acetic Acid | 0.67 | 1.0 |
| Water to make | 1.0 l | 1.0 l |
| pH (adjusted with aqueous ammonia) | 4.5 | 4.0 |

| Fixing Solution | Replenisher equals tank solution (unit: g) |
|---|---|
| Ammonium sulfite | 28 |
| Aqueous Ammonium Thiosulfate Solution (700 g/liter) | 280 ml |
| Imidazole | 15 |
| Ethylenediaminetetraacetate | 15 |
| Water to make | 1.0 l |
| pH (adjusted with aqueous ammonia and acetic acid) | 5.8 |

Washing Water

The washing water having the same composition as in Example 1 was used.

Stabilizing Solution

The stabilizing solution having the same composition as in Example 1 was used.

The results obtained are shown in Tables 9 and 10. The same results as in Example 1 were obtained and it was understood that the photographic material of the present invention shows less gradient fluctuation in rapid processing and less degradation of color reproducibility and sharpness.

TABLE 9

| Sample No. | DIR Coupler in 3rd and 4th Layers | DIR Coupler in 5th Layer | Ratio of Gradient of Yellow $\gamma_A(Y)/\gamma_B(Y)$ | Ratio of Gradient of Magenta $\gamma_A(M)/\gamma_B(M)$ | Ratio of Gradient of Cyan $\gamma_A(C)/\gamma_B(C)$ | Remarks |
|---|---|---|---|---|---|---|
| 101 | ExC-6 | ExC-6 | 0.99 | 1.03 | 0.68 | Comparison |
| 102 | Ex-1 | ExC-6 | 0.99 | 1.02 | 0.68 | Comparison |
| 103 | Ex-1 | Ex-1 | 0.98 | 1.02 | 0.67 | Comparison |
| 104 | (2) | ExC-6 | 1.02 | 1.04 | 1.02 | Invention |
| 105 | (3) | ExC-6 | 1.02 | 1.03 | 0.95 | Invention |
| 106 | (4) | ExC-6 | 1.01 | 1.02 | 1.01 | Invention |
| 107 | (7) | ExC-6 | 1.00 | 1.03 | 0.88 | Invention |
| 108 | (11) | ExC-6 | 1.01 | 1.02 | 1.00 | Invention |
| 109 | (31) | ExC-6 | 1.01 | 1.02 | 1.01 | Invention |
| 110 | (34) | ExC-6 | 1.02 | 1.04 | 1.00 | Invention |
| 111 | (2) | (2) | 1.02 | 1.02 | 1.05 | Invention |
| 112 | (3) | (3) | 1.02 | 1.02 | 1.02 | Invention |
| 113 | (4) | (4) | 1.01 | 1.02 | 1.03 | Invention |

TABLE 10

| Sample No. | Color Turbidity (processing A) | Color Turbidity (processing B) | Sharpness (processing A) | Sharpness (processing B) | Remarks |
|---|---|---|---|---|---|
| 101 | −0.31 | −0.27 | 100 | 91 | Comparison |
| 102 | −0.25 | −0.22 | 99 | 86 | Comparison |
| 103 | −0.24 | −0.19 | 95 | 84 | Comparison |
| 104 | −0.32 | −0.35 | 100 | 99 | Invention |
| 105 | −0.34 | −0.35 | 99 | 97 | Invention |
| 106 | −0.31 | −0.32 | 100 | 99 | Invention |
| 107 | −0.33 | −0.33 | 101 | 99 | Invention |
| 108 | −0.30 | −0.31 | 100 | 99 | Invention |
| 109 | −0.32 | −0.35 | 101 | 100 | Invention |
| 110 | −0.32 | −0.35 | 100 | 99 | Invention |
| 1I1 | −0.34 | −0.40 | 102 | 101 | Invention |
| 112 | −0.32 | −0.41 | 102 | 101 | Invention |
| 113 | −0.34 | −0.40 | 102 | 102 | Invention |

EXAMPLE 4

Development processing was carried out in the same manner as in Example 3 using Sample No. 113 prepared in Example 1 except that silver halide solvent in color developing solution of development processing B in Example 3 was changed as shown in Table 11.

The magnetic signals recorded at the time of sample preparation were read out using the processed sample at the same speed with the input time and read error rate was counted as the ratio of the number of erroneous bits to the number of inputted bits. If this error rate is 0.1% or more, it is impracticable, but if 0.05% or less, preferably 0.01% or less, it means practicable.

TABLE 11

| Test No. | Development Processing | Silver Halide Solvent | Readout Error Rate | Remarks |
|---|---|---|---|---|
| T401 | B-1 | B-3 | 0.007 | Invention |
| T402 | B-2 | Not added | 0.079 | Comparison |
| T403 | B-3 | Sodium sulfite | 0.052 | Comparison |

TABLE 11-continued

| Test No. | Development Processing | Silver Halide Solvent | Readout Error Rate | Remarks |
|---|---|---|---|---|
| T404 | B-4 | Sodium thiosulfate | 0.009 | Invention |
| T405 | B-5 | Sodium methanethio-sulfonate | 0.009 | Invention |
| T406 | B-6 | Sodium thiocyanate | 0.008 | Invention |
| T407 | B-7 | A-1 | 0.007 | Invention |
| T408 | B-8 | A-9 | 0.006 | Invention |
| T409 | B-9 | B-8 | 0.008 | Invention |
| T410 | B-10 | B-12 | 0.007 | Invention |
| T411 | B-11 | C-1 | 0.008 | Invention |
| T412 | B-12 | D-3 | 0.009 | Invention |
| T413 | B-13 | E-16 | 0.008 | Invention |

As is apparent from the results, readout accuracy of magnetic recording information has been conspicuously improved by the image forming method of the present invention.

While the invention has been described in detail and with reference to specific examples thereof, it will be apparent to one skilled in the art that various changes and modifications can be made therein without departing from the spirit and scope thereof.

What is claimed is:

1. A method for forming a color image using a silver halide color photographic material comprising a transparent support having thereon at least one blue-sensitive silver halide emulsion layer, at least one green-sensitive silver halide emulsion layer, at least one red-sensitive silver halide emulsion layer and at least one light-insensitive layer, wherein said red-sensitive silver halide emulsion layer contains at least one compound which releases a development inhibitor having a diffusion parameter of 0.3 or more upon reaction with the oxidation product of a color developing agent, and when development processing I and development processing II each having different color developing times are carried out, the gradients of yellow, magenta and cyan obtained by said two kinds of development processing satisfy the following conditions:

$0.8 \leqq \gamma_{II}(Y)/\gamma_{I}(Y) \leqq 1.2$ $0.8 \leqq \gamma_{II}(M)/\gamma_{I}(M) \leqq 1.2$ $0.8 \leqq \gamma_{II}(C)/\gamma_{I}(C) \leqq 1.2$ wherein $\gamma_I$ (Y), $\gamma_I$ (M) and $\gamma_I$ (C) each represents the gradient of yellow, magenta and cyan when development processing I is carried out and $\gamma_{II}$ (Y), $\gamma_{II}$ (M) and $\gamma_{II}$ (C) each represents the gradient of yellow, magenta and cyan when development processing II is carried out, development processing I:

development processing is characterized in that color development processing is carried out (i) for from 3 minutes to 3 minutes and 15 seconds of the color developing time, (ii) at the temperature of a color developing solution of from 37 to 39° C., and (iii) using a color developing solution containing from 15 to 20 mmol/liter of 2-methyl-4-(N-ethyl-N-(β-hydroxyethyl)amino)aniline as a color developing agent;

development processing II:

development processing is characterized in that color development processing is carried out (i) for from 50 seconds to 70 seconds of the color developing time, (ii) at the temperature of a color developing solution of from 43 to 47° C., and (iii) using a color developing solution containing from 35 to 40 mmol/liter of 2-methyl-4-(N-ethyl-N-(β-hydroxyethyl)amino) aniline as a color developing agent, and containing at least one silver halide solvent selected from the group consisting of thiosulfate, methanesulfonate, thiocyanate, the compounds represented by the following formulae (A), (B), (C), (D) and (E):

(A)

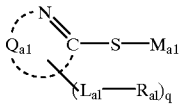

wherein $Q_{a1}$ represents a nonmetal atomic group necessary for forming a 5- or 6-membered heterocyclic ring, and this heterocyclic ring may be condensed with a carbocyclic aromatic ring or a heterocyclic aromatic ring; $L_{a1}$ represents a single bond, a divalent aliphatic group, a divalent aromatic hydrocarbon group, a divalent heterocyclic group, or a linking group of a combination of these groups; $R_{a1}$ represents a carboxylic acid or a salt thereof, a sulfonic acid or a salt thereof, a phosphonic acid or a salt thereof, or an amino group or an ammonium salt, q represents an integer of 1, 2 or 3; and $M_{a1}$ represents a hydrogen atom or a cation;

(B)

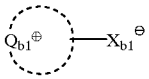

wherein $Q_{b1}$ represents a 5- or 6-membered mesoionic ring constituted with a carbon atom, a nitrogen atom, an oxygen atom, a sulfur atom or a selenium atom; $X_{b1}^-$ represents —O—, —S⁻, —NR⁻$R_{b1}$; and $R_{b1}$ represents an aliphatic group, an aromatic hydrocarbon group or a heterocyclic group;

$$L_{c1}—(A_{c1}—L_{c2})_r—A_{c2}—L_{c3} \quad (C)$$

wherein $L_{c1}$ and $L_{c3}$, which may be the same or different, each represents an aliphatic group, an aromatic hydrocarbon group or a heterocyclic group; $L_{c2}$ represents a divalent aliphatic group, a divalent aromatic hydrocarbon group, a divalent heterocyclic linking group or a linking group of a combination of these groups; $A_{c1}$ and $A_{c2}$ each reresents —S—, —CO—, —$NR_{c20}$—, —CO—, —$SO_2$— or a group of a combination of these groups; r represents an integer of from 1 to 10; provided that at least one $L_{c1}$ and $L_{c3}$ is substituted with —$SO_3M_{c1}$, —$PO_3M_{c2}M_{c3}$, —$NR_{c1}(R_{c2})$, —$N^+R_{c3}(R_{c4})(R_{c5})$ .$X_{c1}^-$, —$SO_2NR_{c6}(R_{c7})$, —$NR_{c8}SO_2R_{c9}$, —$CONR_{c10}(R_{c11})$, —$NR_{c12}COR_{c13}$, —$SO_2R_{c14}$, —$PO(—NR_{c15}(R_{c16}))_2$, —$NR_{c17}CONR_{c18}(R_{c19})$, —$COOM_{c4}$ or a heterocyclic group; $M_{c1}$, $M_{c2}$, $M_{c3}$ and $M_{c3}$, which may be the same or different, each represents a hydrogen atom or a counter cation; $R_{c1}$ to $R_{c20}$, which may be the same or different, each represents a hydrogen atom, an aliphatic group or an aromatic hydrocarbon group; and $X_{c1}^-$ represents a counter anion; provided that at least one of $A_{c1}$ and $A_{c2}$ represents —S—;

(D)

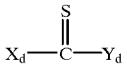

wherein $X_d$ and $Y_d$ each represents an aliphatic group, an aromatic hydrocarbon group, a heterocyclic group, —$N(R_{d1})R_{d2}$, —$N(R_{d3})N(R_{d4})R_{d5}$, —$OR_{d6}$, or —$SR_{d7}$, further, $X_d$ and $Y_d$ may form a ring but do not enolize, provided that at least one of $X_d$ and $Y_d$ is substituted with at least one of a carboxylic acid or a salt thereof, a sulfonic acid or a salt thereof, a phosphonic acid or a salt thereof, an amino group or an ammonium group, and a hydroxyl group; $R_{d1}$, $R_{d2}$, $R_{d3}$, $R_{d4}$, and $R_{d5}$ each represents a hydrogen atom, an aliphatic group, an aromatic hydrocarbon group or a heterocyclic group: and $R_{d6}$ and $R_{d7}$ each represents a hydrogen atom, a cation, an aliphatic group, an aromatic hydrocarbon group or a heterocyclic group;

(E)

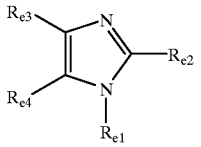

wherein $R_{e1}$, $R_{e2}$, $R_{e3}$ and $R_{e4}$ each represents a hydrogen atom, an alkyl group or an alkenyl group;

wherein a color image is formed by carrying out the following development processing B, development processing B:

development processing is characterized in that color development processing is carried out (i) for from 25 seconds to 90 seconds of the color developing time, (ii) at the temperature of a color developing solution of from 40 to 60° C., and (iii) using a color developing solution containing from 25 to 80 mmol/liter of a color developing agent, and containing at least one silver halide solvent selected from the group consisting of thiosulfate, methanesulfonate, thiocyanate, and the compounds represented by formulae (A), (B), (C), (D) and (E).

2. The method for forming an image as claimed in claim 1, wherein said photographic material has a magnetic recording layer on the side of the support opposite to the side on which the silver halide emulsion layer is provided.

3. The method for forming an image as claimed in claim 1, wherein said silver halide solvent used in the development processing B is selected from the compounds represented by the above formula (A), (B) or (D).

4. The method of claim 1, wherein said development inhibitor has a benzotriazolyl group, a triazolyl group, or a benzimidazolyl group.

5. The method of claim 1, wherein said silver halide solvent used in the development processing II is selected from the compounds represented by the above formula (A), (B), or (D).

6. The method of claim 1, wherein said development processing I is carried out with the following processing solutions according to the following processing step:

Processing Step

| Processing Step | Processing Time | Processing Temperature (° C.) |
|---|---|---|
| Color Development | 3 min 15 sec | 38 |
| Bleaching | 1 min 00 sec | 38 |
| Blixing | 3 min 15 sec | 38 |
| Washing (1) | 1 min 00 sec | 38 |
| Washing (2) | 1 min 00 sec | 38 |
| Drying | 2 min 00 sec | 60 |

Processing Solution

| Color Developing Solution | Tank Solution (g) |
|---|---|
| Diethylenetriaminepentaacetic Acid | 1.0 |
| 1-Hydroxyethylidene-1,1-diphosphonic Acid | 2.0 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-Ethyl-N-(β-hydroxyethyl)amino]-2-methylaniline Sulfate | 4.5 |
| Water to make | 1.0 liter |
| pH (adjusted with potassium hydroxide and sulfuric acid) | 10.05 |

| Bleaching Solution | Tank Solution (g) |
|---|---|
| Ammonium Ethylenediaminetetraacetato Ferrate Dihydrate | 120.0 |
| Disodium Ethylenediaminetetraacetate | 10.0 |
| Ammonium Bromide | 100.0 |
| Ammonium Nitrate | 10.0 |
| Bleach Accelerating Agent $(CH_3)_2N—CH_2—CH_2—S—S—CH_2—CH_2—N(CH_3)_2.2HCl$ | 0.005 mol |
| Aqueous Ammonia (27%) | 15.0 ml |
| Water to make | 1.0 liter |
| pH (adjusted with aqueous ammonia and nitric acid) | 6.3 |

| Blixing Solution | Tank Solution (g) |
|---|---|
| Ammonium Ethylenediaminetetraacetato Ferrate Dihydrate | 50.0 |
| Disodium Ethylenediaminetetraacetate | 5.0 |
| Sodium Sulfite | 12.0 |
| Aqueous Solution of Ammonium Thiosulfate (700 g/liter) | 240.0 ml |

-continued

| Blixing Solution | Tank Solution (g) |
|---|---|
| Aqueous Ammonia (27%) | 6.0 ml |
| Water to make | 1.0 liter |
| pH (adjusted with aqueous ammonia and acetic acid) | 7.2 |

Washing Water (tank solutions (1) and (2) are common)

City water was passed through a mixed bed column packed with an H-type strongly acidic cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 0.15 g/liter of sodium sulfate were added thereto, and the pH of this washing water was in the range of from 6.5 to 7.5; and said development processing II is carried out with the following processing solutions according to the following processing step:

Processing Step

| Processing Step | Processing Time | Processing Temperature (° C.) |
|---|---|---|
| Color Development | 60 sec | 45 |
| Bleaching | 1 min 00 sec | 38 |
| Blixing | 3 min 15 sec | 38 |
| Washing (1) | 1 min 00 sec | 38 |
| Washing (2) | 1 min 00 sec | 38 |
| Drying | 2 min 00 sec | 60 |

Processing Solution

| Color Developing Solution | Tank Solution (g) |
|---|---|
| Diethylenetriaminepentaacetic Acid | 2.0 |
| 1-Hydroxyethylidene-1,1-diphosphonic Acid | 3.0 |
| Sodium Sulfite | 3.9 |
| Potassium Carbonate | 37.5 |
| Potassium Bromide | 2.0 |
| Potassium Iodide | 1.3 mg |
| Hydroxylamine Sulfate | 4.5 |

-continued

| Color Developing Solution | Tank Solution (g) |
|---|---|
| Silver Halide Solvent (Compound B-3) | 0.27 |
| 2-Ethyl-4-[N-ethyl-N-(β-hydroxyethyl)-amino]aniline Sulfate | 11.0 |
| Water to make | 1.0 liter |
| pH (adjusted with potassium hydroxide and sulfuric acid) | 10.05 |

| Bleaching Solution | Tank Solution (g) |
|---|---|
| Ammonium Ethylenediaminetetraacetato Ferrate Dihydrate | 120.0 |
| Disodium Ethylenediaminetetraacetate | 10.0 |
| Ammonium Bromide | 100.0 |
| Ammonium Nitrate | 10.0 |
| Bleach Accelerating Agent $(CH_3)_2N—CH_2—CH_2—S—S—CH_2—CH_2—N(CH_3)_2.2HCl$ | 0.005 mol |
| Aqueous Ammonia (27%) | 15.0 ml |
| Water to make | 1.0 liter |
| pH (adjusted with aqueous ammonia and nitric acid) | 6.3 |

| Blixing Solution | Tank Solution (g) |
|---|---|
| Ammonium Ethylenediaminetetraacetato Ferrate Dihydrate | 50.0 |
| Disodium Ethylenediaminetetraacetate | 5.0 |
| Sodium Sulfite | 12.0 |
| Aqueous Solution of Ammonium Thiosulfate (700 g/liter) | 240.0 ml |
| Aqueous Ammonia (27%) | 6.0 ml |
| Water to make | 1.0 liter |
| pH (adjusted with aqueous ammonia and acetic acid) | 7.2 |

Washing Water (tank solutions (1) and (2) are common)

City water was passed through a mixed bed column packed with an H-type strongly acidic cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 0.15 g/liter of sodium sulfate were added thereto, and the pH of this washing water was in the range of from 6.5 to 7.5.

7. The method of claim 1, wherein said development inhibitor has a benzotriazolyl group.

8. The method of claim 1, wherein the gradients of yellow, magenta and cyan obtained by said two kinds of development processing satisfy the following conditions:

$0.9 \leqq \gamma_{II}(C)/\gamma_{I}(C) \leqq 1.1$ $0.9 \leqq \gamma_{II}(M)/\gamma_{I}(M) \leqq 1.1$ $0.9 \leqq \gamma_{II}(Y)/\gamma_{I}(Y) \leqq 1.1$.

9. The method of claim 1, wherein the color development processing of development processing II is carried out in 60 seconds of the color developing time.

10. The method of claim 1, wherein the color development processing of development processing II is carried out using a color developing solution containing 37 to 38 mmol/liter of 2-methyl-4-(N-ethyl-N-(β-hydroxyethyl) amino)aniline as a color developing agent.

11. The method of claim 1, wherein the color development processing of development processing II is carried out at the termperature of a color developing solution of 45° C.

12. The method of claim 1, wherein the development inhibitor does not contain a sulfur atom.

13. The method of claim 1, wherein the diffusion parameter of the development inhibitor is 0.4 or more.

14. The method of claim 13, wherein the diffusion parameter of the development inhibitor is 0.95 or less.

* * * * *